US006991141B2

(12) United States Patent
Ciko et al.

(10) Patent No.: US 6,991,141 B2
(45) Date of Patent: Jan. 31, 2006

(54) METHODS OF PRODUCING AND TREATING TWISTED BEADS

(76) Inventors: Marcus J. Ciko, 422 Candlewood Dr., Slidell, LA (US) 70458; Spencer Anderson, 529 Cleveland Ave., Slidell, LA (US) 70458

( * ) Notice: Subject to any disclaimer, the term of this patent is extended or adjusted under 35 U.S.C. 154(b) by 33 days.

(21) Appl. No.: 10/264,788

(22) Filed: Oct. 4, 2002

(65) Prior Publication Data

US 2003/0136150 A1 Jul. 24, 2003

Related U.S. Application Data

(60) Provisional application No. 60/388,903, filed on Jun. 14, 2002, provisional application No. 60/327,038, filed on Oct. 4, 2001, and provisional application No. 60/327,022, filed on Oct. 4, 2001.

(51) Int. Cl.
*A41H 43/00* (2006.01)

(52) U.S. Cl. ..... 223/48

(58) Field of Classification Search ..... 223/48; 63/37, 38, 39; 57/209; 434/276, 279, 211; 446/119, 85, 490, 102, 107; 59/2, 92
See application file for complete search history.

(56) References Cited

U.S. PATENT DOCUMENTS 6,241,572 B1 * 6/2001 Braginsky ..... 446/85

* cited by examiner

*Primary Examiner*—Rodney M. Lindsey
*Assistant Examiner*—James G Smith
(74) *Attorney, Agent, or Firm*—Wyatt, Tarrant & Combs, L.L.P.

(57) ABSTRACT

Methods of using carnival beads to create twisted bead structures. A plurality of primary bead strands and shorter Prep pieces are twisted together in order to create quaternary structures having particular three-dimensional configurations. The structures can be interlocked together to form larger structures. The twisted beads can be coated with a protective coating.

18 Claims, 101 Drawing Sheets

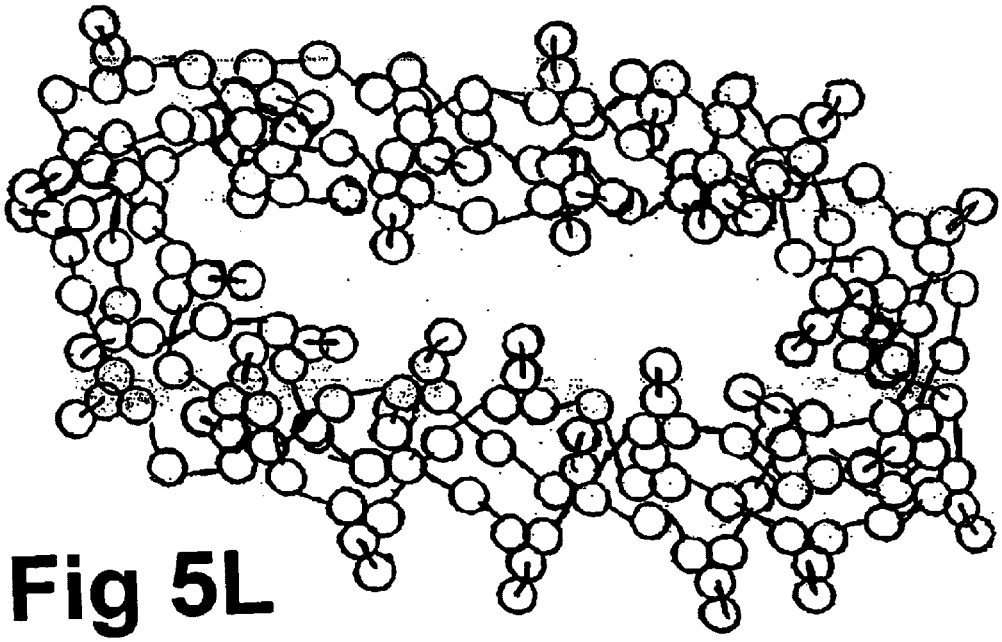
Fig 5L
Fig 5N
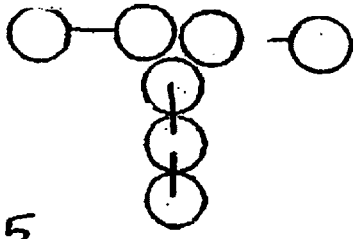
Fig 5M
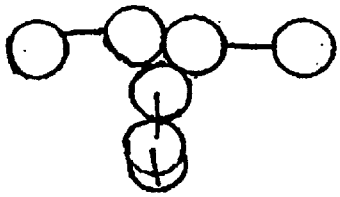
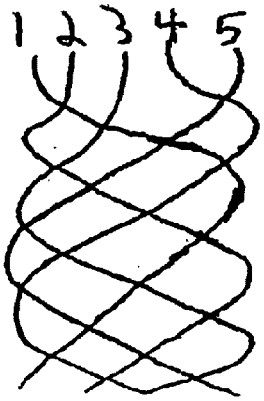
Fig 5O

METHODS OF PRODUCING AND TREATING TWISTED BEADS

CROSS REFERENCE TO RELATED APPLICATIONS

Applicants claim priority to the following related provisional applications: U.S. Provisional Patent Application Ser. No. 60/327,022, filed Oct. 4, 2001, U.S. Provisional Patent Application Ser. No. 60/327,038, filed Oct. 4, 2001, and U.S. Provisional Patent Application Ser. No. 60/388,903, filed Jun. 14, 2002.

STATEMENT REGARDING FEDERALLY SPONSORED RESEARCH OR DEVELOPMENT

Not applicable

REFERENCE TO A MICROFICHE APPENDIX

Not applicable

FIELD OF THE INVENTION

The present invention relates to ornamental jewelry in the nature of beads, and more particularly to strands of plastic beads that are typically used in conjunction with Mardi Gras and other festive occasions. More particularly, the present invention relates to novel methods of twisting multiple strands of beads together and treating the twisted strands to prevent snagging and deterioration.

BACKGROUND OF THE INVENTION

It is well known to place a plurality of beads on a string in order to form a necklace or bracelet. The beads may be made of various well known substances, including plastic, glass, pearls and diamonds. Plastic beads are particularly favored for festive and decorative use, such as during Mardi Gras celebrations. Plastic beads are typically molded directly onto the string, such that the beads are permanently affixed to the string and cannot slid along the string. These types of plastic beads are sometimes referred to as "Mardi Gras beads" or "carnival beads."

In recent years, the market for plastic beads has expanded. Bead manufactures have introduced many variations on conventional plastic beads strands, including, for example, beads of novel shapes, beads that light up, and necklaces that produce sound. However, as far as the inventor is aware, no one has attempted to twist beads together in the manner disclosed below.

OBJECTS AND SUMMARY OF THE INVENTION

It is an object of the invention to provide novel methods of twisting beads together to form interconnected strands of beads having enhanced three dimensional characteristics and quaternary structures.

It is another object of the invention to provide methods of twisting beads together that can be used to produce three dimensional objects and quaternary structures consisting of dozens of interconnected strands of beads.

It is another object of the invention to provide a plurality of methods of twisting beads together that can be combined to produce three dimensional objects and quaternary structures consisting of dozens of interconnected strands of bead.

It is yet another object of the invention to provide novel methods of coating twisted beads in order to protect them, prevent problems with snagging of hair or clothing, prevent breakage of strings, and generally prolong the life of a strand of twisted beads.

These and other objects and advantages of the invention shall become apparent from the following general and preferred description of the invention.

BRIEF DESCRIPTION OF THE DRAWINGS

FIGS. 8A–8J provide preferred embodiments of steps of making Diamondz beads, along with examples of variations of these types of twisted beads.

FIGS. 17A–17J provide preferred embodiments of steps of making Breakbeadz beads, along with examples of variations of these types of twisted beads.

PREFERRED EMBODIMENTS OF THE INVENTION

Figure 1A:
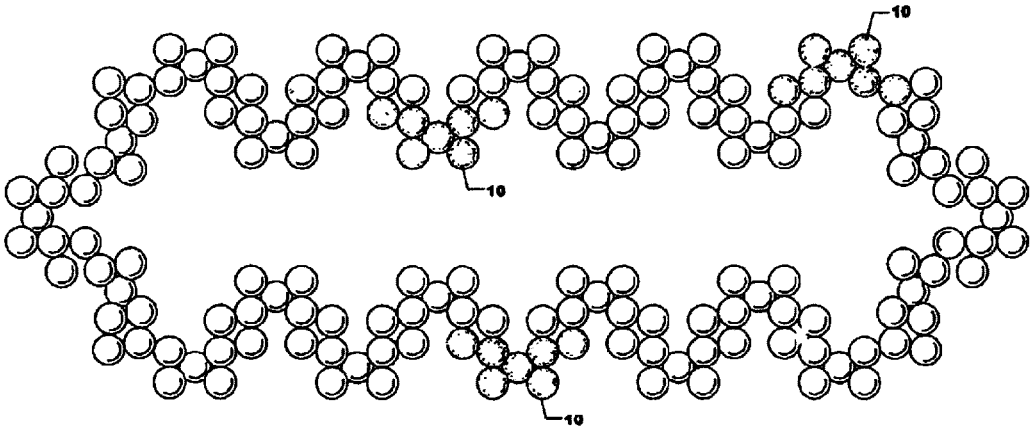
FIG. 1 is a preferred embodiment of a strand of beads twisted in accordance with the boxes method of the invention.

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

This invention takes advantage of properties of conventional strands of plastic beads such as the type used during Mardi Gras celebrations. These types of strands of beads are typically referred to as "Mardi Gras beads" or "carnival beads." Carnival beads consist of a plurality of beads that are fixedly molded onto a string, such that the beads cannot slide along the string. There is a slight gap between each pair of beads. The main advantages of plastic bead strands are that they are inexpensive to manufacture, the beads can be molded in various sizes and shapes, and the beads can made of various selected colors or color patterns. Although the invention will be described in terms of conventional plastic beads, the techniques of the invention can be carried out with other types of beads. Additionally, the techniques described in this application can be applied to conventional beads that are threaded onto a string.

Methods of Twisting Beads

The invention includes various methods of twisting a plurality of carnival beads together to produce quaternary structures. A quaternary structure is one that is formed from a plurality of subunits. The concept of quaternary structures is well-developed in the field of protein chemistry, where the term is used to describe enzymes or structural proteins that are formed from a plurality of peptide subunits. Each peptide consists of a strand of amino acids, with the amino acids linked to one another in a manner analogous to a strand of carnival beads. The overall organization of the subunits is known as the quaternary structure. Se *Enzyme Structure and Mechanism,* $2^{nd}$ Ed., by Alan Fersht, p. 15 (W. H. Freeman and Co.). Quaternary refers to the arrangement of the subunits in space and the ensemble of the subunit contacts and interactions, without regard to the internal geometry of the subunits. Id. The three dimensional structure of each subunit is referred to as its tertiary structure. Id.

The present application focuses on two particular types of twisted beads, namely Helixez beads and Building Blockz beads. However, the specification also discloses detailed instructions for methods of constructing the following varieties of twisted beads:

1. Boxez
2. Braidz
3. Building Blockz
4. Curlz
5. Diamondz
6. Fabricz
7. Flowerz
8. Helixez
9. Linkz
10. Loopz
11. Medallionz
12. Spiralz
13. Starz
14. Breakbeadz
15. Spherez
16. Hybridz These techniques can be used to make a strand or necklace of beads such as the type shown in FIG. 1. Additionally, these techniques can be used in creative ways to create large three dimensional objects out of beads, such as a hat or a flag. The basic types of twisted beads described herein can be combined with one another to form further types of twisted beads, i.e. hybrid twisted beads.

Figure 1B:
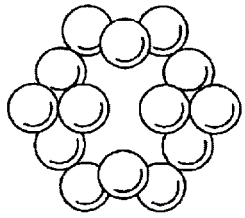
Figure 1C:
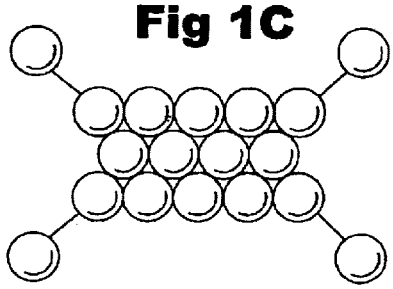

FIG. 1A shows a strand of twisted beads 10 that was created using the boxez technique of the invention. FIG. 1B shows a double boxez configuration. FIG. 1C shows a level II boxez configuration.

Methods of Making Helixez Beads

Helixez is a quaternary Carnival bead design that is created by twisting conventional Carnival beads together in a circular formation that spirals around. Helixez is a mathematical pattern that repeats constantly, giving the product its consistency. There are many variations within the Helixez pattern; however, the repetitious mathematics distinguishes the product.

Helixez utilize a variety of double-twists, including the six-twist and the 8-twist, and prep pieces such as 4s (i.e. 4 bead strands). The basic rule used in determining the product is cut-up Prep pieces twisted to a spine bead, with the beads spiraling around in a circular or helical formation.

Figure 3A:
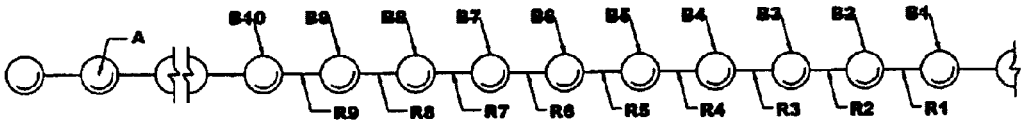
FIGS. 3A–3I provide preferred embodiments of steps of making Helixez beads, along with examples of variations of these types of twisted beads.

The following method(s) can be used to make a Helixez bead structure from carnival beads. As with all of the designs disclosed herein, a Helixez bead structure has a quaternary structure formed from a plurality of twisted carnival bead strands. A basic Helixez bead structure is formed by providing a primary strand A of carnival beads and using Prep-4s to form "forearms" 18 (see FIG. 3E) along the primary strand A. As shown in FIG. 3A, the primary strand A has a plurality of beads B1, B2, B3 etc. fixed thereon. The primary strand A also has a plurality of rope spaces R1, R2, R3 etc. between the beads.

Figure 3B:
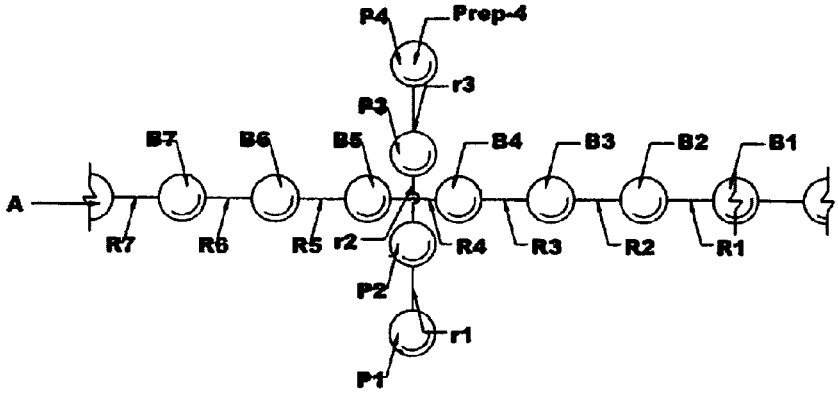

A plurality of Prep-4 strands are prepared by cutting carnival beads into strands having four beads each. As shown in FIG. 3B, each Prep-4 strand has a first rope space r1 between a first bead P1 and a second bead P2, a middle rope space r2 between the second bead P2 and a third bead P3, and a last rope space r3 between the third bead P3 and a fourth bead P4.

Figure 3C:
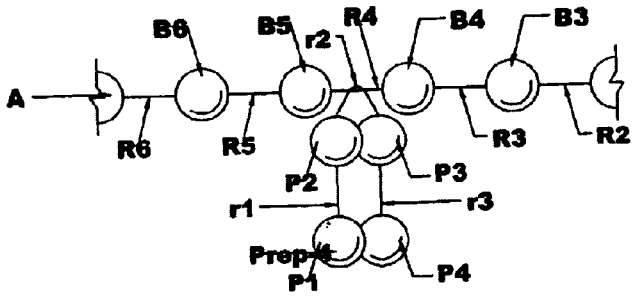

The plurality of forearms 18 are formed along the primary strand using the following steps. First, a Prep-4 is laid over the primary strand such that the middle rope space r2 of the first Prep-4 intersects and contacts a rope space X of the primary strand. At least the first three rope spaces R1–R3 should be left open so that at least one rope space will remain on each end of the Helixez bead structure after the Helixez beads have been formed; the unoccupied rope spaces are used to join a plurality of Helixez bead structures together, in the manner described below. In FIG. 3B, the middle rope space r2 of the prep-4 is shown intersecting rope space R4 of the primary strand A. As shown in FIG. 3C, the first bead P1 and second bead P2 of the Prep-4 hang down on a first side of the primary strand, while the third bead P3 and the fourth bead P4 of the Prep-4 hang down on a second side of the primary strand. Due to the tight spacing between each of the carnival beads (i.e. the length of the rope spaces is substantially less than the outer circumference of the beads) this step is sufficient in itself to interlock the Prep-4 to the primary strand A. However, the interlocking can be significantly strengthened by twisting the Prep-4 180 degrees in the manner shown in FIG. 3D. In order to accomplish the twisted configuration of FIG. 3D, the Prep-4 is twisted around the rope space X of the primary strand A (in FIG. 3D, rope space X=R4) such that the third bead P3 and the fourth bead P4 of Prep-4 are positioned on the first side of the primary strand while the first bead P1 and the second bead P2 are positioned on the second side of the primary strand. In this manner, the middle rope space r2 of the Prep-4 strand is twisted around the rope space X of the primary strand A, thereby interlocking the Prep-4 and the primary strand A to one another.

Figure 3D:
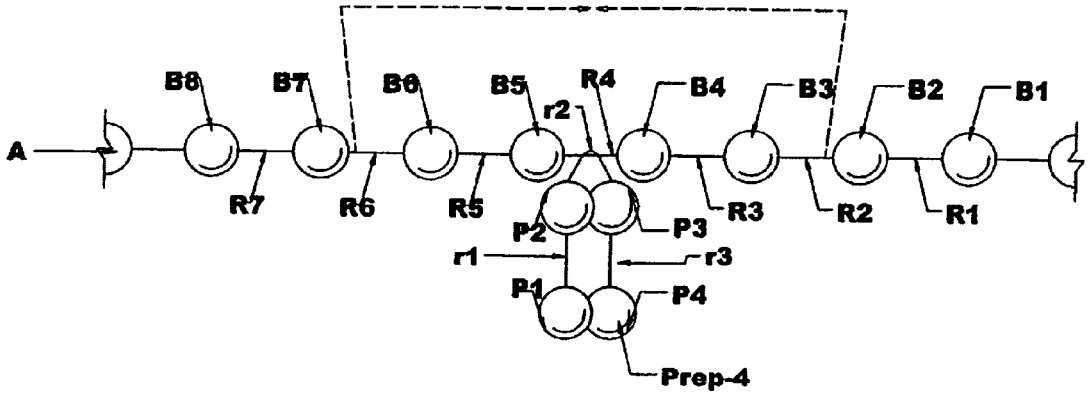
Figure 3E:
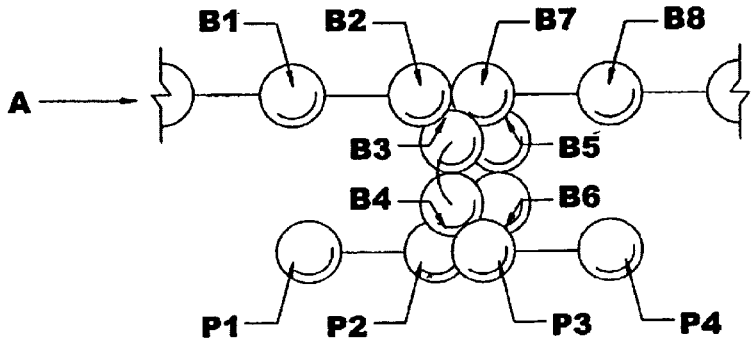
Figure 3F:
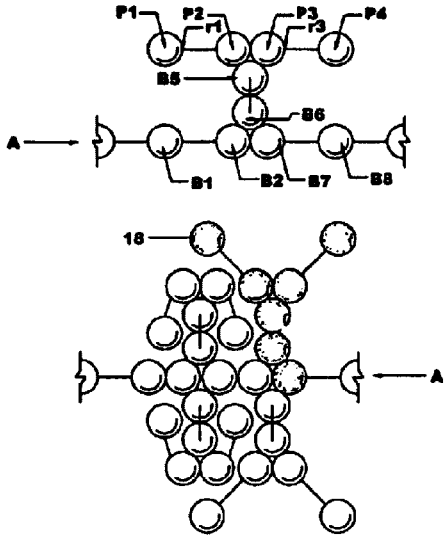

FIGS. 3D and 3E show the final steps that are required in order to form each forearm 18. As indicated in FIG. 3D, rope space X+2 of the primary strand is brought into contact with rope space X−2 of the primary strand (with rope space X being the rope space of the primary strand that is intersected by the Prep-4). In FIG. 3D, rope space X+2=rope space R6, i.e. two spaces greater than rope space R4, while rope space X−2=rope space R2, i.e. two spaces less than rope space R4. Rope space X+2 and rope space X−2 are then twisted 180 degrees relative to one another to form a forearm 18 (see FIG. 3E). FIG. 3F shows a plurality of forearms that have been formed along a primary strand A using the foregoing method.

As indicated in FIG. 3E, the first rope space r1 and the last rope space r3 of the Prep-4 remain unoccupied and are available for twisting to other forearms 18. The Helixez configuration is completed by interlocking each forearm 18 to another of the forearms 18 via twisting of the unoccupied rope space of the forearms 18. In the basic Helixez configuration shown in FIG. 3G, the locking of the forearms 18 is accomplished by sequentially twisting an unoccupied rope space of a forearm 18 around an unoccupied rope space of an immediately adjacent forearm 18.

Figure 3G:
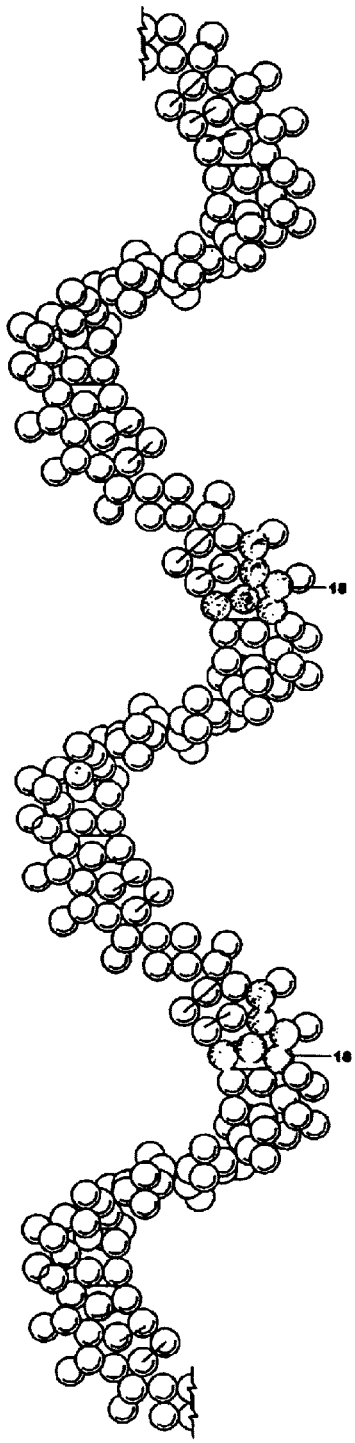
Figure 3H:
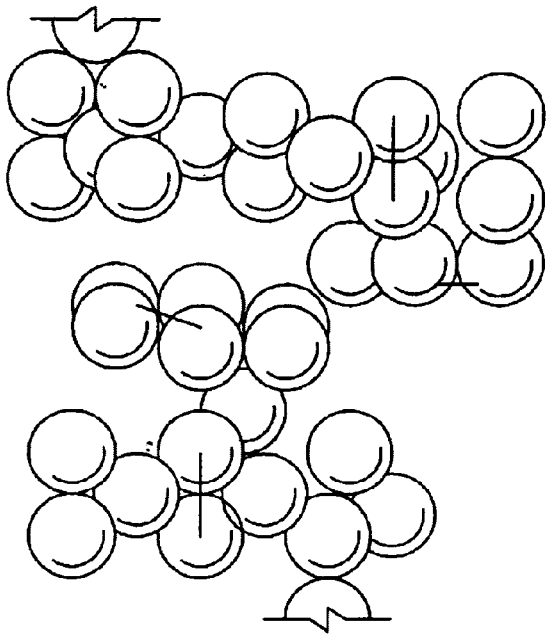
Figure 3I:
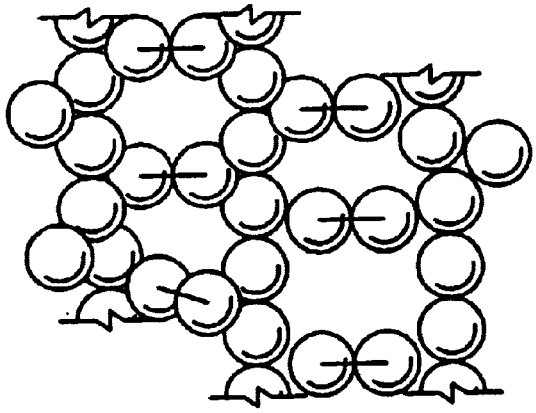

FIG. 3I shows a "Flat Helixez" configuration. The Flat Helixez configuration is produced by twisting a free rope space of each odd numbered forearm around a free rope space of an adjacent odd numbered forearm and twisting a free rope space of each even numbered forearm around a free rope space of an adjacent even numbered forearm, to thereby form a Flat Helixez configuration. In other words, there is a forearm positioned between each pair of attached forearm. To complete the structure, excess beads can be selectively trimming off of the Helixez bead structure.

FIG. 3H shows a Tight Helixez configuration. A Tight Helixez configuration is formed in a manner identical to the basic Helixez described above, except that the Prep-4s are not twisted around the primary strand A. Due to the tight spacing of beads along a conventional strand of carnival beads, simply laying the Prep-4 over the primary strand A and bringing rope space r2 of the Prep-4 into contact with a rope space of the primary strand causes the Prep-4 to become interlocked with the primary strand A. The linkage is weaker than in the basic Helixez structure described above, but it is sufficiently strong to hold the Prep-4 on the primary structure. A forearm 18 can then be formed in the manner described above.

As shown in FIG. 3G, a Helixez bead structure can be lengthened by interlocking the Helixez bead structure to a second Helixez bead structure. Interlocking is accomplished by twisting an unoccupied rope space of the Helixez bead structure around an unoccupied rope space of the second Helixez bead structure. For example, in FIG. 3G, a plurality of Helixez bead structures have been interlocked together in this manner to form a closed loop, which can be worn as a necklace.

Methods of Making Building Blockz Beads

Building Blockz is a Carnival bead design that is created by cutting up conventional carnival beads into pieces and twisting them together. It is a mathematical pattern that repeats constantly, giving the product its consistency. Many variations are possible within the Building Blockz design; however, the repetitious mathematics distinguishes the product. The following techniques are used to create separate Building Blockz units, which are often then combined together to form objects such as necklaces, clothing, or toys.

Building Blockz uses a variety of cut-up Prep pieces, such as 3s and 12s, that are double-twisted together to form objects. A Prep-3 is a strand of carnival beads that has three beads, a Prep-4 has four beads, a Prep-5 has five beads, and so forth. Prep pieces are prepared by cutting conventional carnival beads into Prep pieces of the desired length.

Figure 2A:
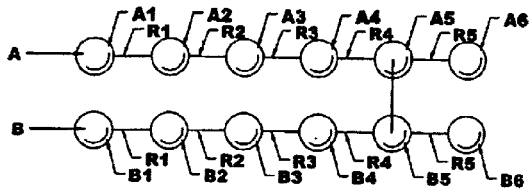
FIGS. 2A–2H provide preferred embodiments of steps of making Building Blockz beads, along with examples of variations of these types of twisted beads.
Figure 2B:
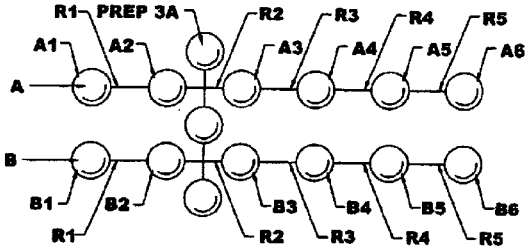
Figure 2C:
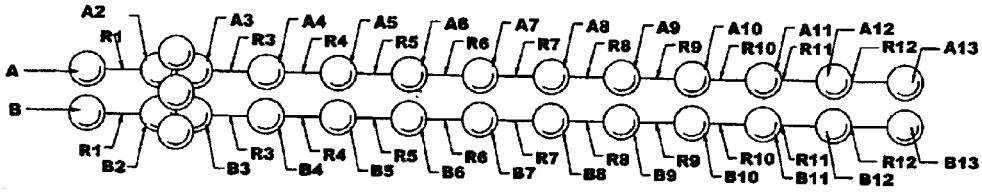
Figure 2D:
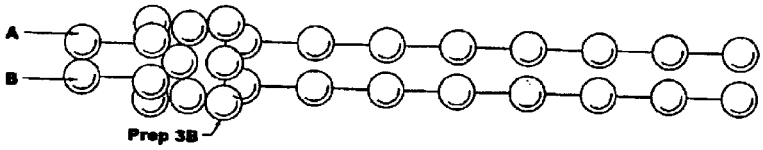

A piece or unit of Building Blockz beads is made using the following steps. As shown in FIG. 2A, a pair of primary strands of carnival beads A, B are set side-by-side in a substantially parallel arrangement. The primary strands are of a selected length of beads, e.g. Prep-12s. As shown in FIG. 2B, a Prep-3, designated Prep-3A, is laid over the second rope R2 of each of the primary strands A, B. As shown in FIG. 2C, each outer bead of Prep-3A is twisted over second rope R2 and then back above it to form a 360 degree lock between the second ropes R2 and Prep-3A. In this manner, Prep-3A locks primary strands A, B to one another. As shown in FIG. 2D, the locked assembly is then flipped over and the above steps are repeated on rope space R3. A Prep-3 designated Prep-3B, is laid over the third rope space R3 of each of the primary strands A, B. Each outer bead of Prep-3B is twisted over third rope space R3 and then back above it to form a pair of 360 degree twisted locks between the third rope spaces R3 and Prep-3A. In this manner, Prep-3B assists Prep-3A in locking primary strands A, B to one another.

Figure 2E:
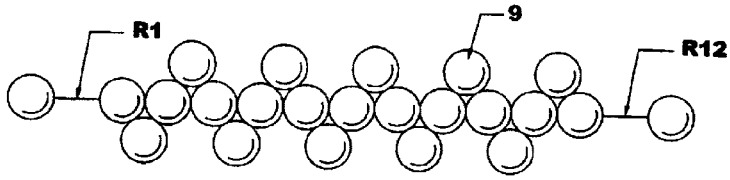
Figure 2F:
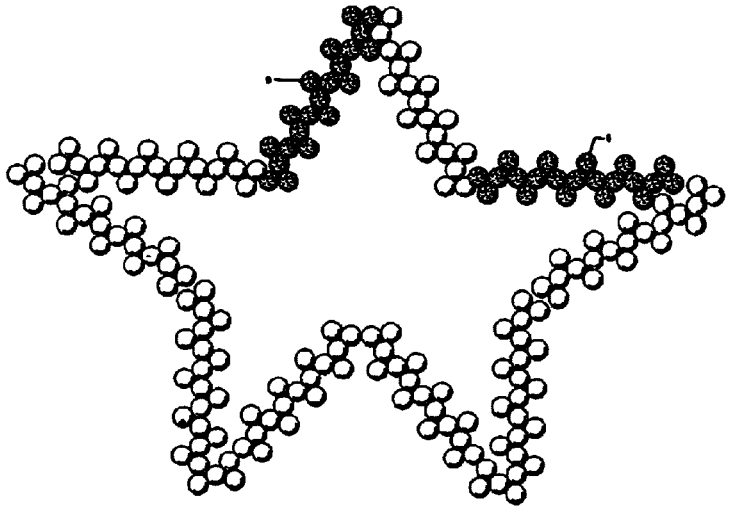

As shown in FIG. 2E, the foregoing steps are repeated until Prep pieces have been added along the length of primary strands A, B, preferably occupying all but the first and last rope spaces R1, R12. The first and last rope spaces R1, R12 are left open so that these rope spaces can be used to attach the completed unit of Building Blockz beads onto other units of Building Blockz As indicated in FIG. 2F, attachment is accomplished by twisting the unoccupied rope space of a first Building Blockz unit around an unoccupied rope space of a second Building Blockz unit. FIG. 2F provides an example of a necklace that was made by twisting the ends of a plurality of Building Blockz units together. Using these techniques, complex objects such as hats, bras, and panties (all of which are popular items during Mardi Gras) can be created. Excess beads can be trimmed off as desired in order to create the final Building Blockz product. Difference Prep pieces are used depending on the object to be created.

Figure 2G:
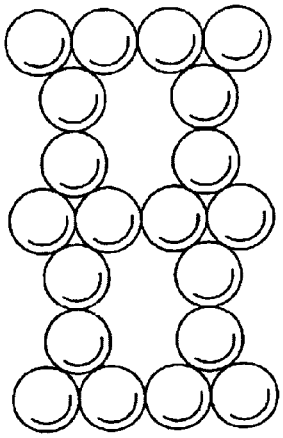
Figure 2H:
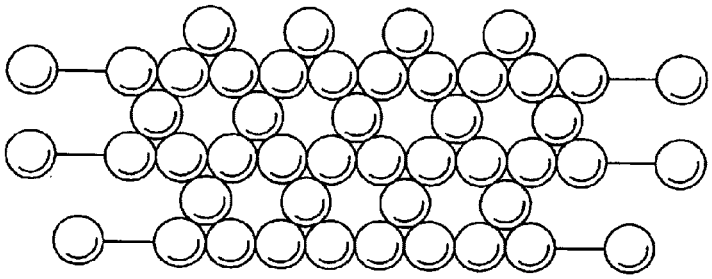

FIG. 2G shows a variation on the basic Building Blockz technique, namely a 3-Wide Building Blockz. FIG. 2H shows another variation on the basic Building Blockz technique, namely a Level II Building Blockz. Level II Building Blocks are created by lying three strands of carnival beads substantially parallel to one another.

Methods of Protecting Twisted Beads

Twisted beads of the type described above are relatively durable, but they suffer from a couple of drawbacks. The twists may cause the beads to become tangled with the hair of a wearer. Additionally, because the twisting causes the strings of the strands of beads to be placed under tension, the strings tend to weaken and break over time.

These two problems can be mitigated or avoided altogether by applying a protective coating to the twisted beads. The protective coating is preferably a clear coat, such as Krylon® acrylic, so as not to obscure the color of the beads. A colored coating can be used if desired. The coating is preferably sprayed onto the beads so to produce a thin coating. The coating can also be applied by brushing or by dipping the twisted beads into the coating solution.

Boxez Specifications

Boxez is a Carnival bead design that is created by cutting up conventional Carnival beads into pieces and then twisting them together or around other beads. It is a mathematical pattern that repeats constantly, giving the product its consistency. There are infinite variations within the Boxez design; however, the repetitious mathematics distinguishes the product.

Boxez utilize a variety of cut-up Prep pieces, including 3s and 5s. The basic rule used in determining the product is box-shaped Prep pieces consistently twisted together, usually around a center spine bead.

Description of Boxez Drawings

Figure 4A:
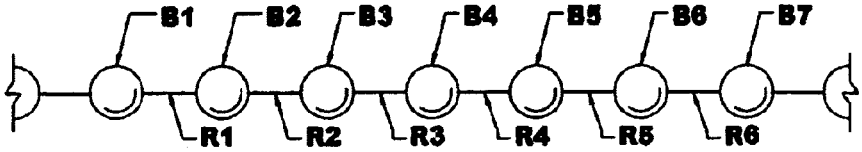
FIGS. 4A–4I provide preferred embodiments ofsteps of making Boex beads, along with examples of variations of trhese types of twisted beads.
Figure 4B:
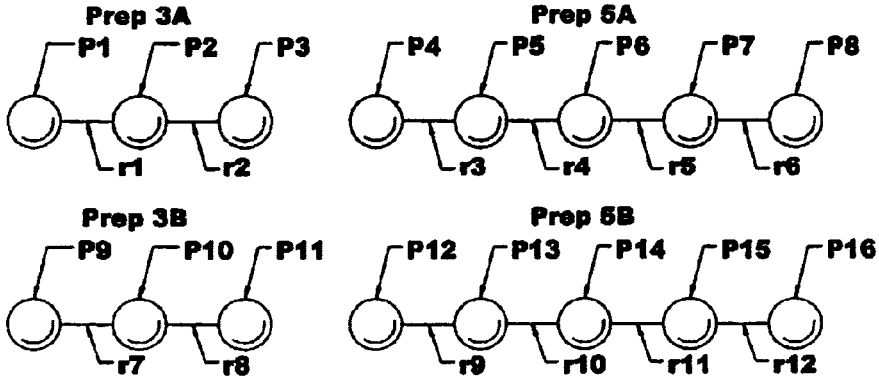
Figure 4C:
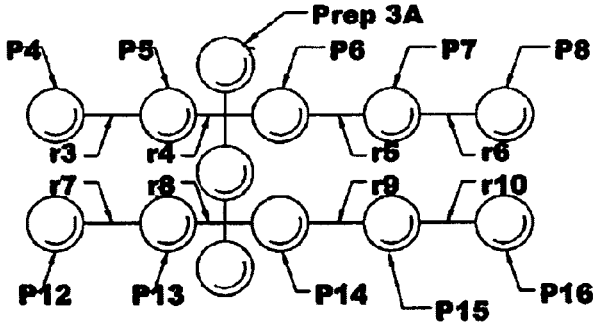
Figure 4D:
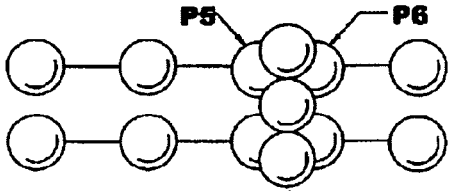
Figure 4E:
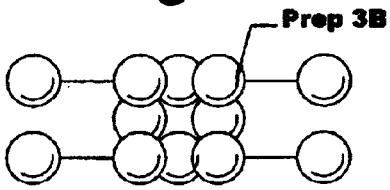
Figure 4G:
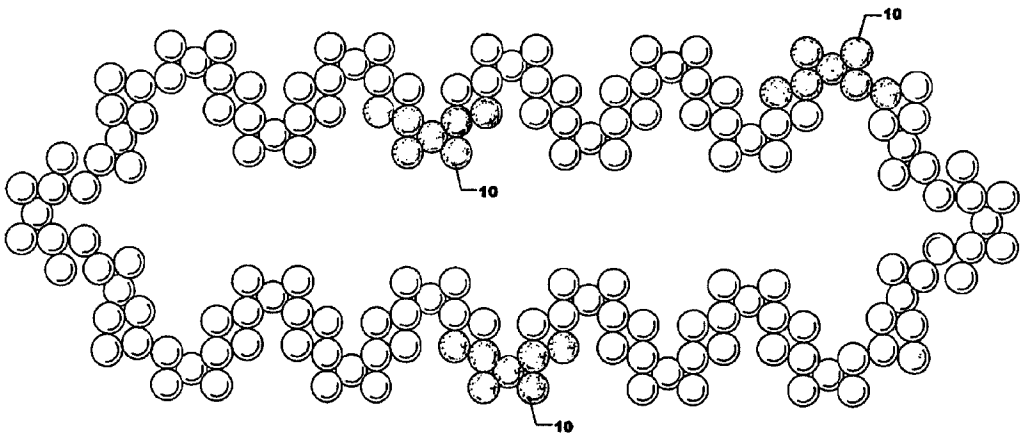
Figure 4F:
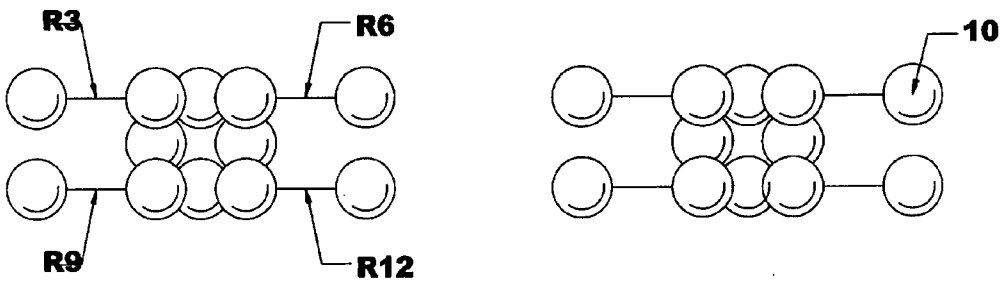

How to make a set of Boxez:

1. Choose the variables within the pattern; i.e. color scheme for required Prep pieces, size or level of design, etc.
2. Take a strand of conventional Carnival beads (FIG. 4A)
3. Cut it into two pieces of three beads each and two pieces of five beads each (FIG. 4B)
4. Make a base-box by:
   A. Position a Prep-3 over the $2^{nd}$ rope on each Prep-5 (FIG. 4C)
   B. Twist each bead under the center strand, and then back above it to form a 360-degree lock with the $2^{nd}$ ropes and the Prep-3 (FIG. 4D)
   C. Repeat Steps A and B on the next available ropes on the Prep-5s (FIG. 4E)
5. Repeat Steps 3 and 4 until required number of base-boxes is completed (FIG. 4F)
6. Double-twist ends of base-boxes together to connect them, or double-twist again to suspend base-boxes around a center bead. Trim any excess beads to create a Boxez product. (FIG. 4G)

Figure 4H:
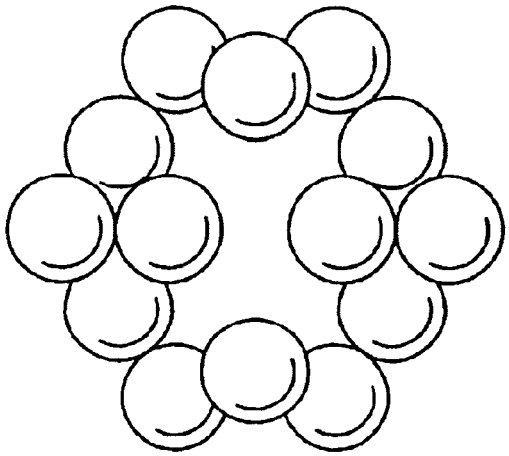
Figure 4I:
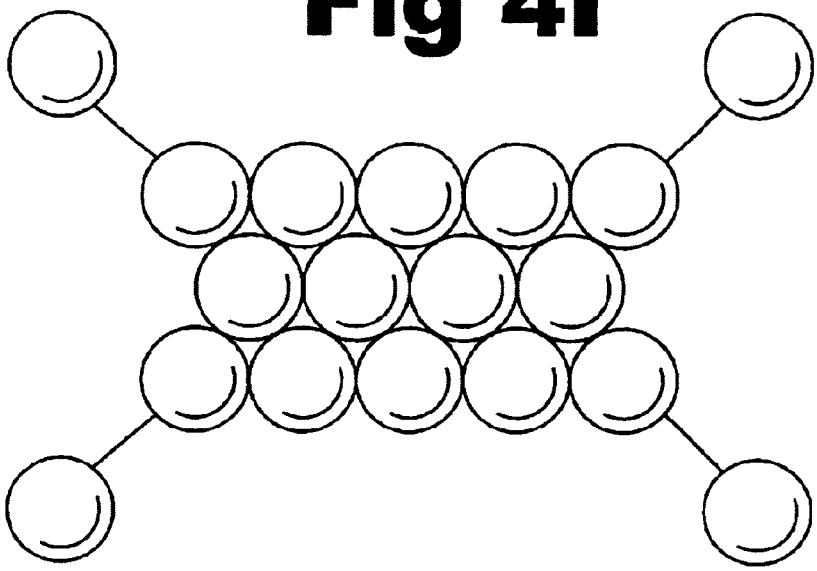

Some variations available:

Double Boxez (FIG. 4H)
Level II Boxez (FIG. 4I)

BRAIDZ SPECIFICATIONS

Braidz is a Carnival bead design that is created by twisting conventional Carnival beads together. It is a mathematical pattern that repeats constantly, giving the product its consistency. There are infinite variations within the Braidz design; however, the repetitious mathematics distinguishes the product.

Braidz utilize a variety of traditional braiding techniques, including a basic left over middle, right over middle three-braid, a four-braid, a five-braid, and three three-braids braided together, plus more. The basic rule used in determining the product is to check for consistently twisted Carnival beads braided together.

Description of Braidz Drawings

Figure 5A:
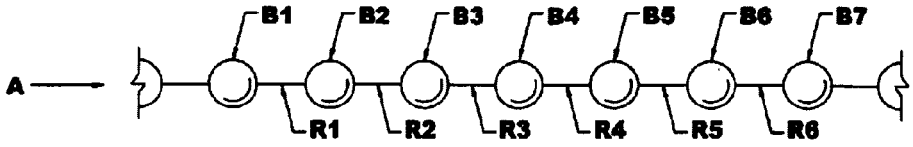
FIGS. 5A–5O provide preferred embodiments of steps of making Bradz beads, along with examples of variations of these types of twisted beads.
Figure 5B:
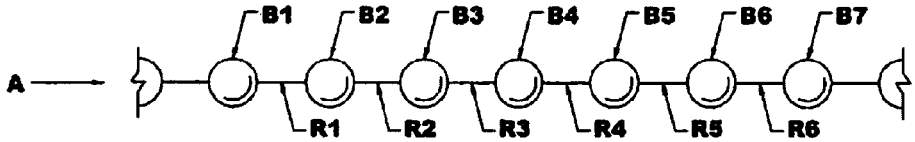
Figure 5C:
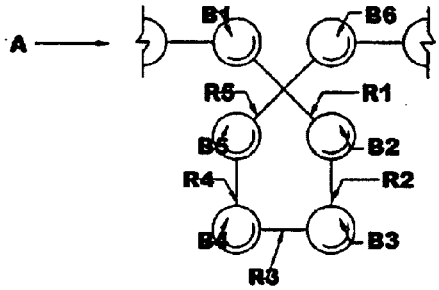
Figure 5D:
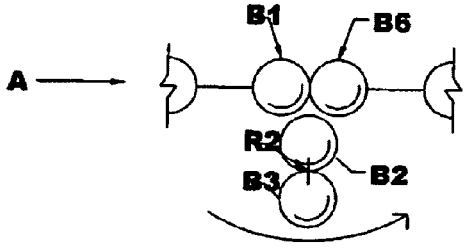
Figure 5E:
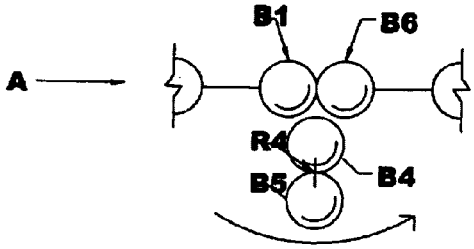
Figure 5F:
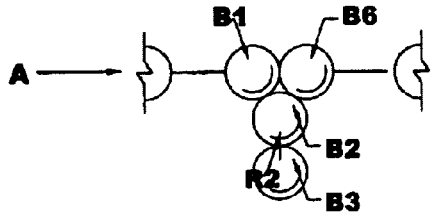
Figure 5G:
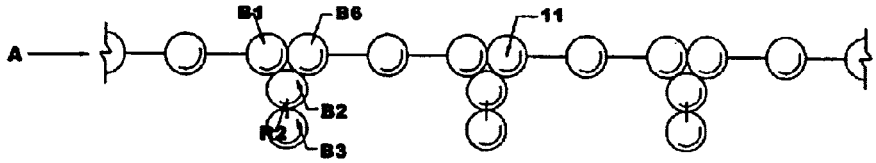
Figure 5H:
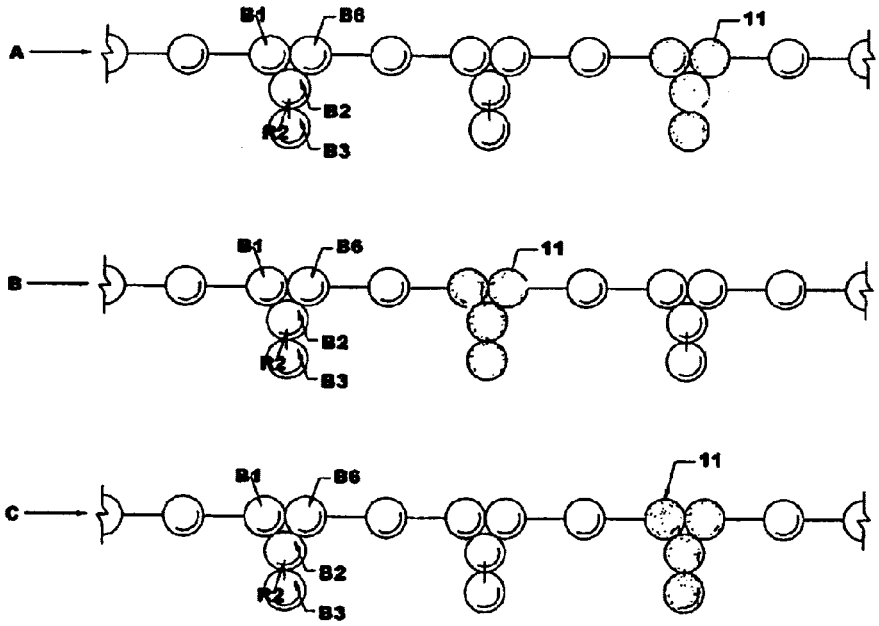
Figure 5I:
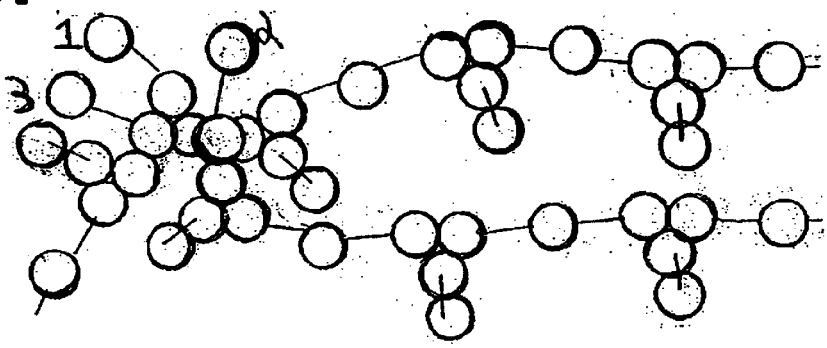
Figure 5J:
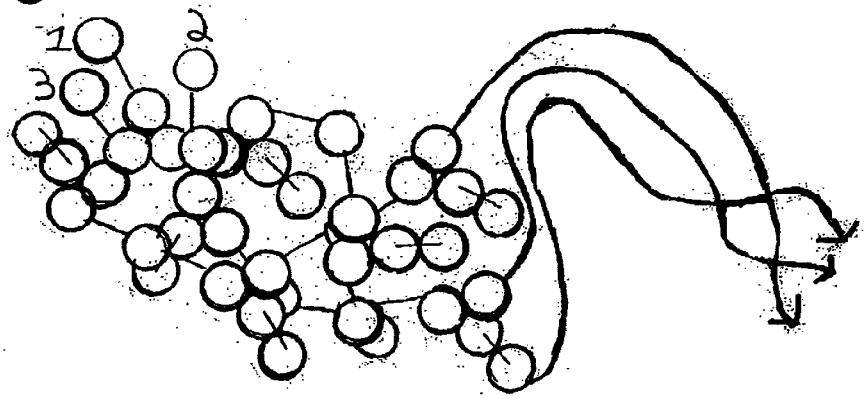
Figure 5K:
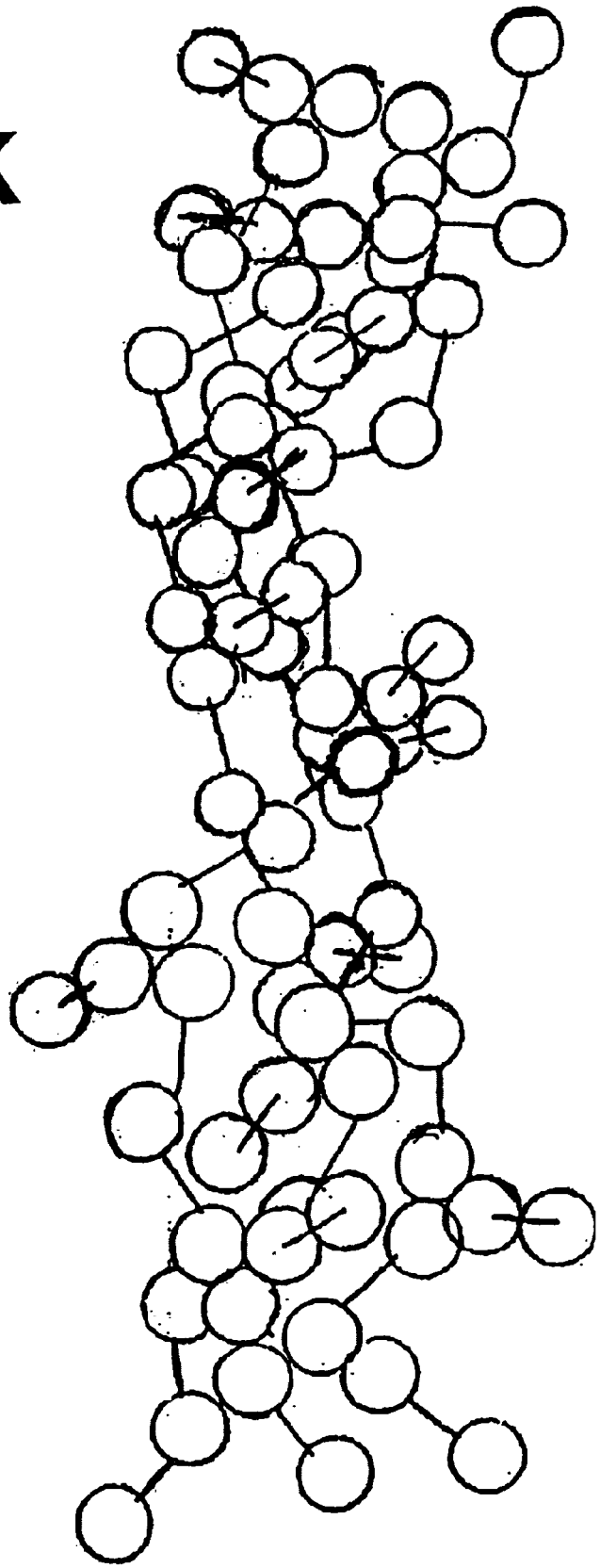

How to Make a Set of Braidz:

1. Choose the variables within the pattern, i.e. color scheme, six-twist, seven-twist, etc.
2. Take a strand of conventional Carnival beads
   A. Skip the first three beads on the strand to leave space for finishing step (FIG. 5A)
3. Create a six-twist by:
   A. Choose beads 1,2,3,4,5,6 (FIG. 5B)
   B. Take the first rope and cross it over the $5^{th}$ rope (FIG. 5C)
   C. Twist beads 2,3,4,5 to the right (FIG. 5D)
   D. Twist beads 2,3,4,5 to the right a second time, forming a 360 degree lock with the $1^{st}$ and $5^{th}$ ropes (FIG. 5E)
4. Skip two ropes after the completed six-twist (FIG. 5F)
5. Repeat Step 3 until strand is completed (FIG. 5G)
6. Complete twisting three strands (FIG. 5H)
7. Double-twist the first strand to the second and the third strand at the beginning (FIG. 5I)
8. Begin braiding the three strands together, using a left over middle, right over middle technique (FIG. 5J)
9. Finish braiding all three strands together, then double-twist the last three beads on each strand together (FIG. 5K)
10. Double-twist the ends of each strand together to create the seam; trim any excess beads to create a Braidz product. (FIG. 5L)

Some Variations Available:

Seven-Twist (FIG. 5M)
Eight-Twist (FIG. 5N)
Five-braid (FIG. 5O)

Building Blockz Specifications

Building Blockz is a Carnival bead design that is created by cutting up conventional Carnival beads into pieces and twisting them together. It is a mathematical pattern that repeats constantly, giving the product its consistency. There are infinite variations within the Building Blockz design; however, the repetitious mathematics distinguishes the product.

Building Blocks utilize a variety of cut-up Prep pieces, such as 3s and 12s double-twisted together to form objects. The basic rule used in determining the product is clothing/toys made out of prep beads twisted in sequence.

Description of Building Blockz Drawings

Figure 6A:
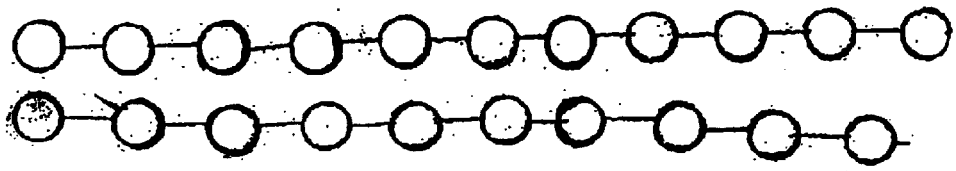
FIGS. 6A–6H provide preferred embodiments of steps of making Blockz beads, along with examples of variations of these types of twisted beads.
Figure 6B:
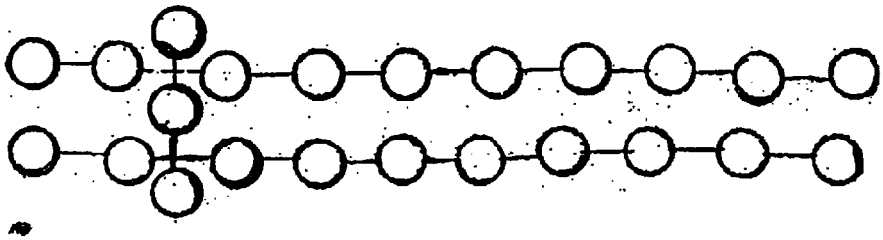
Figure 6C:
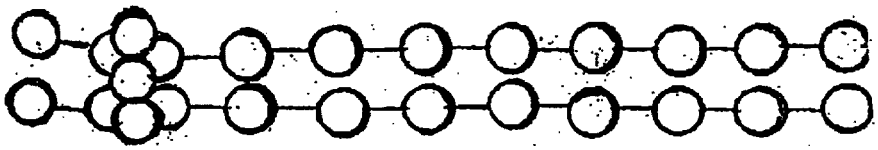
Figure 6D:
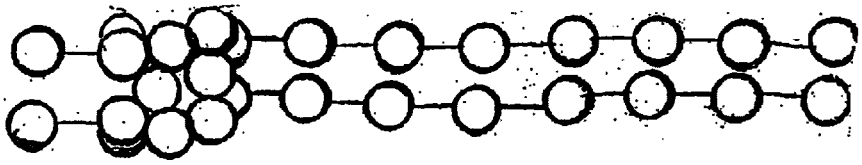
Figure 6E:
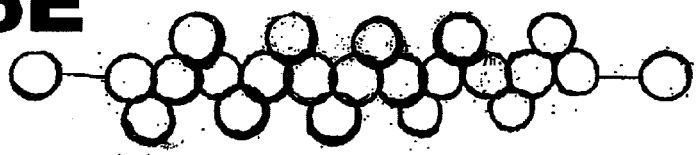
Figure 6F:
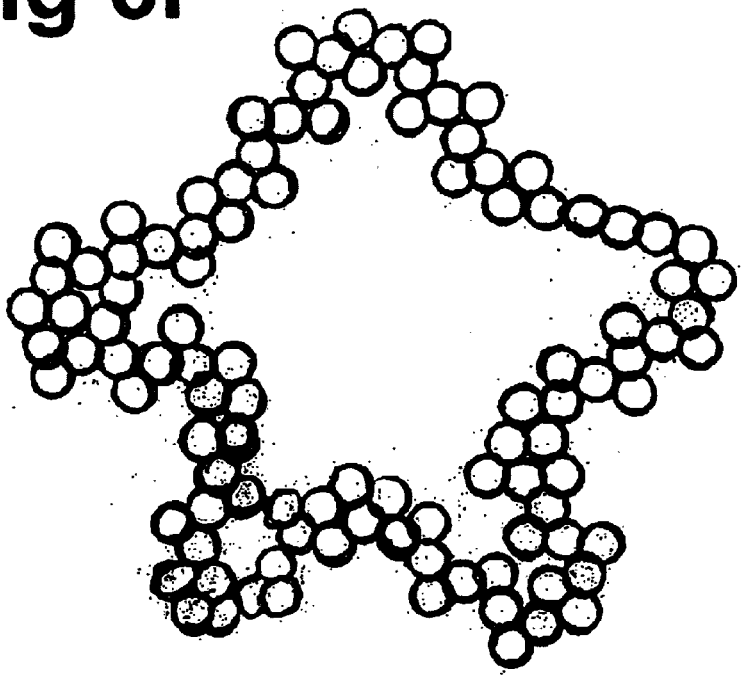

How to Make a Piece of Building Blockz:

1. Choose object of pattern, ex. Braz, Pantiez
2. Determine Prep pieces required for object i.e. 3s, 12s
3. Make a piece of Building Blockz by:
   A. Take two strands of conventional Carnival beads (FIG. 6A)
   B. Position a Prep-3 over the $2^{nd}$ rope on each strand (FIG. 6B)
   C. Twist each bead under the center strand, then back above it to form a 360-degree lock with the $2^{nd}$ ropes and the Prep piece (FIG. 6C)
4. Flip strands over, then repeat Step 2 (FIG. 6D)
5. Repeat until piece of Building Blockz is completed (FIG. 6E)
6. Attach pieces together by double-twisting ends together to form objects (FIG. 6F)

Figure 6G:
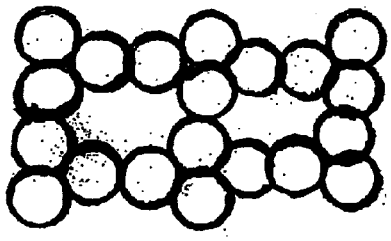
Figure 6H:
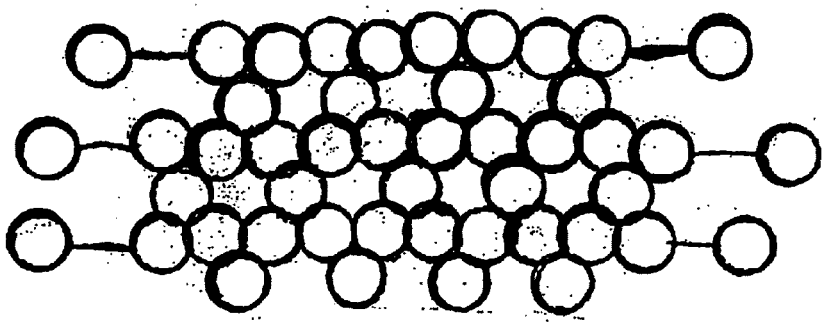

Some Variations Available:

3-Wide Building Blockz (FIG. 6G)
Level II Building Blockz (FIG. 6H)

Curlz Specifications

Curlz is a Carnival bead design that is created by twisting conventional Carnival beads together. It is a mathematical pattern that repeats constantly, giving the product its consistency. There are infinite variations within the Curlz design; however, the repetitious mathematics distinguishes the product.

Curlz utilize a variety of double-twists, including the seven-twist and the eight-twist. The basic rule used in determining the product is consistently-twisted Carnival beads double-twisted on every available rope, not including the ropes contained in the seven or eight twists.

Description of Curlz Drawings

Figure 7A:
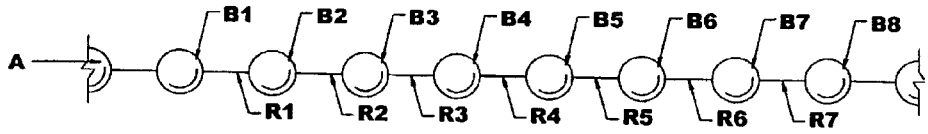
FIGS. 7A–7J provide preferred embodiments of steps of making Curlz beads, along with examples of variations of these types of twisted beads.
Figure 7B:
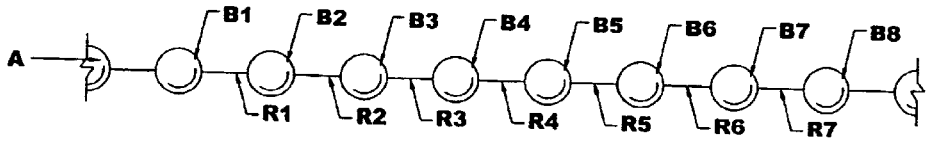
Figure 7C:
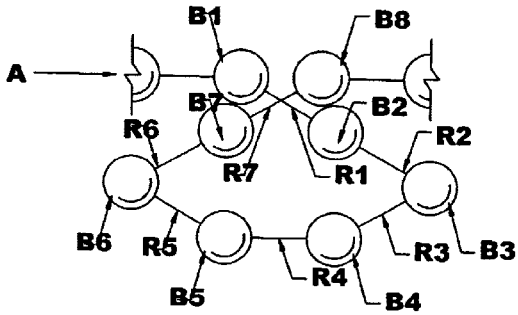
Figure 7D:
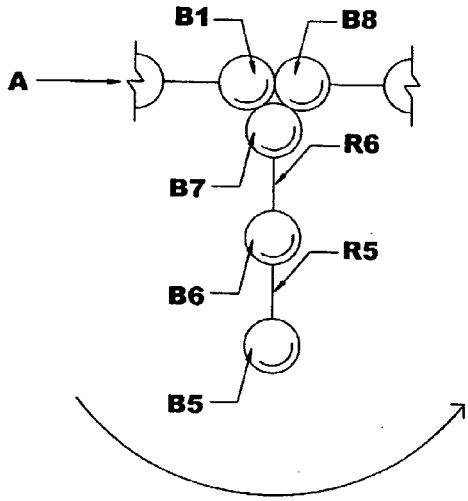
Figure 7E:
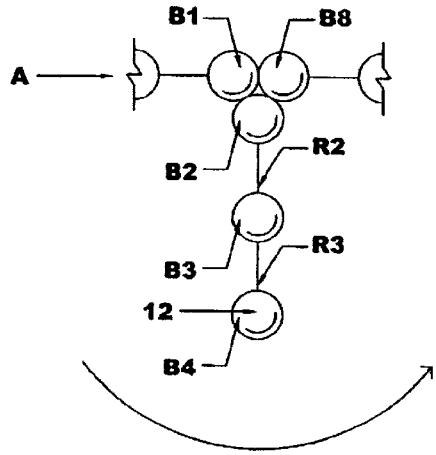
Figure 7F:
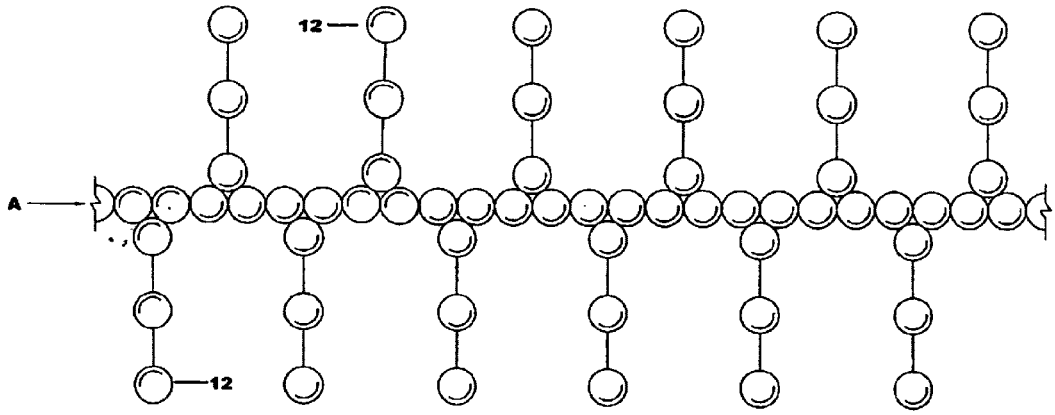
Figure 7G:
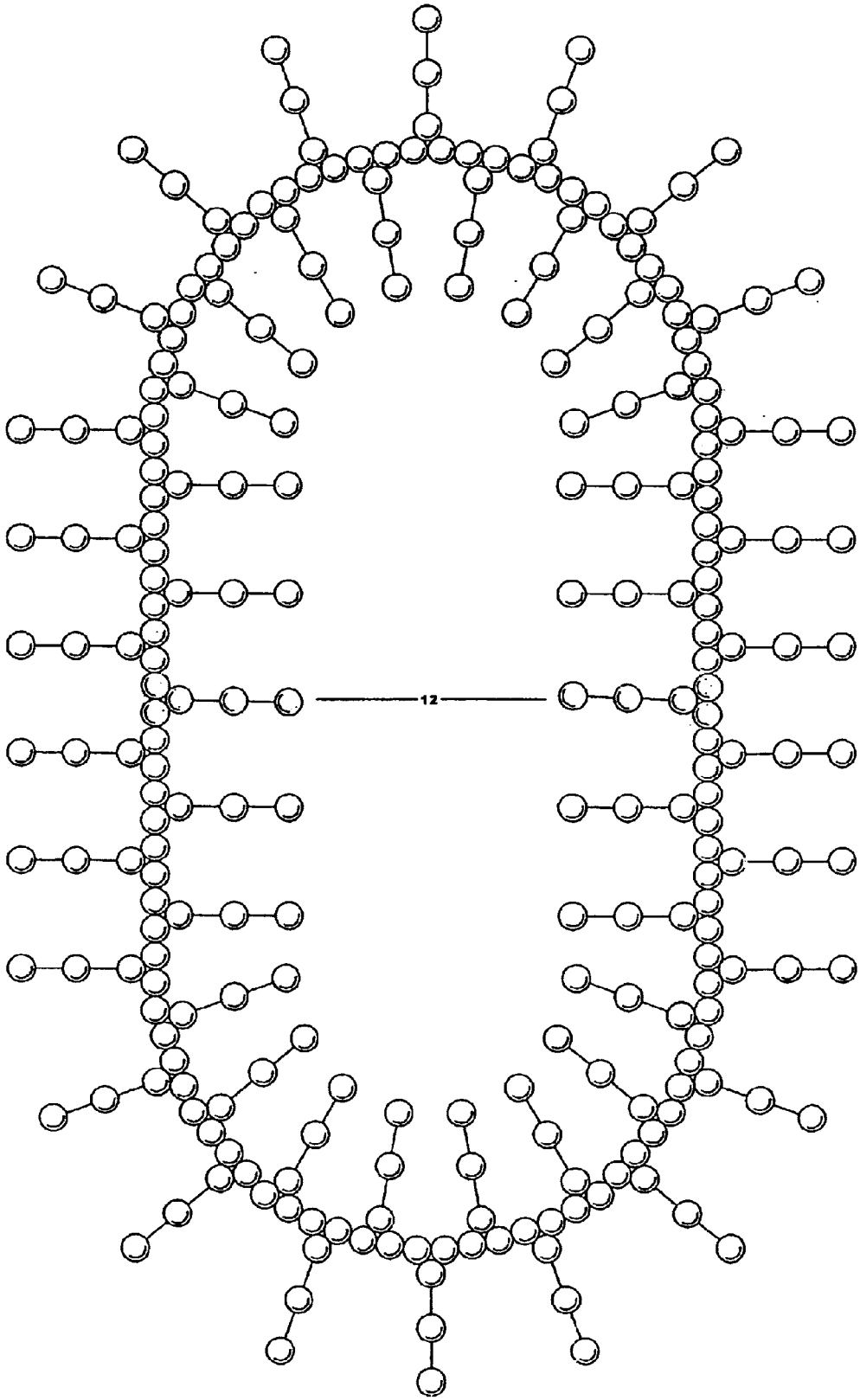

How to Make a Set of Curlz:

1. Choose the variables within the pattern, i.e. color scheme, seven-twist, eight-twist, etc.
2. Take a strand of conventional Carnival beads
   A. Skip the first four beads on the strand to leave space for the finishing step (FIG. 7A)
3. Create an eight-twist by:
   A. Choose beads 1,2,3,4,5,6,7,8 (FIG. 7B)
   B. Take the $1^{st}$ rope and cross it over the $7^{th}$ rope (FIG. 7C)
   C. Twist beads 2,3,4,5,6,7 to the right (FIG. 7D)
   D. Twist beads 2,3,4,5,6,7 to the right a second time, forming a 360 degree lock with the $1^{st}$ and $7^{th}$ ropes (FIG. 7E)
4. Repeat Step 3 on next available rope until strand is completed (FIG. 7F)
5. Double-twist ends of Curlz together to diversify color scheme and to lengthen the pattern; double-twist the last end beads together to create the seam. Trim any excess beads to create a Curlz product. (FIG. 7G)

Figure 7I:
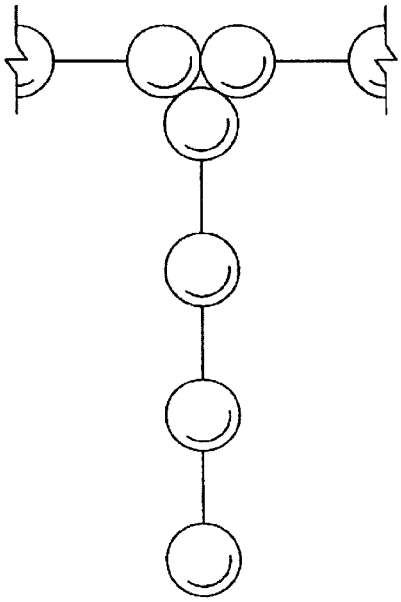
Figure 7H:
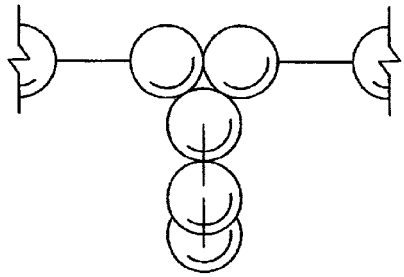

Some Variations Available:

Seven-twist (FIG. 7I)

Ten-twist (FIG. 7I)

Figure 7J:
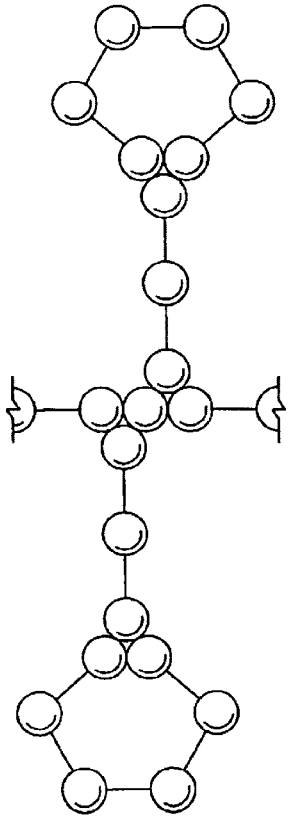

Level II Curlz (FIG. 7J)

Diamondz Specifications

Diamondz is a Carnival bead design that is created by cutting up conventional Carnival beads into pieces and then twisting them together. It is a mathematical pattern that repeats constantly, giving the product its consistency. There are infinite variations within the Diamondz product; however, the repetitious mathematics distinguishes the product.

Diamondz utilize several cut-up Prep pieces double-twisted together several times to form a triangular shape. The basic rule used in determining the product is six beads arranged in a three-sided/two-layered shape with additional beads jutting out from each side, repeating constantly.

Description of Diamondz Drawings Page (1 of 2)

Figure 8A:
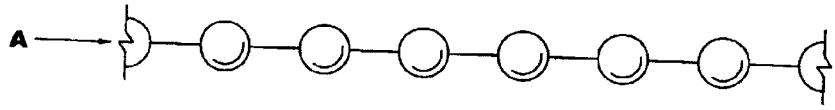
Figure 8B:
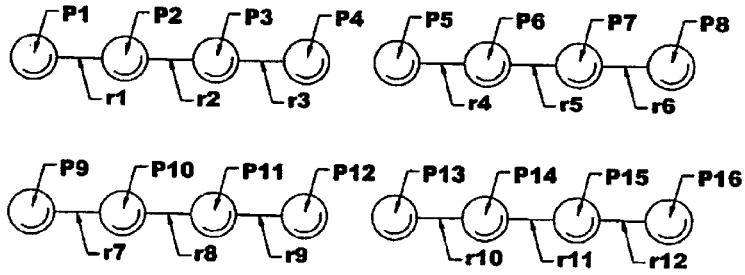
Figure 8C:
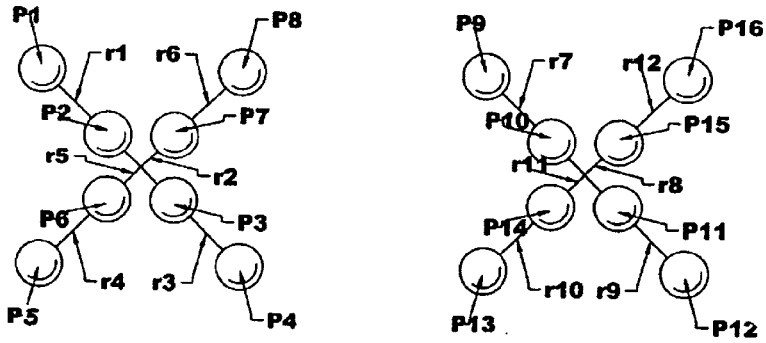
Figure 8D:
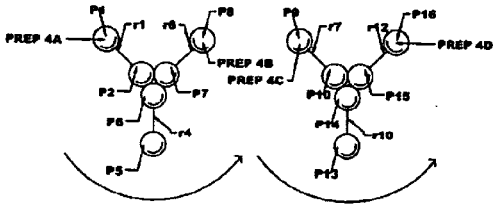
Figure 8E:
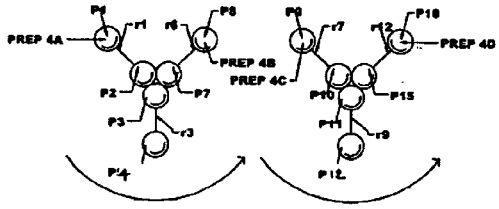
Figure 8F:
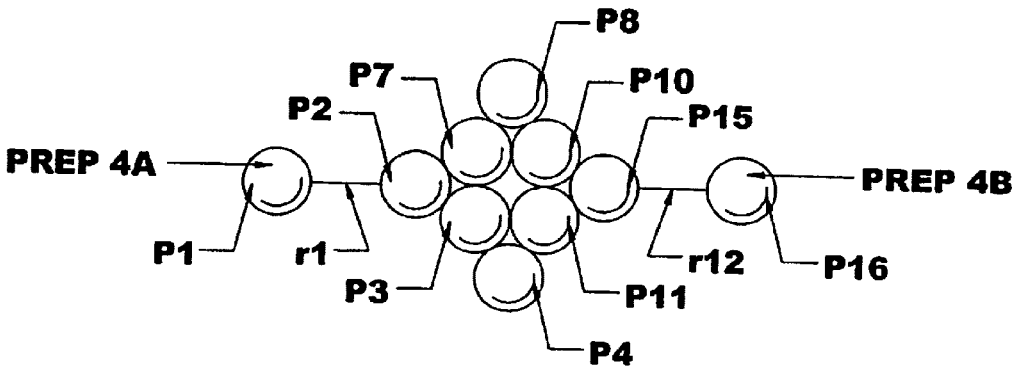
Figure 8G:
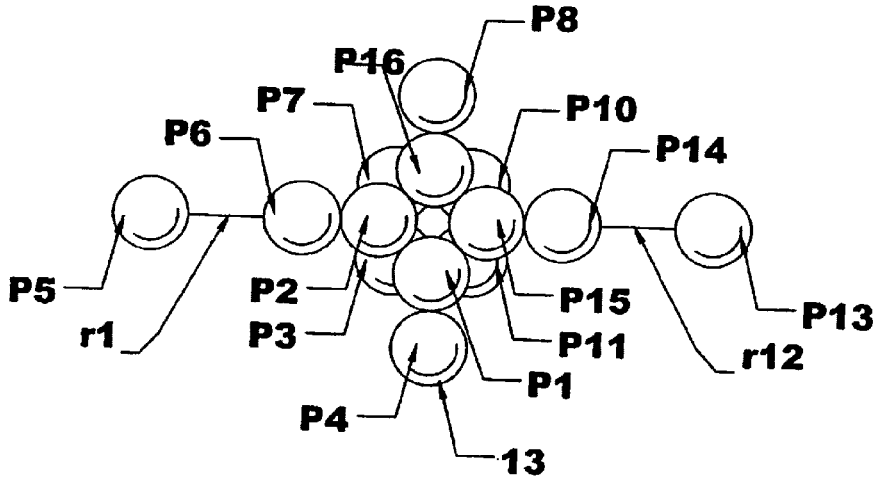

How to Make a Set of Diamondz:

1. Choose the variables within the pattern, i.e. color scheme for Prep pieces needed, ex. Purple green and gold 4s, red and white 8s, etc.
2. Take a strand of conventional Carnival beads (FIG. 8A)
3. Create a single Diamond by:
   A. Cut it into four pieces of four beads each (FIG. 8B)
   B. Take the $2^{nd}$ rope on the first piece and cross it over the $2^{nd}$ rope on the second piece (do this step twice to accommodate all four Prep pieces) (FIG. 8C)
   C. Twist beads 3,4,5,6 to the right (do this step twice to accommodate all four Prep pieces) (FIG. 8D)
   D. Twist beads 3,4,5,6 to the right a second time, forming a 360 degree lock between the $2^{nd}$ ropes (do this step twice to accommodate all four prep pieces) (FIG. 8E)
   E. Double-twist beads 8,9 as well as 4,12 together (FIG. 8F)
   F. Double-twist beads 1,16 together to create a single Diamond (FIG. 8G)
4. Double-twist the ends of Diamondz together to diversify color scheme and to lengthen the pattern; double-twist the last end beads together to create the seam. Trim any excess beads to create a Diamondz product. (FIG. 8H)

Some Variations Available:

Diamondz with Prep pieces inserted between each other (FIG. 8I)

Level II Diamondz: (FIG. 8J)

Fabricz Specifications

Fabricz is a Carnival bead design that is created by twisting conventional Carnival beads together. It is a mathematical pattern that repeats constantly, giving the product its consistency. There are infinite variations within the Fabricz design; however, the repetitious mathematics distinguishes the product.

Fabricz utilize a variety of double-twists, including the four-twist and the six-twist. The basic rule used in determining the product is consistently twisted Carnival beads twisted over and within one another.

Figure 9A:
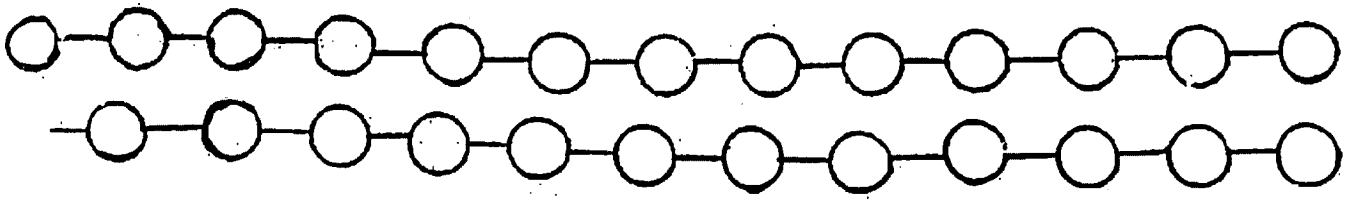
FIGS. 9A–9J provide preferred embodiments of steps of making Fabriez beads, along with examples of variations of these types of twisted beads.
Figure 9B:
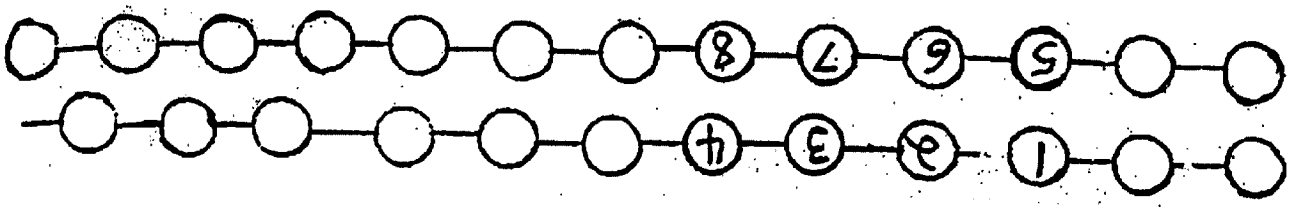
Figure 9C:
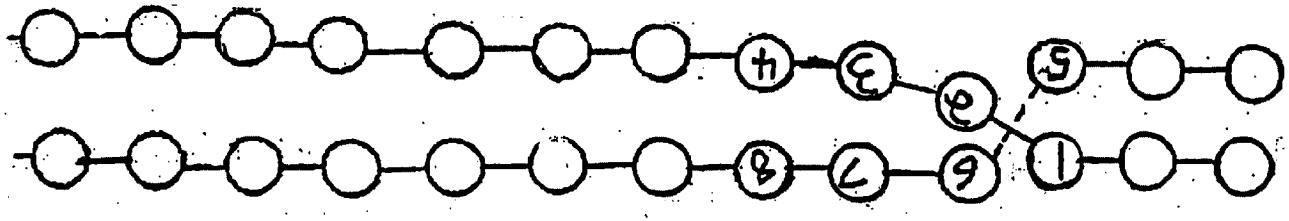
Figure 9D:
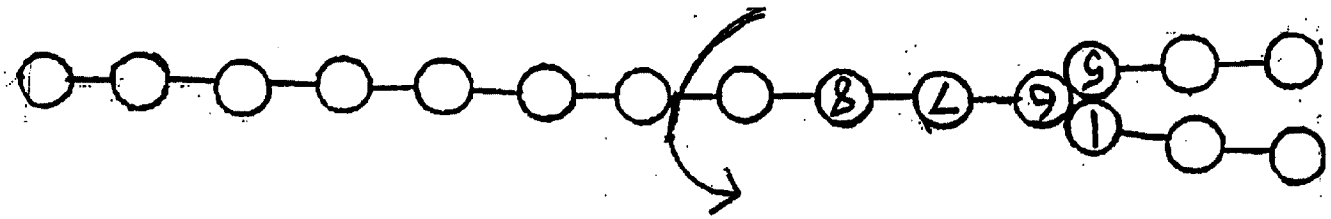
Figure 9E:
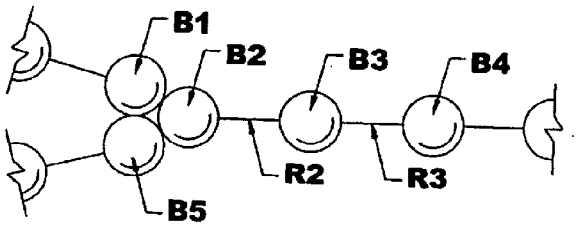
Figure 9F:
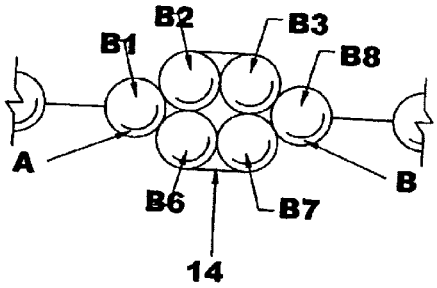
Figure 9G:
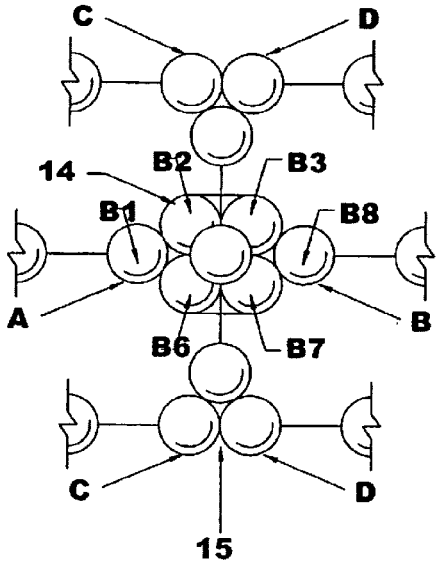
Figure 9I:
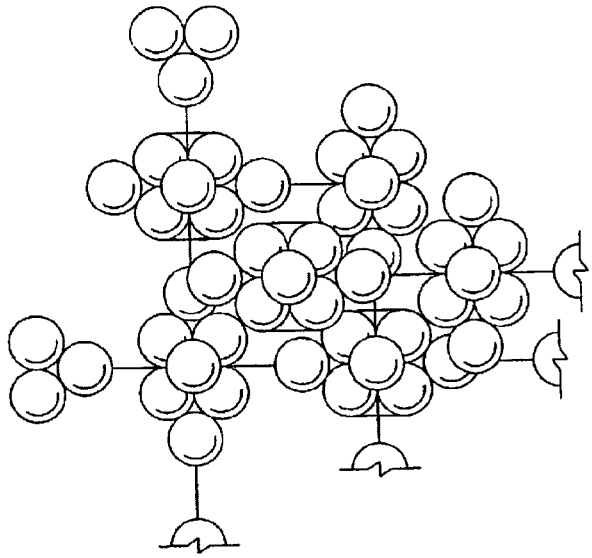
Figure 9H:
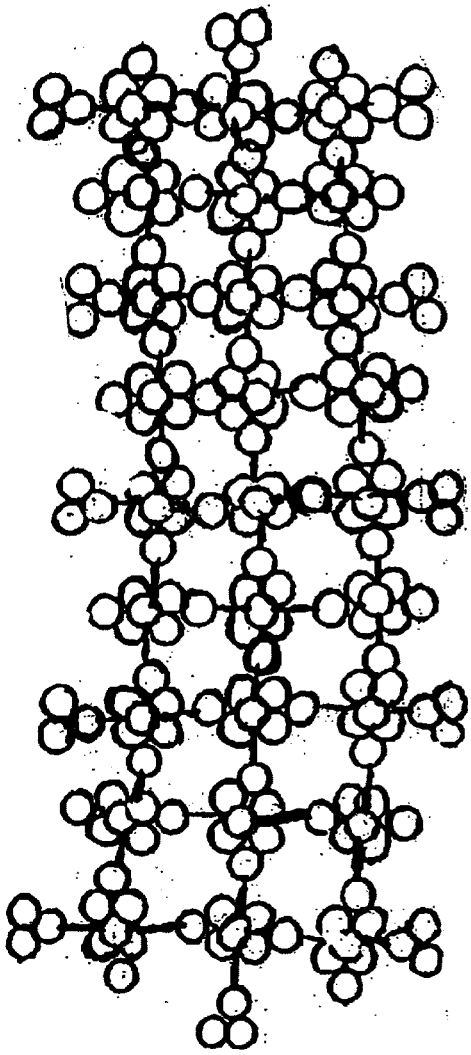

How to make a section of Fabricz:

1. Choose the variables within the pattern, i.e. color scheme and type of design, ex. Triangular or square Fabricz, etc.
2. Take two strands of conventional Carnival beads
   A. Skip the first two beads on each strand to leave space for the finishing step (FIG. 9A)
3. Create a piece of Fabricz by:
   A. Choose beads 1,2,3,4,5,6,7,8 (FIG. 9B)
   B. Cross the $1^{st}$ rope over the $4^{th}$ rope (FIG. 9C)
   C. Twist beads 2,3,4,5,6,7,8 to the right (FIG. 9D)
   D. Twist beads 2,3,4,5,6,7,8 to the right a second time, forming a 360-degree lock between the $1^{st}$ and $4^{th}$ ropes (FIG. 9E)
   E. Double-twist beads 3,4 and 7,8 to the right to complete the Fabricz piece (FIG. 9F)
4. Double-twist two more strands together (with two beads skipped at the beginning of each strand); double-twist both strands around beads 2,3,6,7 (FIG. 9G)
5. Continue to add double-twisted strands over and within each other to lengthen pattern; double-twist ends of strands to other ends to create seams. Trim any excess beads to create a Fabricz product. (FIG. 9H)

Some Variations Available:

Interlaced Fabricz: (FIG. 9I)

Figure 9J:
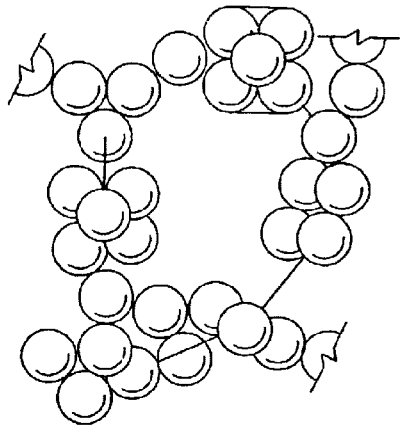

Triangular Fabricz: (FIG. 9J)

Flowerz Specifications

Flowerz is a Carnival bead design that is created by twisting conventional Carnival beads together. It is a mathematical pattern that repeats constantly, giving the product its consistency. There are infinite variations within the Flowerz design; however, the repetitious mathematics distinguishes the product.

Flowerz utilize a variety of double-twists, including the seven-twist and the eight-twist, with the strand being pulled through the twisted loop and single-twisted into place. The basic rule used in determining the product is one center bead being surrounded by six beads in a hexagonal formation.

Description of Flowerz Drawings

Figure 10A:
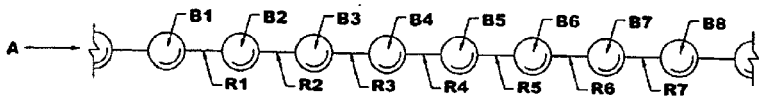
FIGS. 10A–10J provide preferred embodiments of steps of making Flowerz beads, along with examples of variations of these types of twisted beads.
Figure 10B:
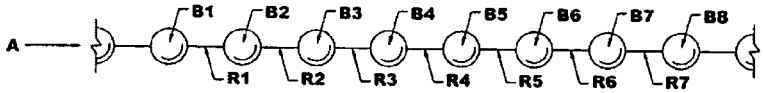
Figure 10C:
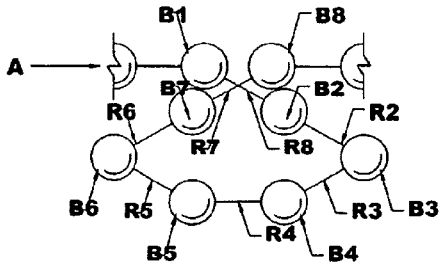
Figure 10D:
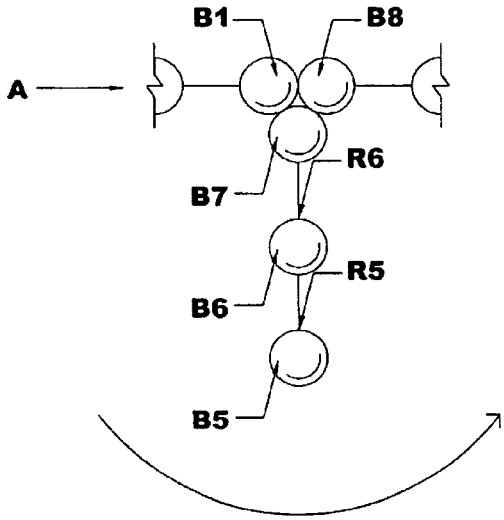
Figure 10E:
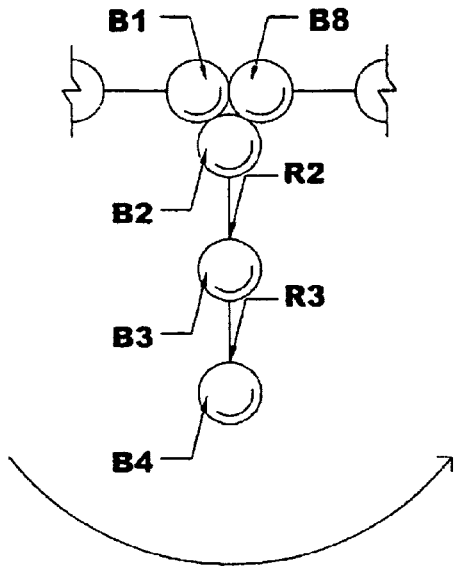
Figure 10F:
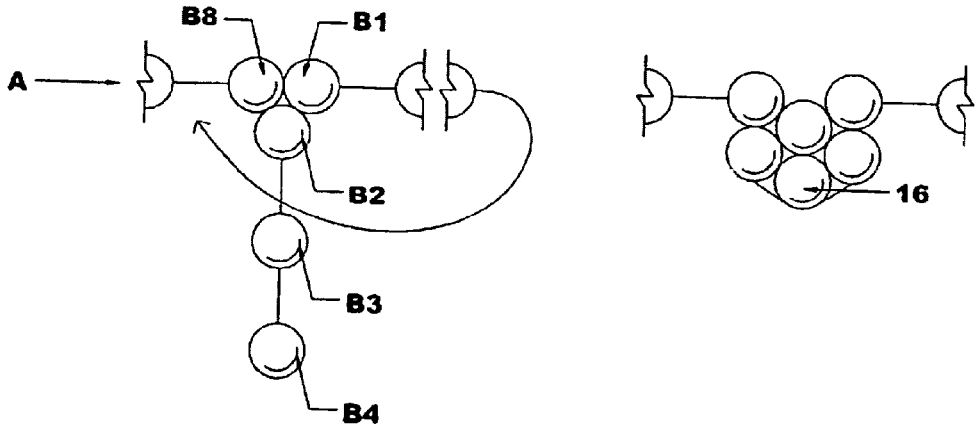
Figure 10G:
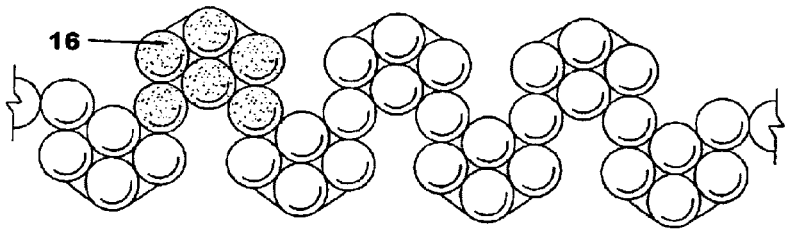
Figure 10H:
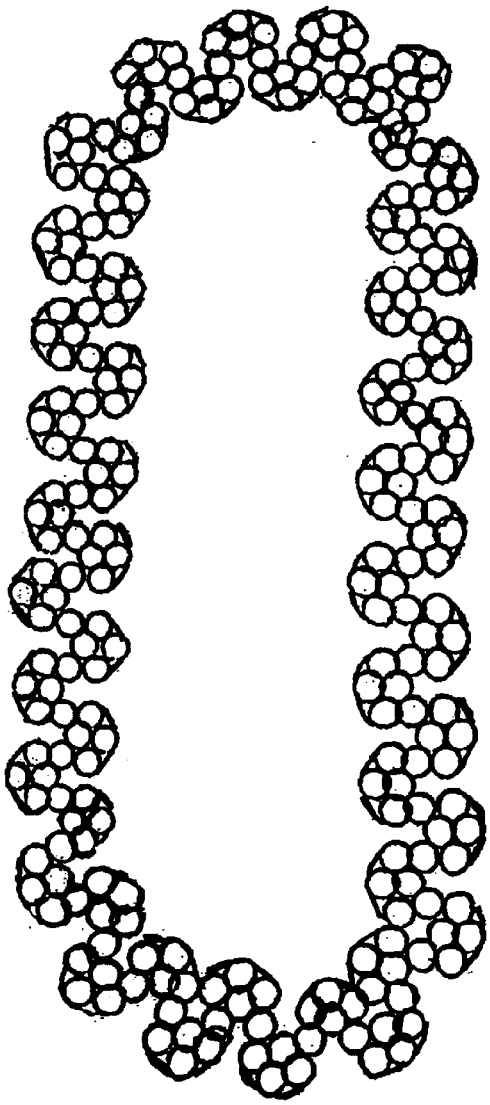

How to Make a Set of Flowerz:

1. Choose the variables within the pattern, i.e. color scheme, level of design, etc.
2. Take a strand of conventional Carnival beads
   A. Skip one bead on the strand to leave space for the finishing step (FIG. 10A)
3. Create an eight-twist by:
   A. Choose beads 1,2,3,4,5,6,7,8 (FIG. 10B)
   B. Take the $1^{st}$ rope and cross it over the $7^{th}$rope (FIG. 10C)
   C. Twist beads 2,3,4,5,6,7 to the right (FIG. 10D)
   D. Twist beads 2,3,4,5,6,7 to the right a second time, forming a 360 degree lock with the $1^{st}$ and $7^{th}$ ropes (FIG. 10E)
4. Take the end of the strand and pull it back through the eight-twist; single-twist the $1^{st}$ rope to the $3^{rd}$ rope (center rope) in the eight-twist (FIG. 10F)
5. Repeat Steps 3 and 4 on the next available rope until strand is completed (FIG. 10G)
6. Double-twist the ends of Flowerz together to diversify the color scheme and to lengthen the pattern; double-twist the last end beads together to create the seam. Trim any excess beads to create a Flowerz product. (FIG. 10H)

Figure 10I:
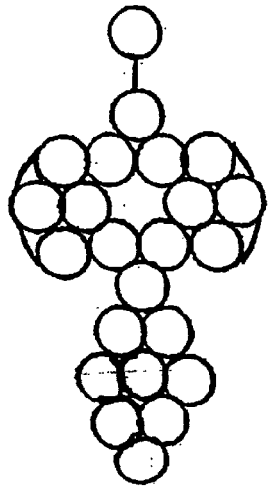

Some Variations available:

Double Flowerz: (FIG. 10I)

Figure 10J:
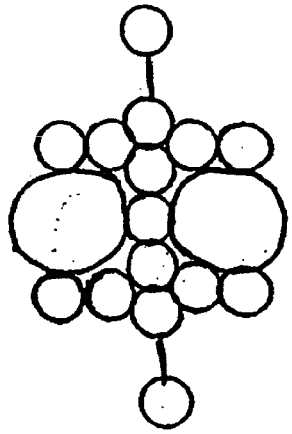

Level II Single Flowerz: (FIG. 10J)

Helixez Specifications

Helixez is a Carnival bead design that is created by twisting conventional Carnival beads together in a circular formation that spirals around. It is a mathematical pattern that repeats constantly, giving the product its consistency. There are infinite variations within the Helixez pattern; however, the repetitious mathematics distinguishes the product.

Helixez utilize a variety of double-twists, including the six-twist and the 8-twist, and prep pieces such as 4s. The basic rule used in determining the product is cut-cup Prep pieces twisted to a spine bead, with both beads spiraling around in a circular formation.

How to Make a Set of Helixez:

1. Choose the variables within the pattern, i.e. single Helix, narrow Helix, etc.
2. Take a strand of conventional Carnival beads
   A. Skip the first three beads on the strand to leave space for the finishing step (FIG. 11A)
3. Create a four-arm by:
   A. Choose beads 1,2 (FIG. 11 B)
   B. Cross the $2^{nd}$ rope on a Prep-4 piece over the $5^{th}$ rope on the strand (FIG. 11C)
   C. Twist beads 3,4,5,6 to the right (FIG. 11D)
   D. Twist beads 3,4,5,6 to the right a second time, forming a 360-degree lock with the $2^{nd}$ and $5^{th}$ ropes (FIG. 11E)
   E. Double-twist the $3^{rd}$ and $7^{th}$ ropes on the spine strand together (FIG. 11F)
4. Repeat Step 2 until strand is completed (FIG. 11G)
5. Double-twist prep pieces together to create circumference bead; double-twist end beads together to create seam. Trim any excess beads to create a Helixez product. (FIG. 11 H)

Figure 11A:
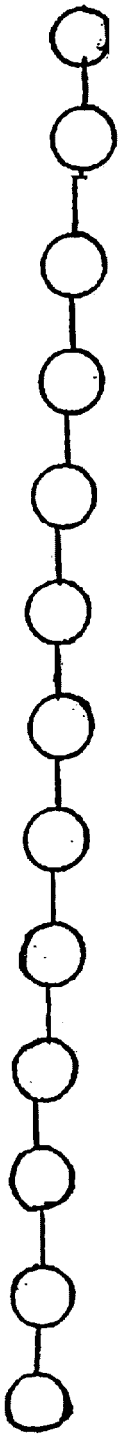
FIGS. 11A–11J provide preferred embodiments of steps of making Helixez beads, along with examples of variations of these types of twisted beads.
Figure 11B:
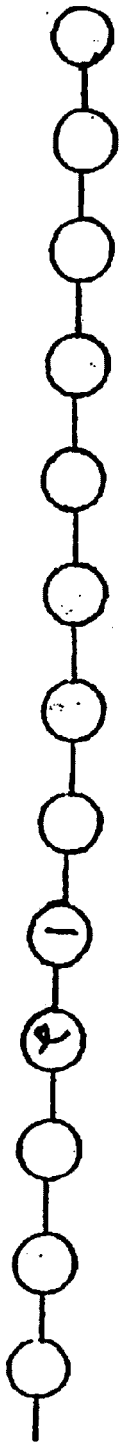
Figure 11C:
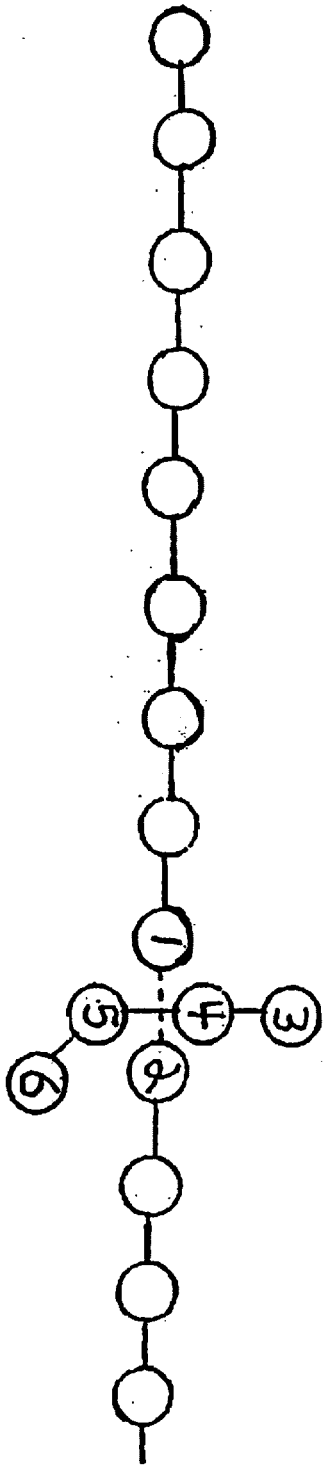
Figure 11D:
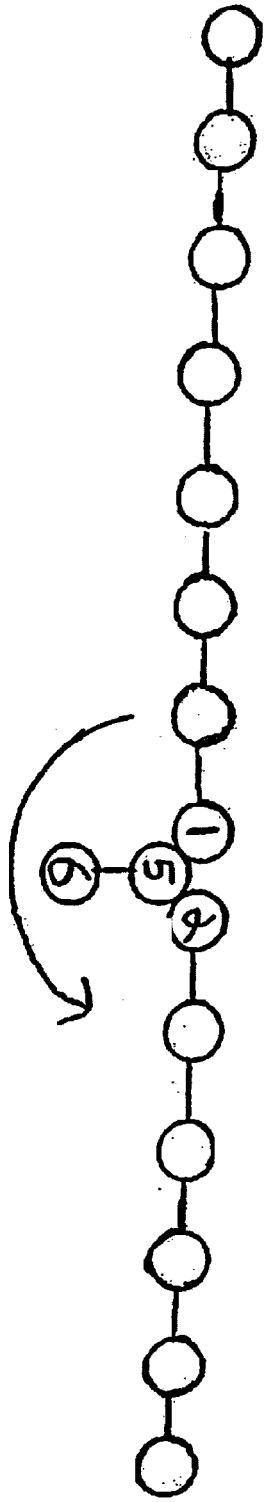
Figure 11E:
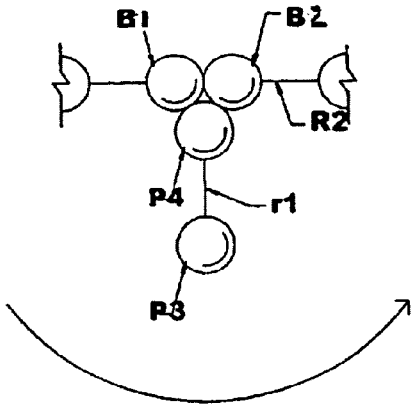
Figure 11F:
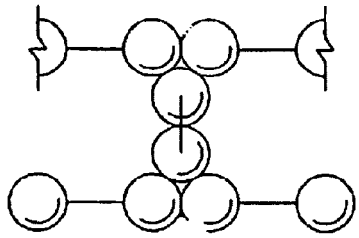
Figure 11G:
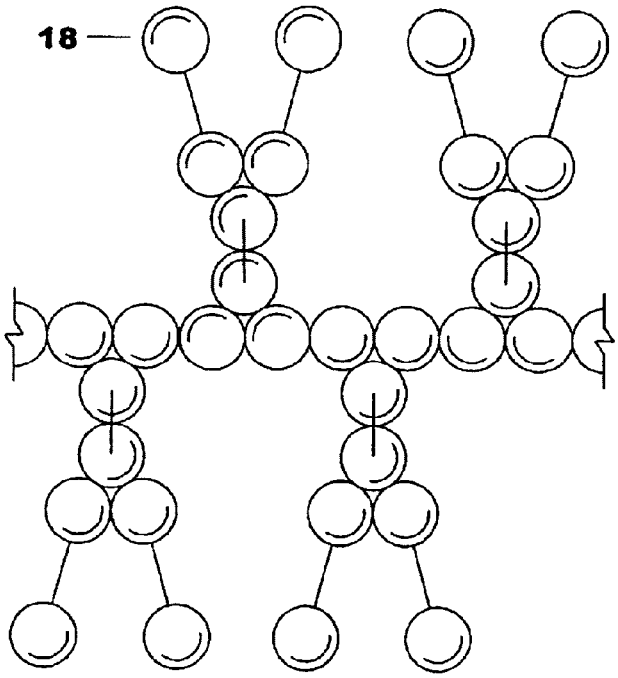
Figure 11H:
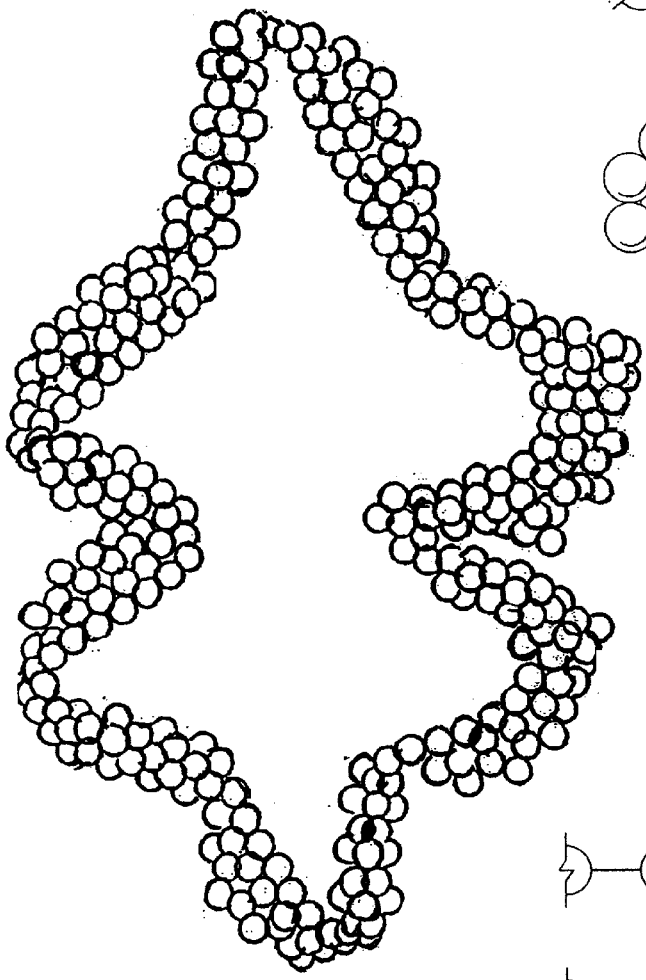
Figure 11I:
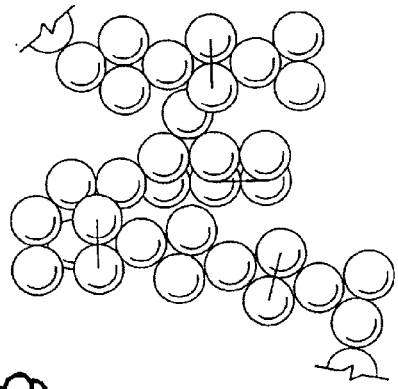

Some Variations Available:

Tight Helix: (FIG. 11I)

Figure 11J:
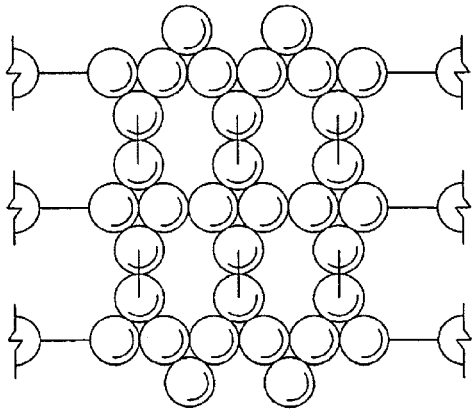

Level III Helix: (FIG. 11J)

Linkz Specifications

Linkz is a Carnival bead design that is created by twisting conventional Carnival beads together, and then having cut-up pieces attached. It is a mathematical pattern that repeats constantly, giving the pattern its consistency. There are infinite variations within the Linkz design; however, the repetitious mathematics distinguishes the product.

Linkz utilize a variety of double-twists, including the six-twist and the eight-twist, plus prep pieces twisted onto those twists. The basic rule used in determining the product is a uniformly colored spine bead with colored Prep pieces double-twisted onto it.

Figure 12A:
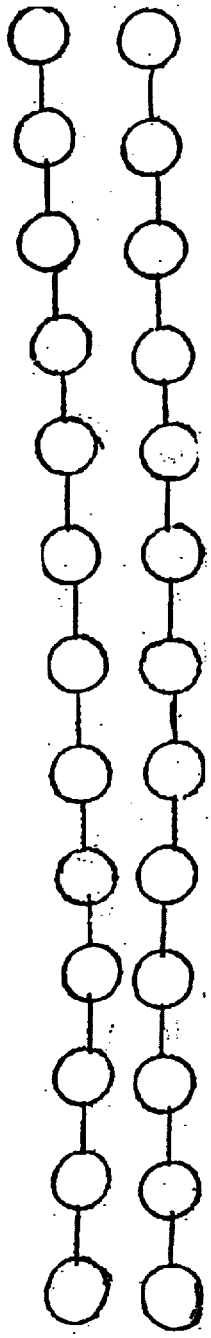
FIGS. 12A–12K provide preferred embodiments of steps of making Linkz beads, along with examples of variations of these types of twisted beads.
Figure 12B:
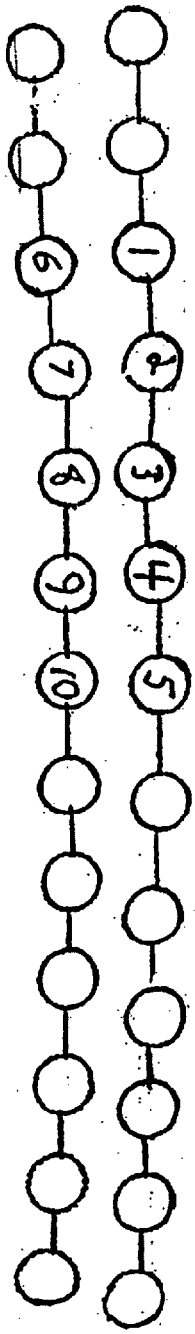
Figure 12C:
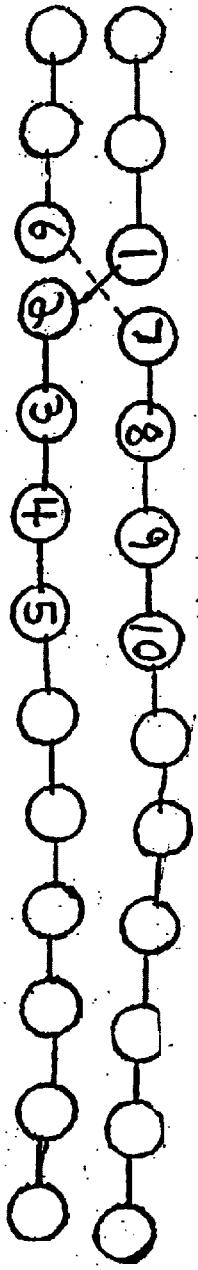
Figure 12D:
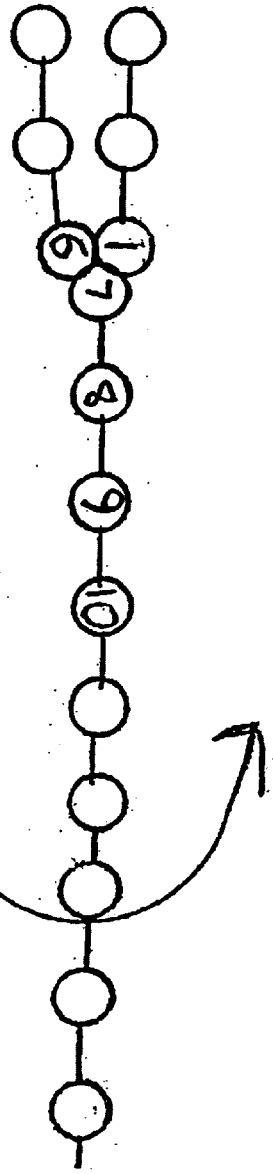
Figure 12E:
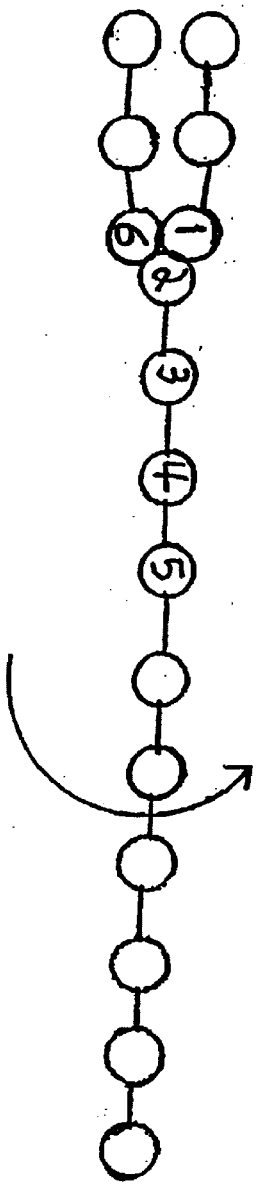
Figure 12F:
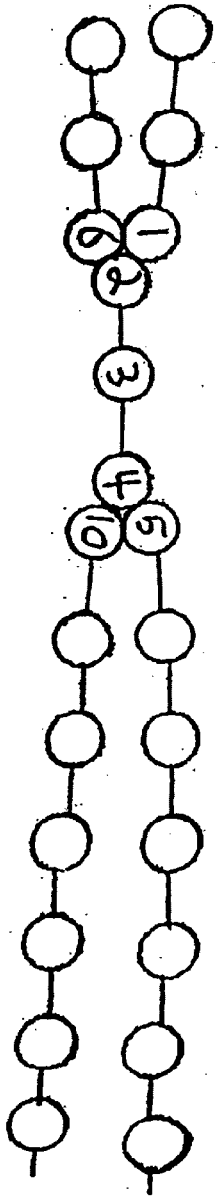
Figure 12G:
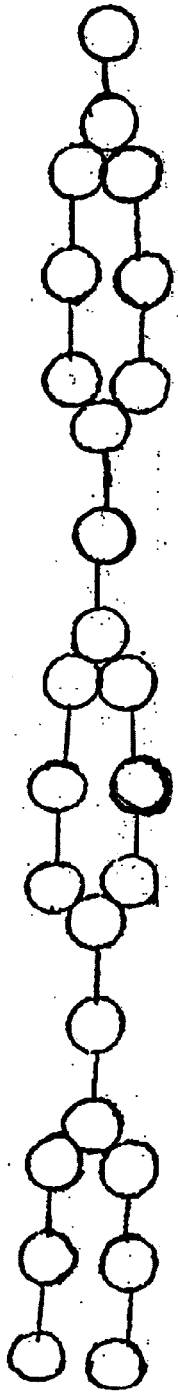
Figure 12H:
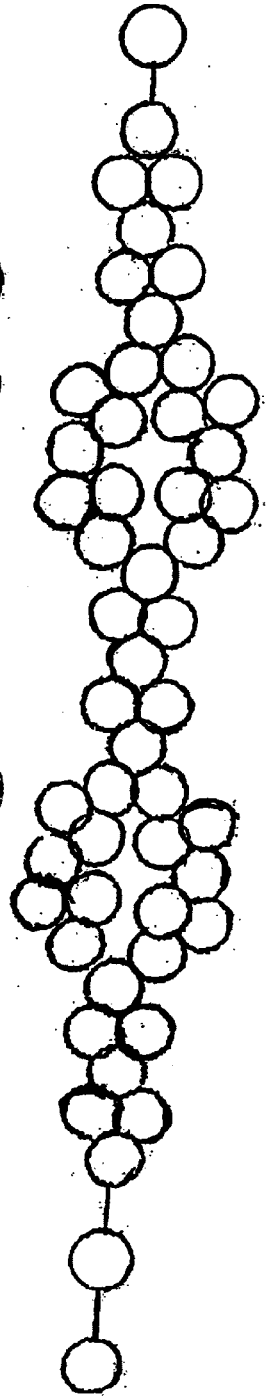
Figure 12I:
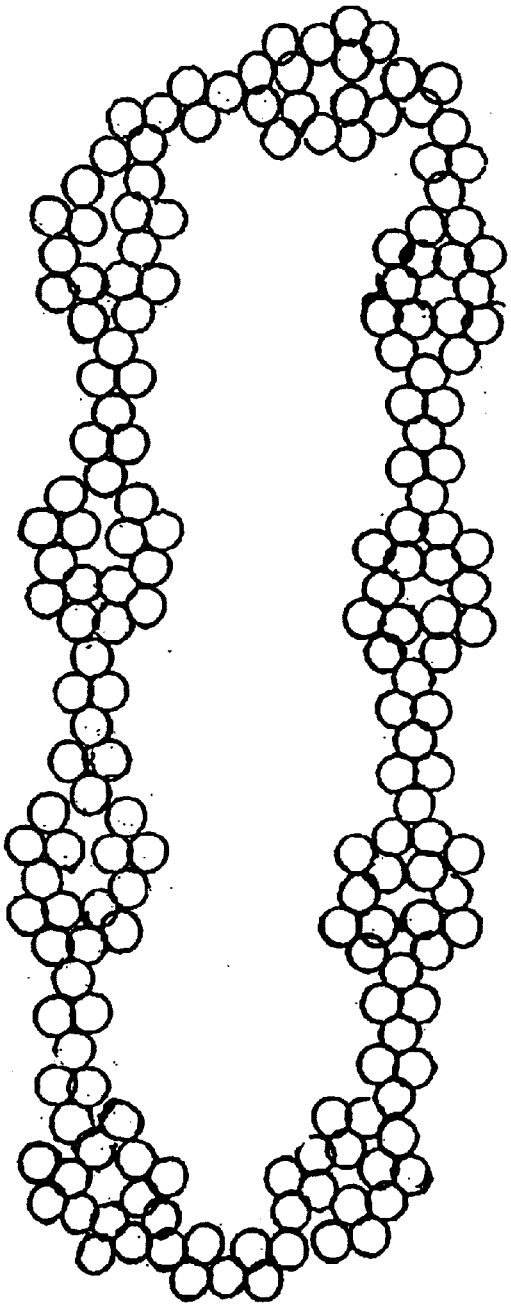

How to Make a Set of Linkz:

1. Choose the variables within the pattern, i.e. size/level of Linkz, color scheme for Prep pieces, ex. Purple green gold 2s
2. Take two strands of conventional Carnival beads
   A. Skip the first two beads on each strand to leave space for the finishing step (FIG. 12A)
3. Create a six-link by:
   A. Choose beads 1,2,3,4,5,6,7,8,9,10 (FIG. 12B)
   B. Take the $1^{st}$ rope and cross it over the $5^{th}$ rope (FIG. 12C)
   C. Twist beads 2, 3,4, 5, 7, 8, 9,10 (the bottom eight beads) to the right (FIG. 12D)
   D. Twist beads 2, 3, 4, 5, 7, 8, 9, 10 (the bottom eight beads) to the right a second time, forming a 360-degree lock between the $1^{st}$ and $5^{th}$ ropes (FIG. 12E)
   E. Double-twist the $4^{th}$ and $8^{th}$ ropes together to complete the six-link (FIG. 12F)
4. Repeat Step 3 until strands are completed (FIG. 12G)
5. Take color-schemed Prep 2s and double-twist them on to each available rope in each six-link (FIG. 12H)
6. Double-twist ends o spine bead together to create seam; trim any excess beads to create a Linkz product. (FIG. 12I)

Figure 12J:
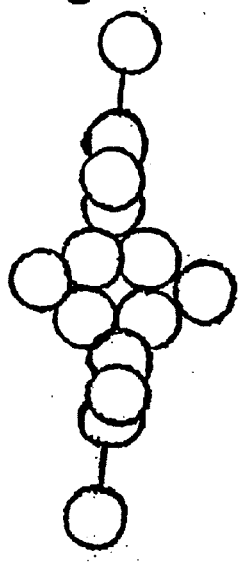

Some Variations Available:

Four-Linkz: (FIG. 12J)

Figure 12K:
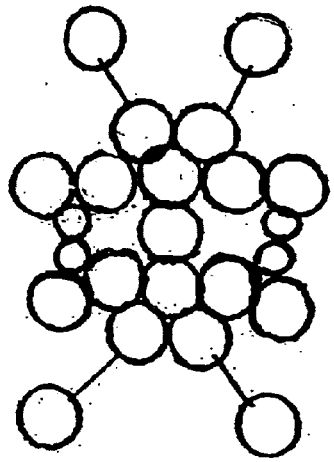

Level II Linkz: (FIG. 12K)

LOOPZ SPECIFICATIONS

Loopz is a Carnival bead design that is created by twisting conventional Carnival beads together. It is a mathematical pattern that repeats constantly, giving the product its consistency. There are infinite variations within the Loopz design; however, the repetitious mathematics distinguishes the product.

Loopz primarily use strands of conventional Carnival beads double-twisted together in a woven pattern. The basic rule used in determining the product is consistently twisted Carnival beads twisted together in a woven fashion.

Figure 13A:
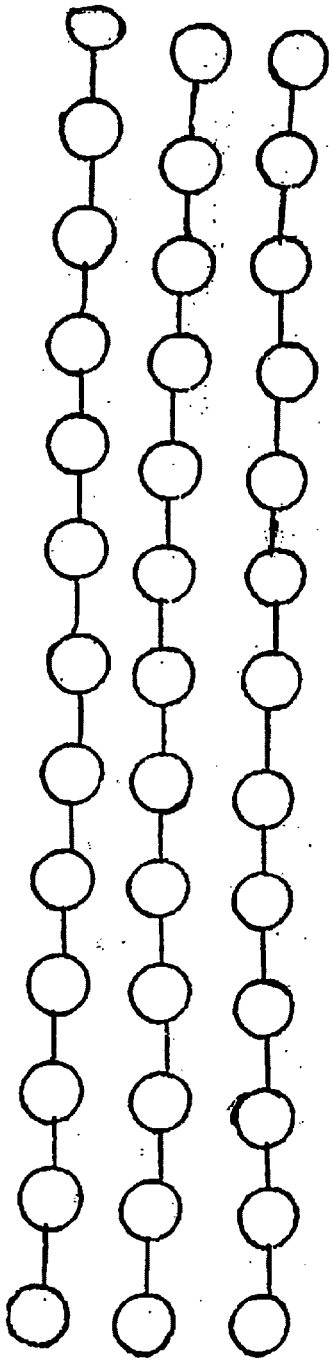
FIGS. 13A–13J provide preferred embodiments of steps of making Loopz beads, along with examples of variations of these types of twisted beads.
Figure 13B:
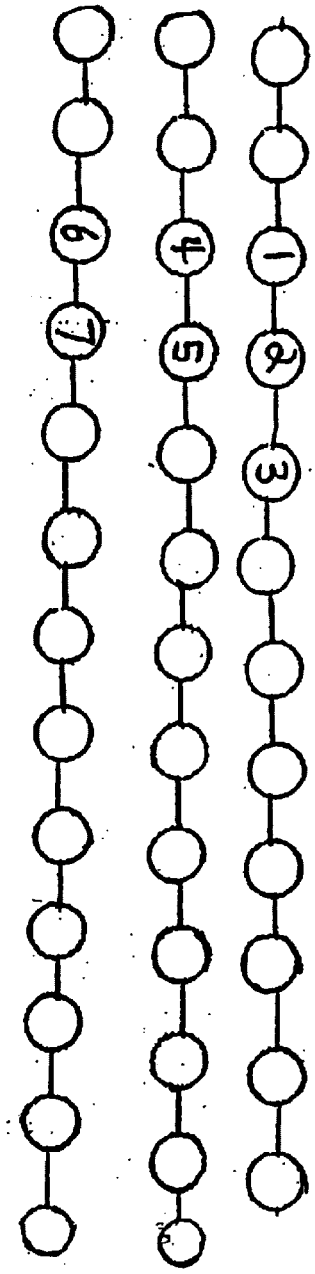
Figure 13C:
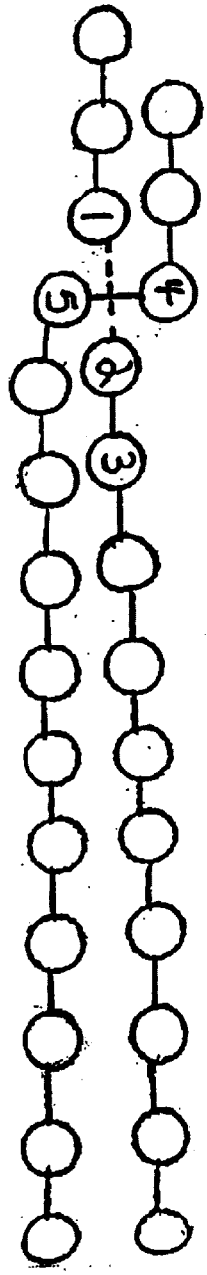
Figure 13D:
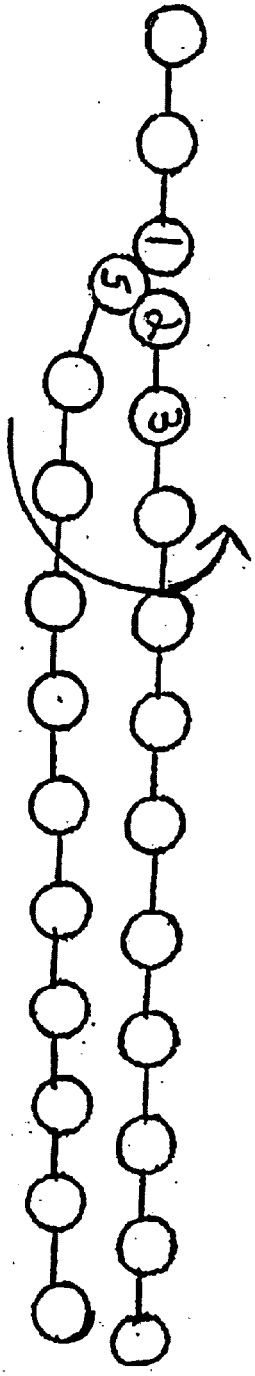
Figure 13E:
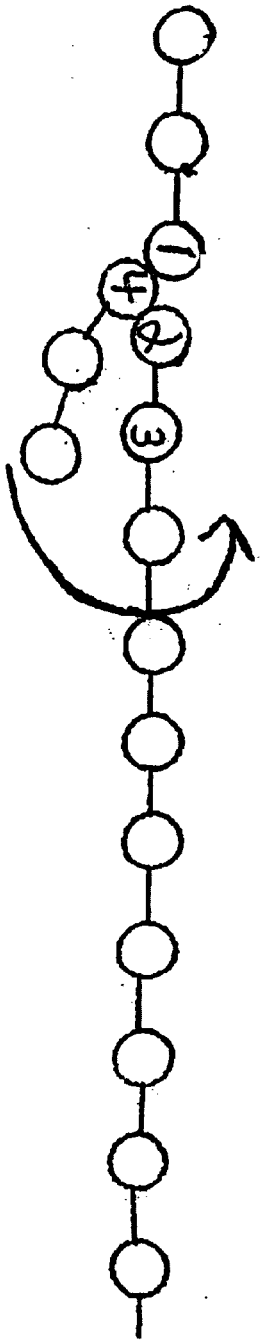

How to make a set of Loopz:

1. Choose the variables within the pattern, i.e. six-loop, cut-up loop, etc.
2. Take three strands of conventional Carnival beads
   A. Skip the first two beads on each strand to leave space for the finishing step (FIG. 13A)
3. Choose beads 1,2,3,4,5,6,7 (FIG. 13B)
4. Cross the $1^{st}$ rope on the first strand over the $1^{st}$ rope on the second strand (FIG. 13C)
5. Twist beads 4,5 to the right (FIG. 13D)
6. Twist beads 4,5 to the right a second time, forming a 360-degree lock with the $1^{st}$ ropes (FIG. 13E)

Figure 13F:
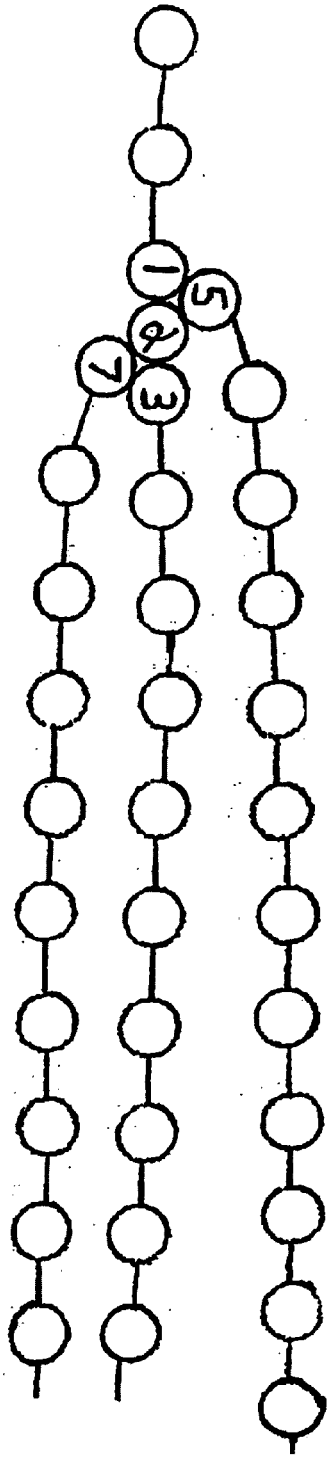
Figure 13G:
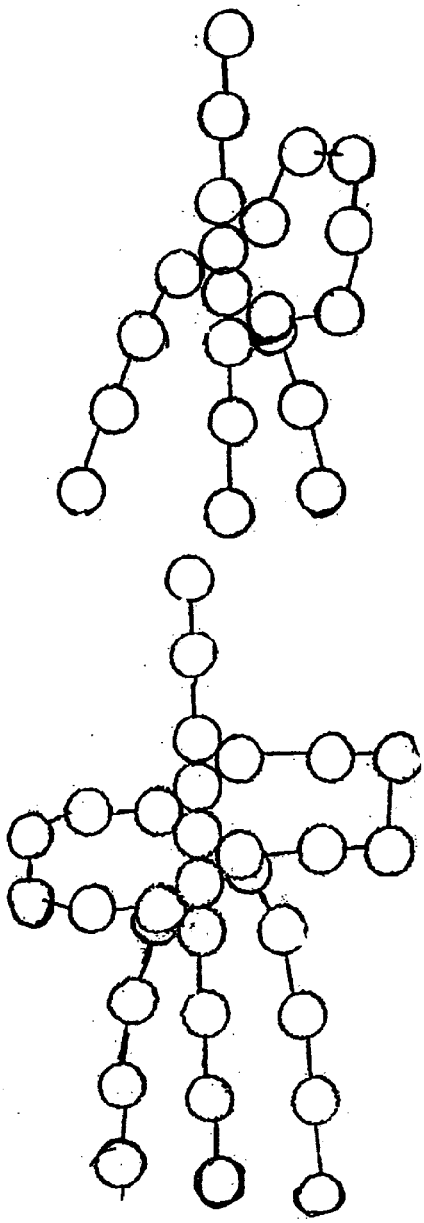
Figure 13H:
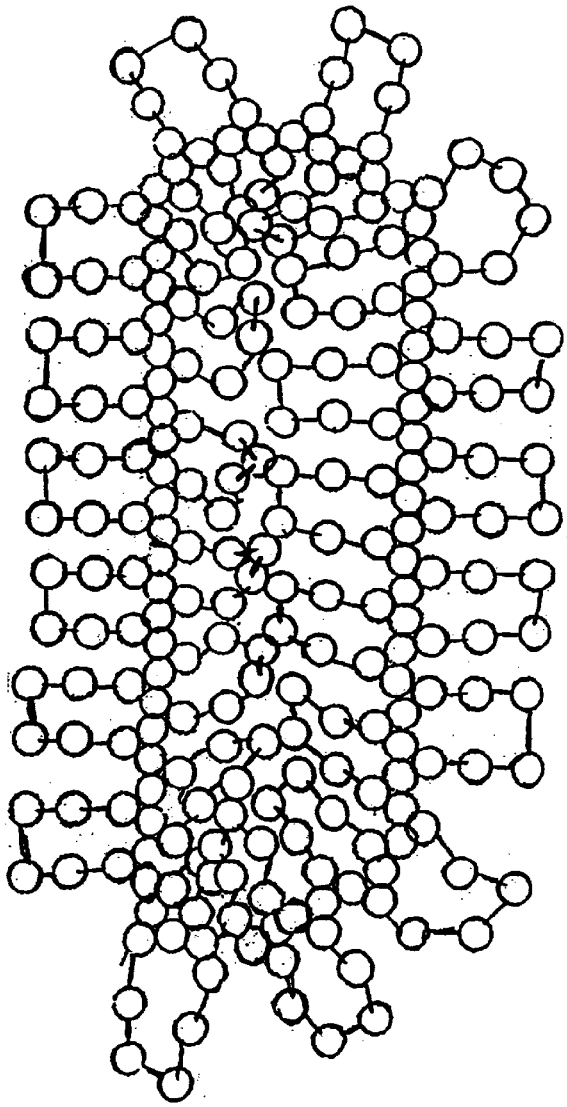

7. Double-twist the third strand to the second strand with beads 2,3,6,7 twisted to the right (FIG. 13F)
8. Skip six beads on the second strand, then double-twist it to the right with the first strand. Repeat with the third and first strands. (FIG. 13G)
9. Continue to alternate the second and third strands with the first strand to lengthen the pattern; double-twist the ends of the first, second, and third strands together, respectively, to create the seam. Trim any excess beads to create a Loopz product. (FIG. 13H)

Figure 13I:
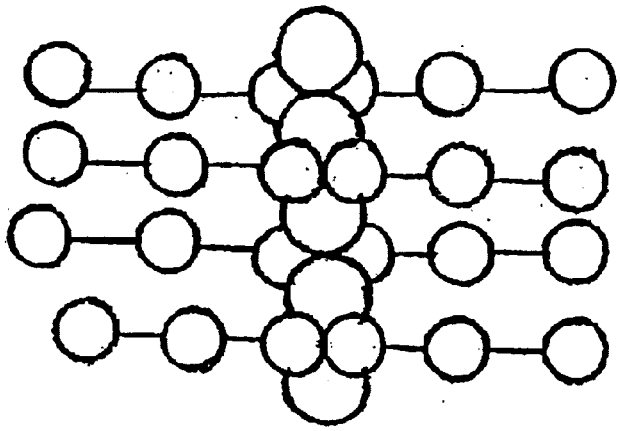

Some variations available:

Cut-up Loopz: (FIG. 13I)

Figure 13J:
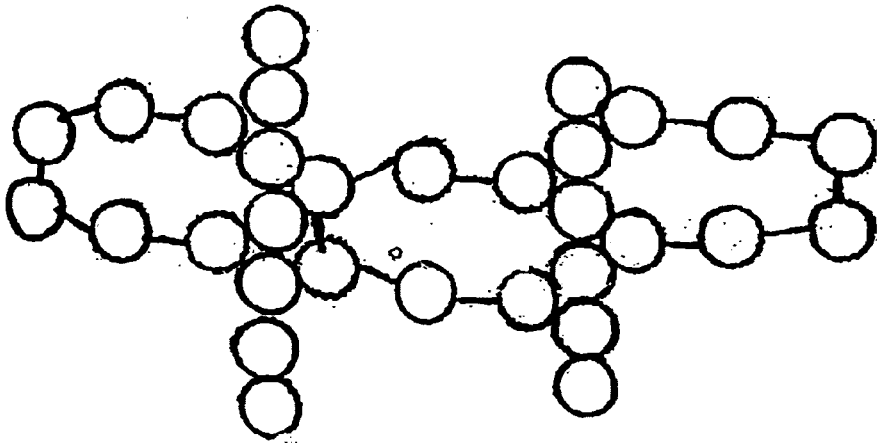

Level II Loopz: (FIG. 13J)

Medallionz Specifications

Medallionz is a Carnival bead design that is created by twisting conventional Carnival beads together in a circular formation. It is a mathematical pattern that repeats constantly, giving the pattern its consistency. There are infinite variations within the Medallionz design; however, the repetitious mathematics distinguishes the product.

Medallionz utilize a variety of cut-up Prep pieces, such as 2s and 4s, double-twisted on to a spine bead. The basic rule used in determining the product is double-twisted beads arranged in a circular formation.

Figures 14A, 14B, 14C, 14D:
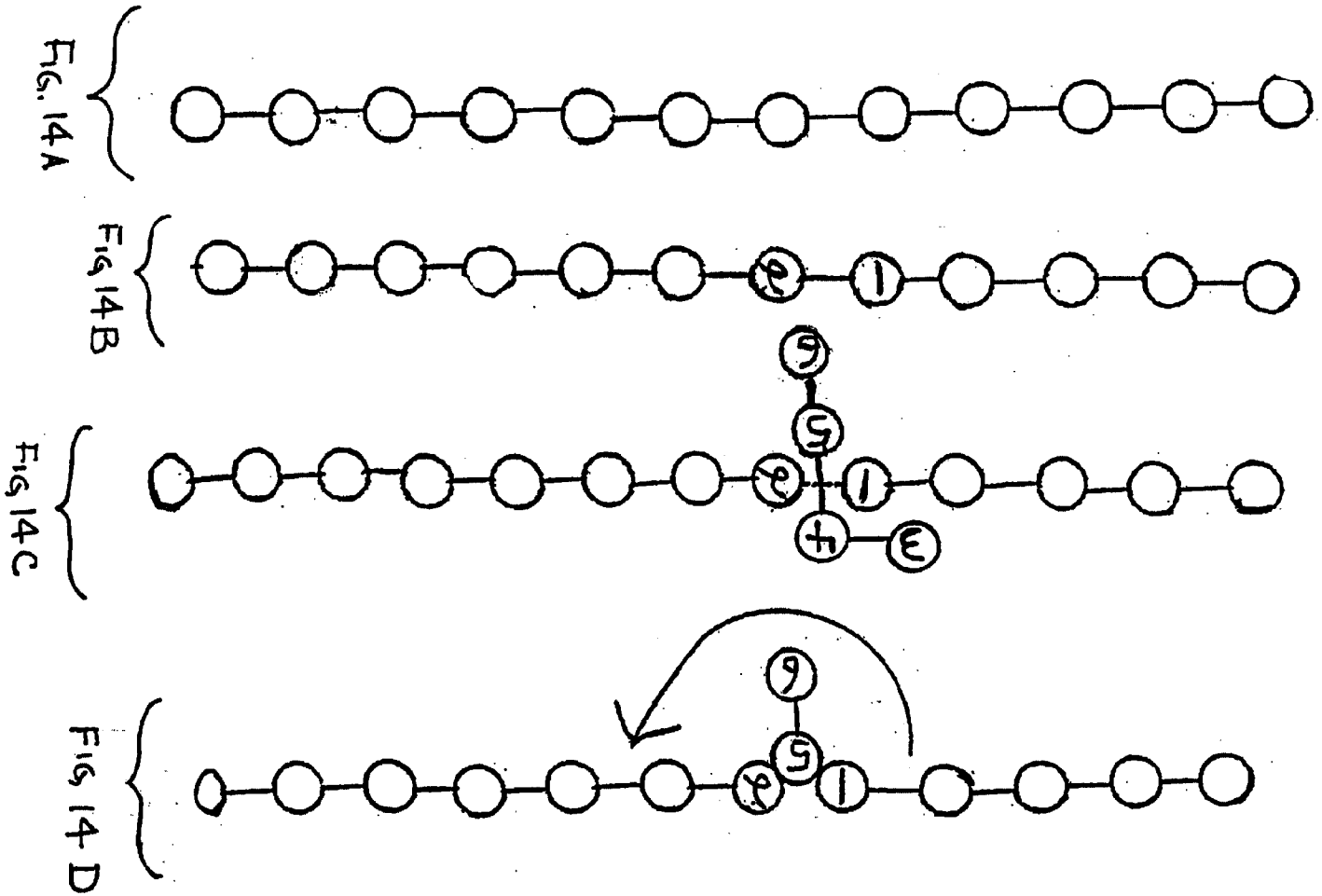
FIGS. 14A–14M provide preferred embodiments of steps of making Medallionz beads, along with examples of variations of these types of twisted beads.
Figures 14E, 14F, 14G:
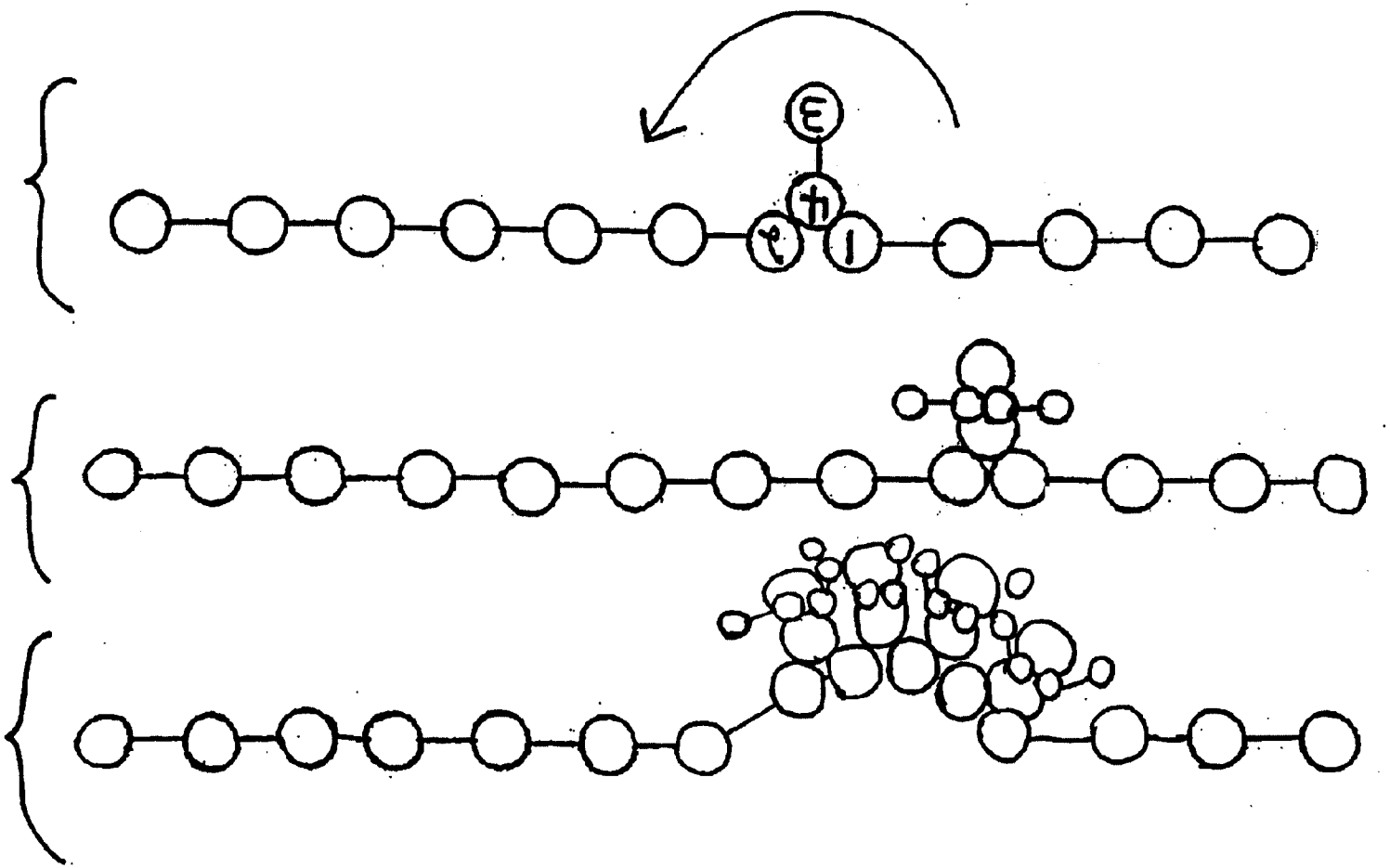
Figures 14H, 14I, 14J, 14K:
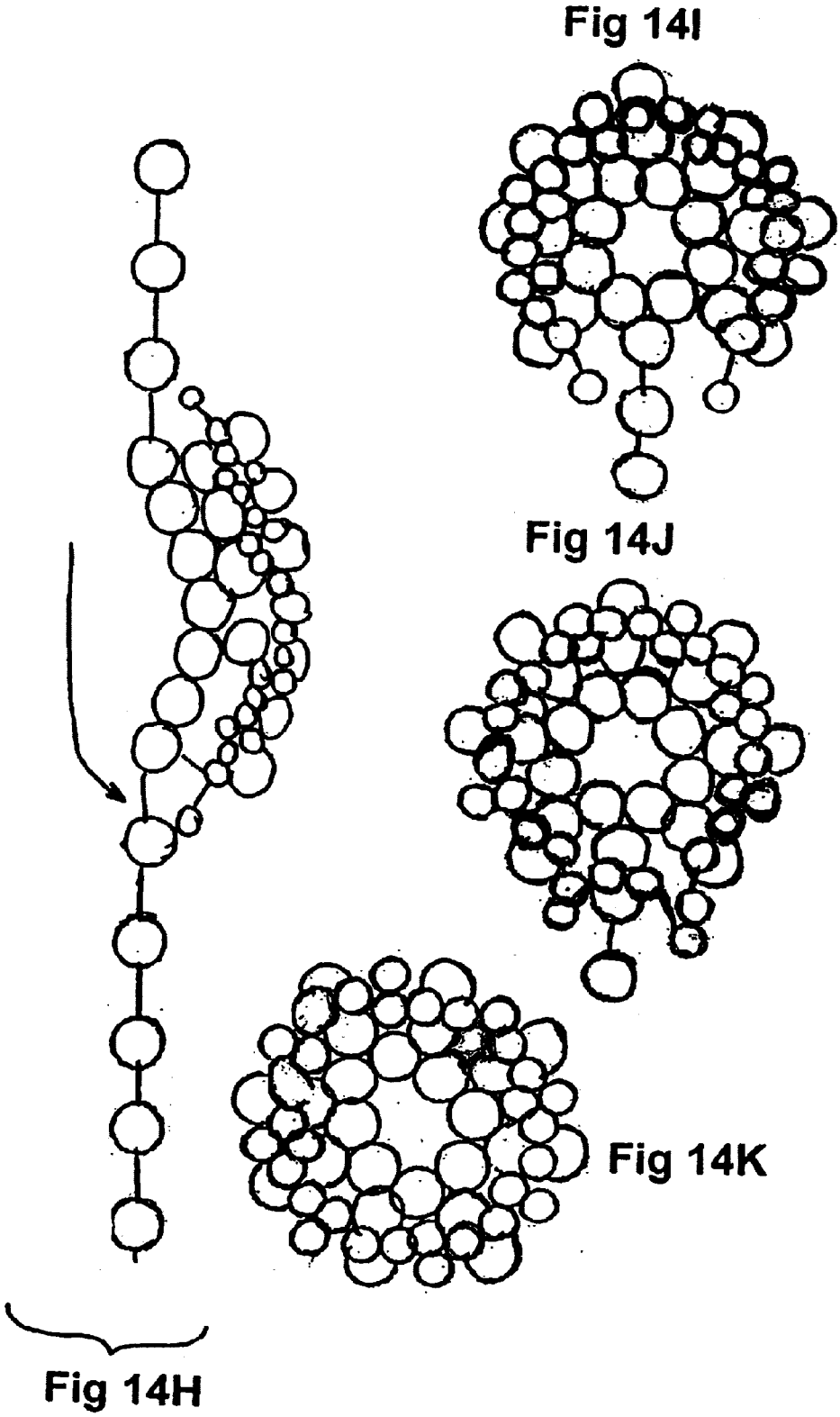

How to Make a Medallion:

1. Choose the variables within the pattern, i.e. number of spine arms, length of circumference Prep pieces, etc.
2. Take a strand of conventional Carnival beads
   A. Skip the first three beads on the strand to leave space for the finishing step (FIG. 14A)
3. Create a six-arm by:
   A. Choose beads 1,2 (FIG. 14B)
   B. Cross the $2^{nd}$ rope on a 4-bead Prep piece over the $2^{nd}$ rope on the strand (FIG. 14C)
   C. Twist beads 3,4,5,6 to the right (FIG. 14D) D. Twist beads 3,4,5,6 to the right a second time, forming a 360-degree lock with the two $2^{nd}$ ropes (FIG. 14E)
   E. Double-twist the $1^{st}$ and $5^{th}$ ropes together (FIG. 14F)
4. Repeat Step 3 on each available rope until enough arms minus one are completed (FIG. 14G)
5. Double-twist each Prep piece together to form circumference bead (FIG. 14H)
6. Double-twist the end beads together on each $1^{st}$ rope (FIG. 1)
7. Double-twist a 4-bead Prep piece on to $1^{st}$ available rope (FIG. 14J)
8. Double-twist the ends of the spine bead and the circumference Prep pieces together, respectively. Trim any excess beads to create a Medallionz product. (FIG. 14K)

Figure 14L:
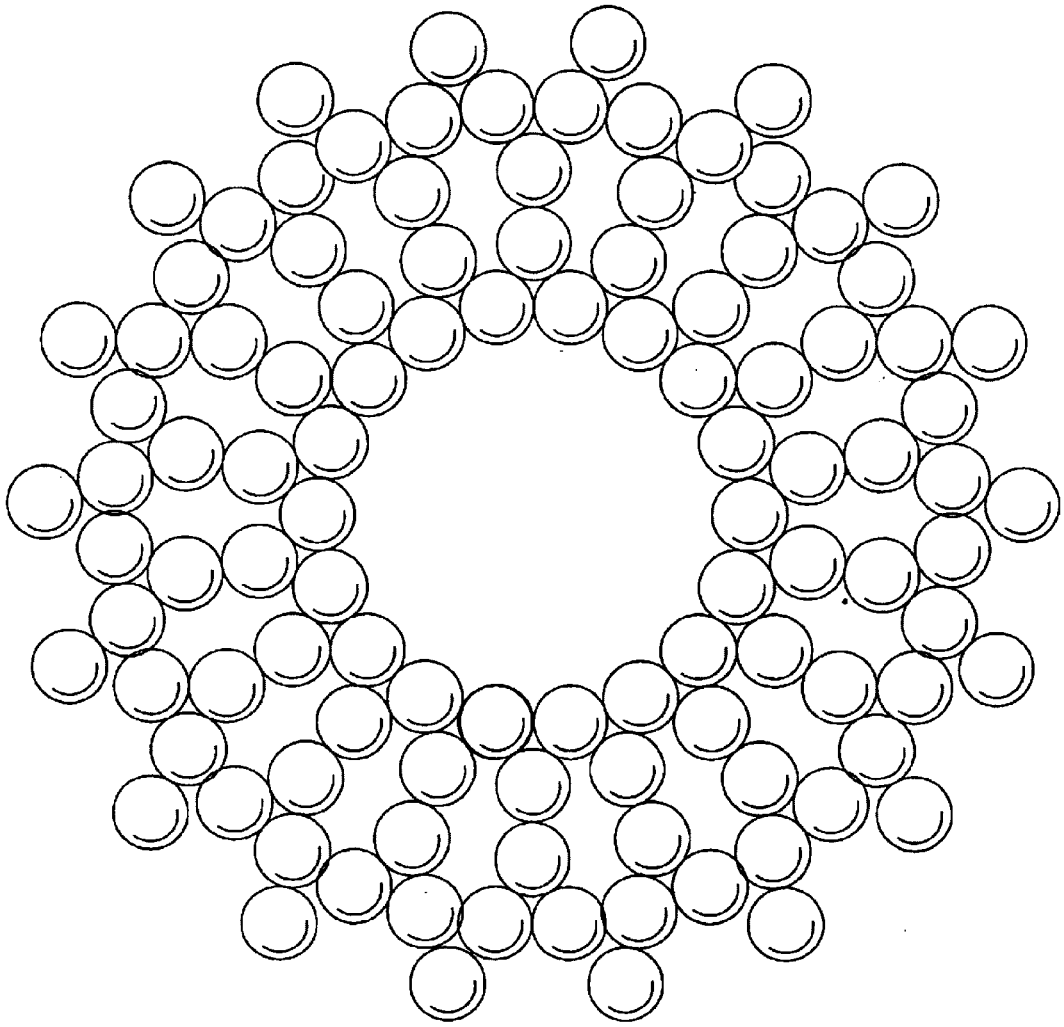

Some Variations Available:

16-arms (FIG. 14L)

Figure 14M:
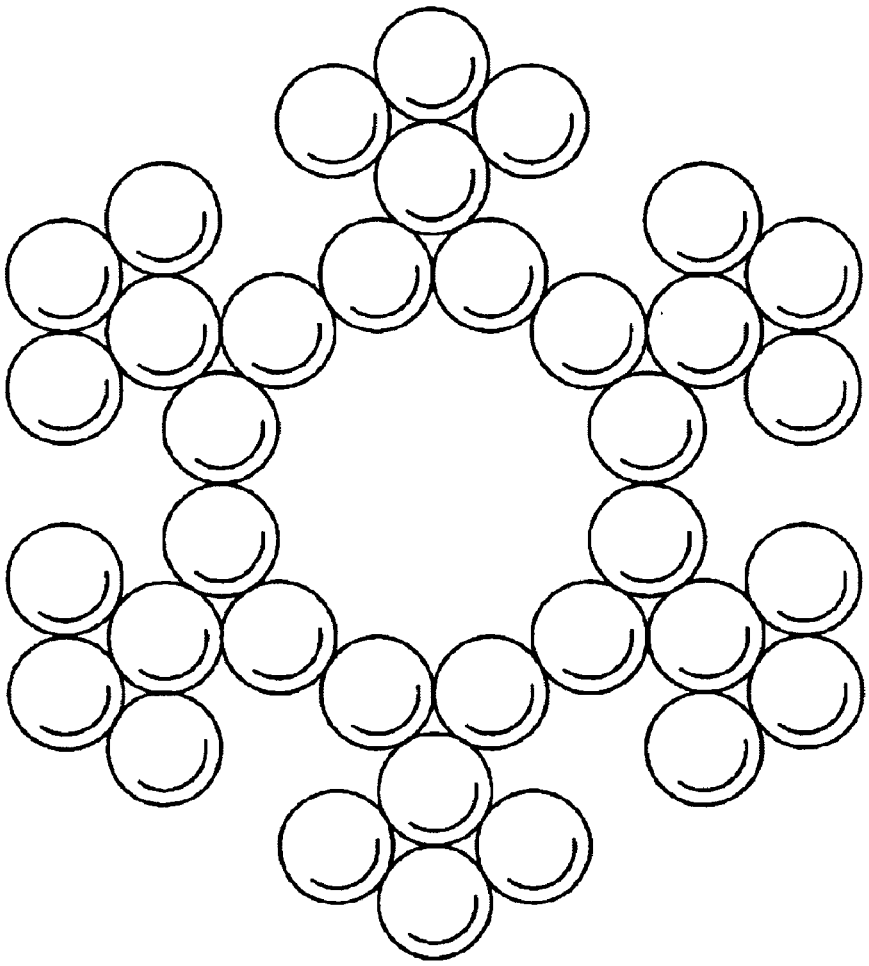

Prep circumference (FIG. 14M)

SPIRALZ SPECIFICATIONS

Spiralz is a Carnival bead design that is created by twisting conventional Carnival beads together. It is a mathematical pattern that repeats constantly, giving the product its consistency. There are infinite variations within the Spiralz design; however, the repetitious mathematics distinguishes the product.

Spiralz utilize primarily double-twists to spiral outer strands around a spine bead. The basic rule used in determining the product is outer strands of beads spiraling around a center spine bead.

DESCRIPTION OF SPIRALZ DRAWINGS

Figure 15A:
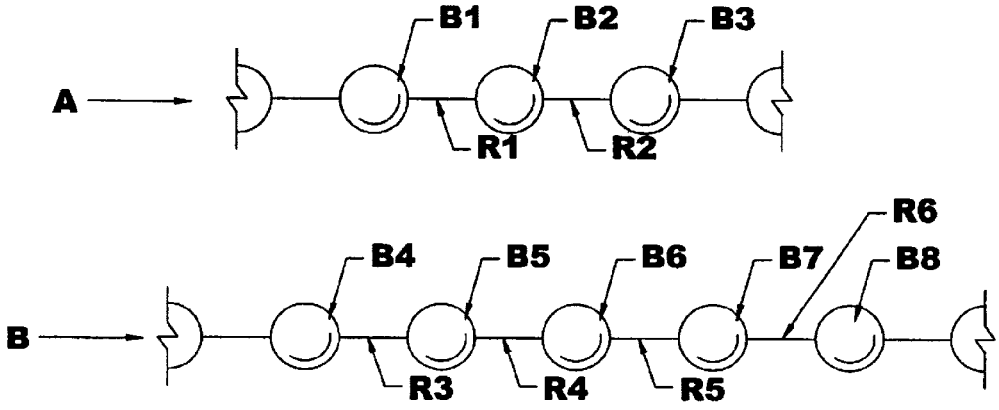
FIGS. 15A–15J provide preferred embodiments of steps of making Spiralz beads, along with examples of variations of these types of twisted beads.
Figure 15B:
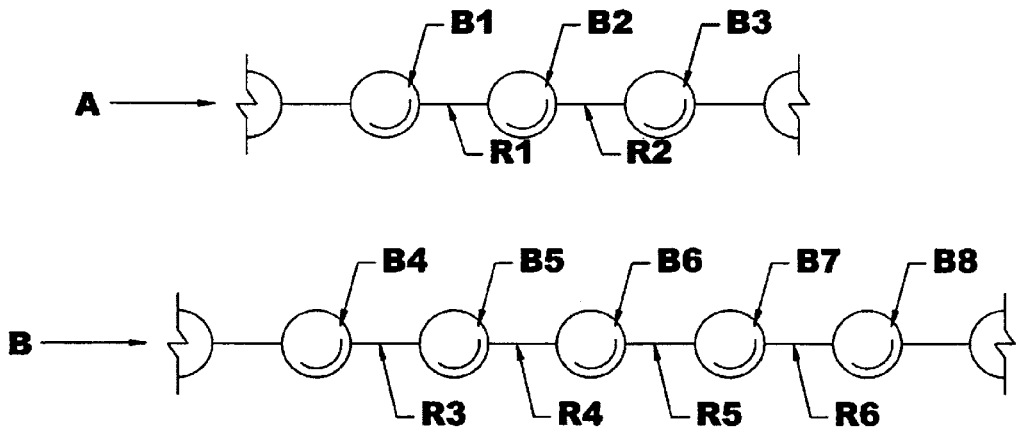
Figure 15C:
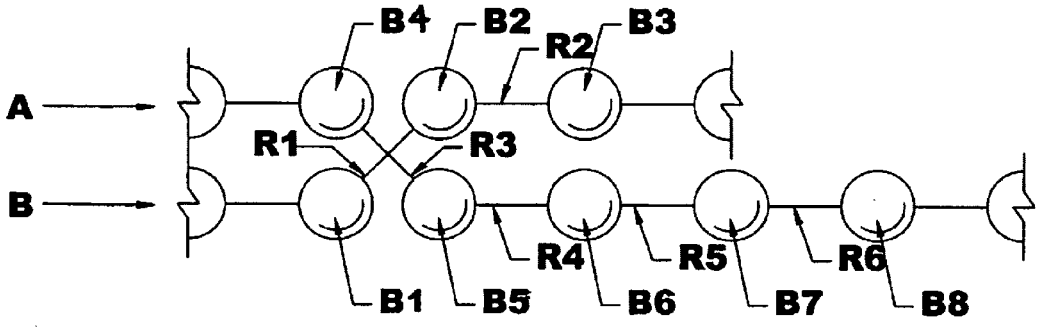
Figure 15D:
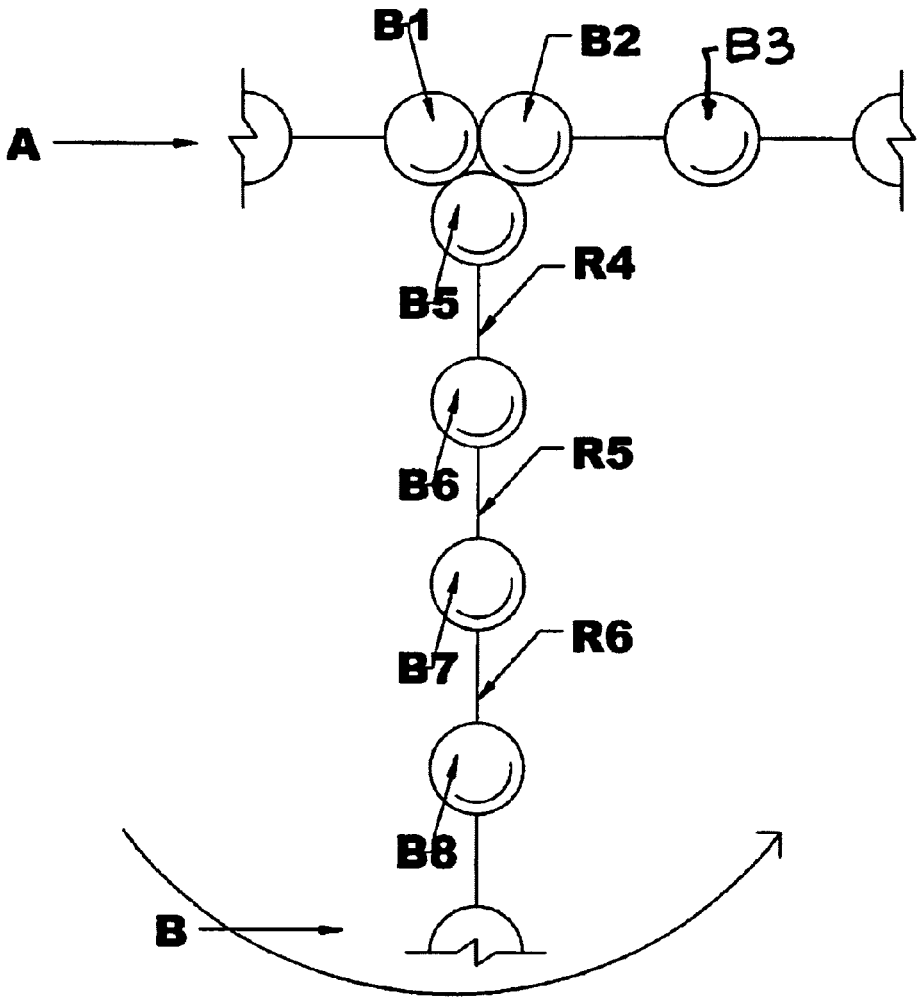
Figure 15E:
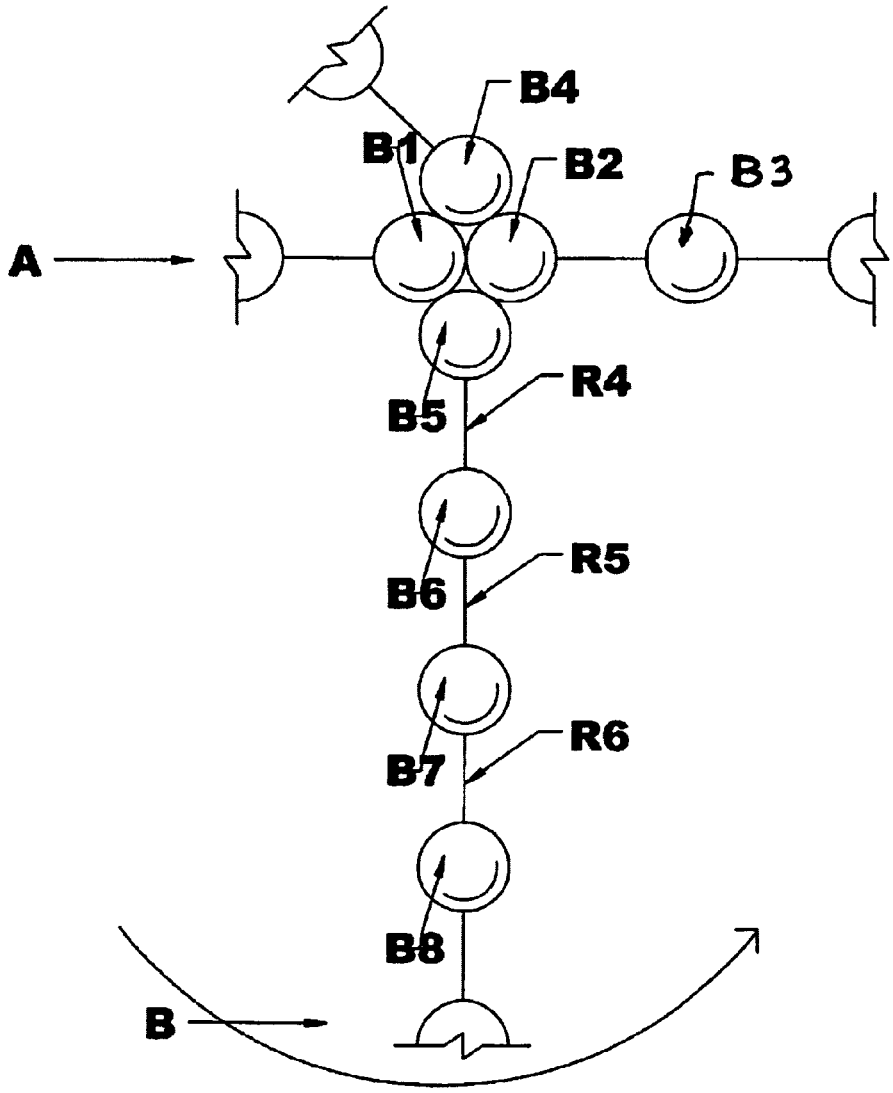
Figure 15F:
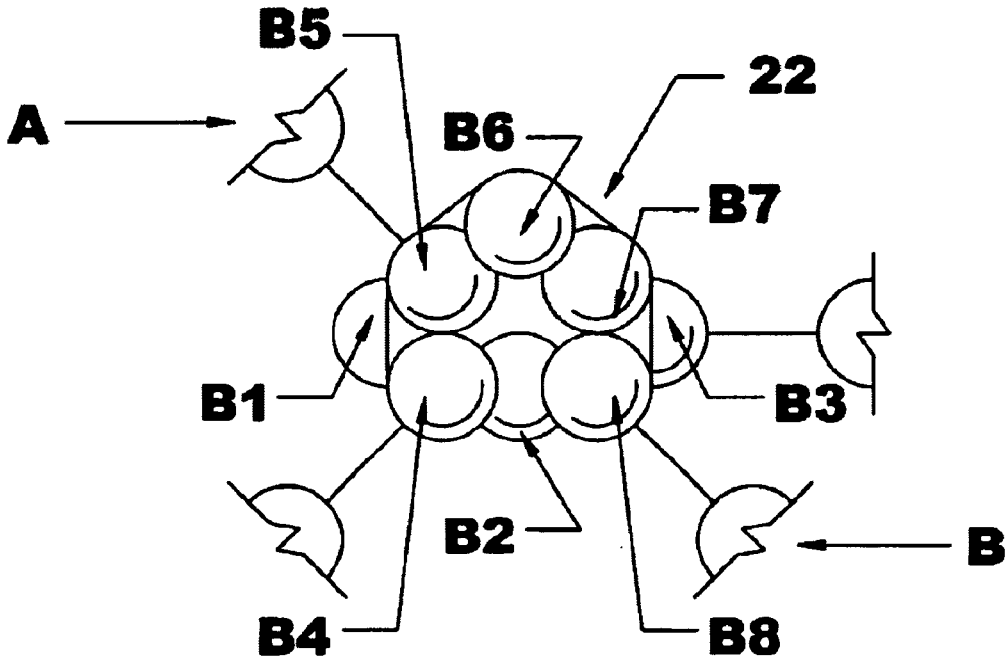
Figure 15G:
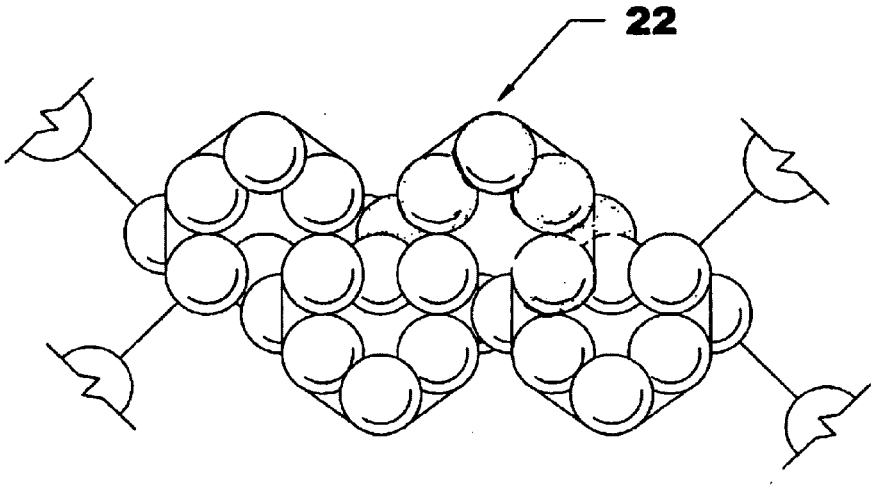
Figure 15H:
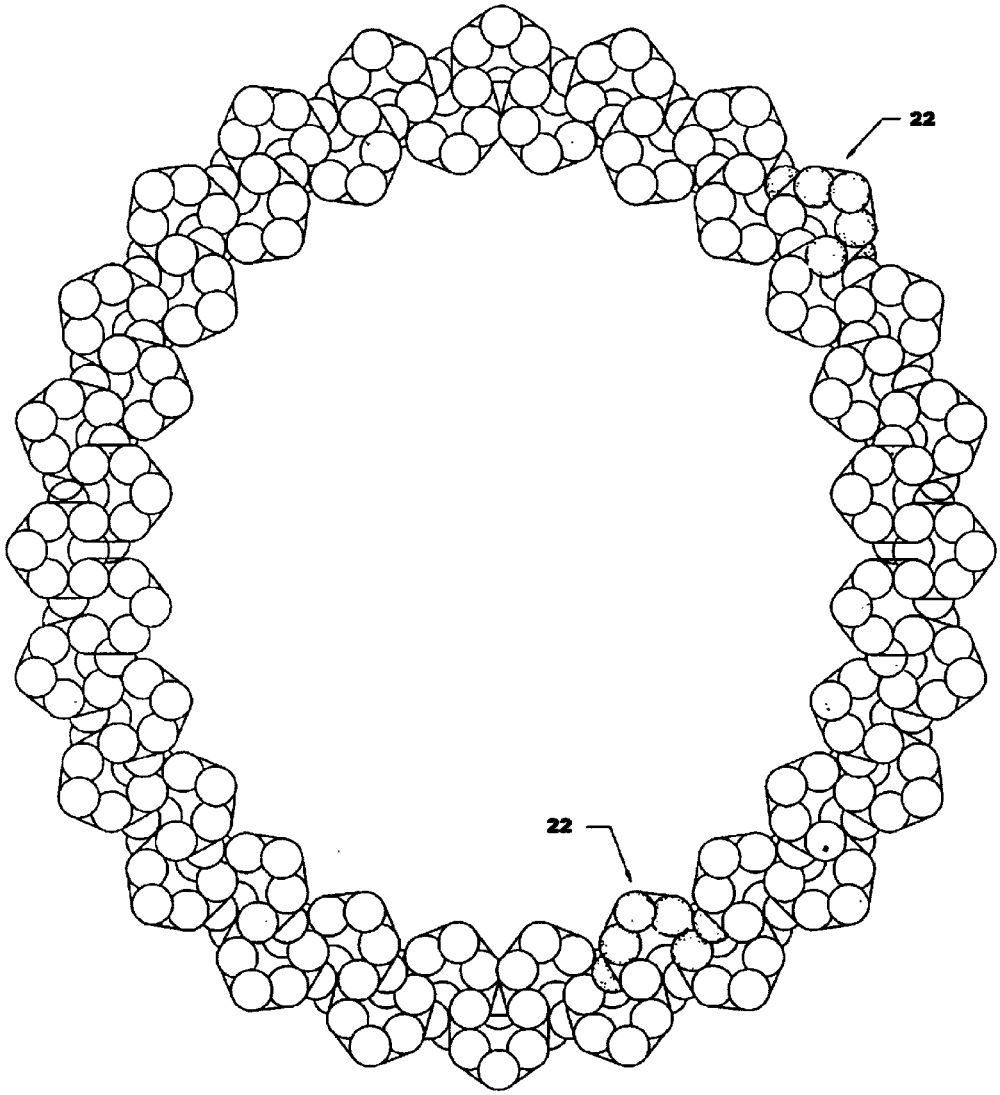

How to Make a Set of Spiralz:

1. Choose the variables within the pattern, i.e. size, level, or direction of design, ex. one-spiral, three-spiral, right-handed twist
2. Take two strands of conventional Carnival beads
   A. Skip the first three beads on each strand to leave space for the finishing step (FIG. 15A)
3. Choose beds 1,2,3,4,5,6,7,8 (FIG. 15B)
4. Cross the $1^{st}$ rope over the $3^{rd}$ rope (FIG. 15C)
5. Twist beads 4,5,6,7,8 to the right (FIG. 15D)
6. Twist beads 4,5,6,7,8 to the right a second time, forming a 360-degree lock with the $1^{st}$ and $3^{rd}$ ropes (FIG. 15E)
7. Skip a rope on the outer strand, and double-twist it to the next available rope on the spine strand (FIG. 15F)
8. Repeat Steps 4–7 on every available rope on the spine strand until strands are completed (FIG. 15G)
9. Double-twist ends of each strand together to create the seam; trim any excess beads to create a Spiralz product (FIG. 15H)

Figure 15I:
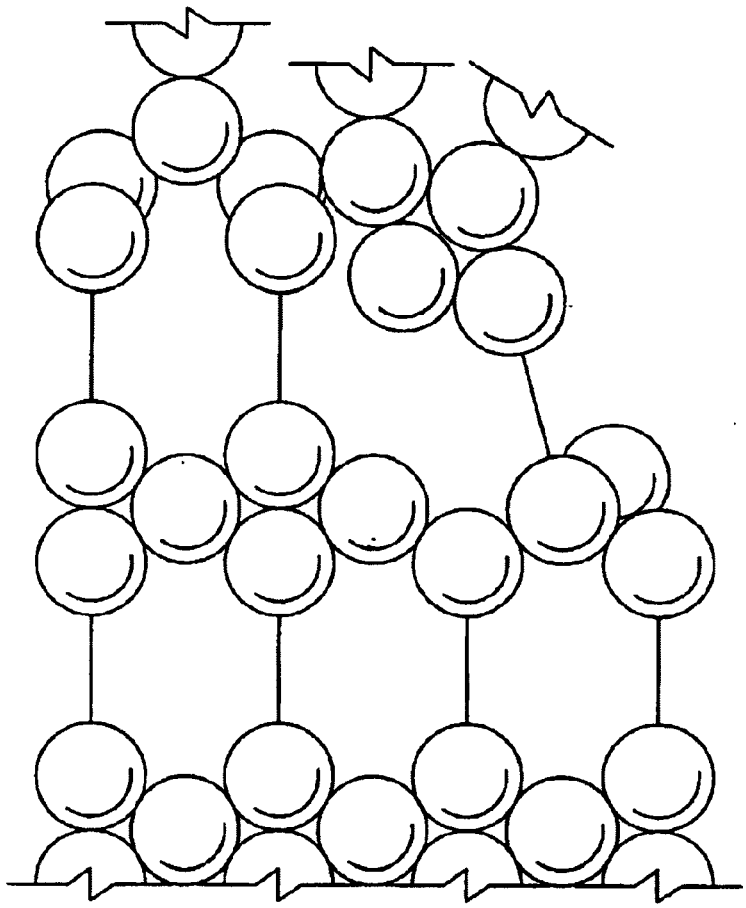

Some Variations Available:

Five-Spiral: (FIG. 15I)

Figure 15J:
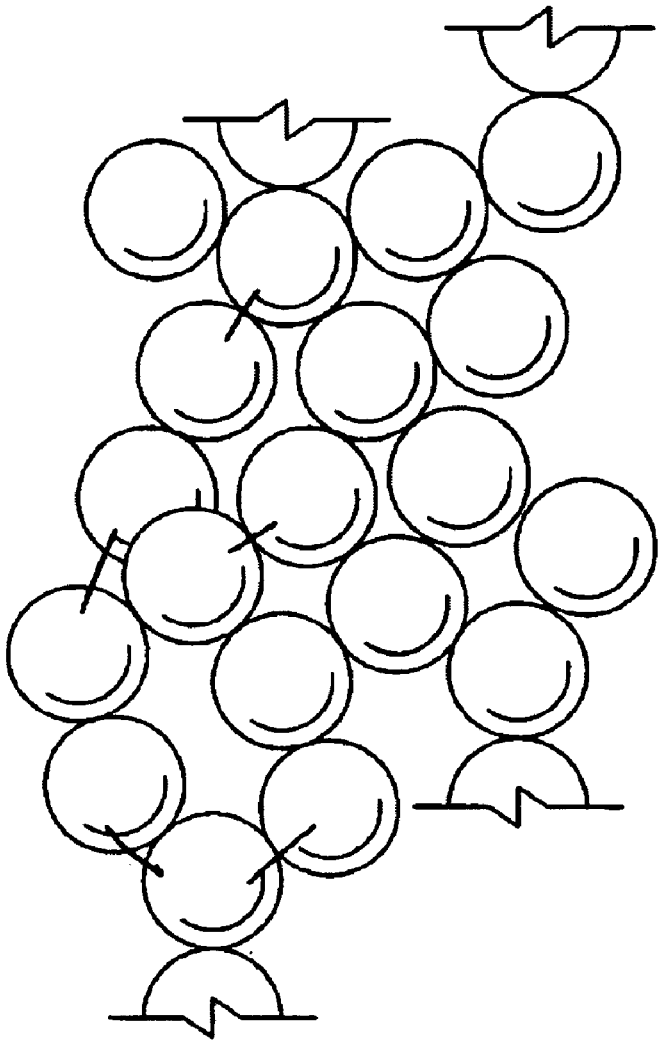

Double Helix Spiral: (FIG. 15J)

STARZ SPECIFICATIONS

Starz is a Carnival bead design that is created by cutting up conventional Carnival beads and then twisting them around a center bead. It is a mathematical pattern that repeats constantly, giving the product its consistency. There are infinite variations within the Starz design; however, the repetitious mathematics distinguishes the product.

Starz utilize a variety of cut-up Prep pieces, such as 3s and 4s. The basic rule used in determining the product is Prep pieces twisted around a larger center bead.

Description of Starz Drawings

Figure 16A:
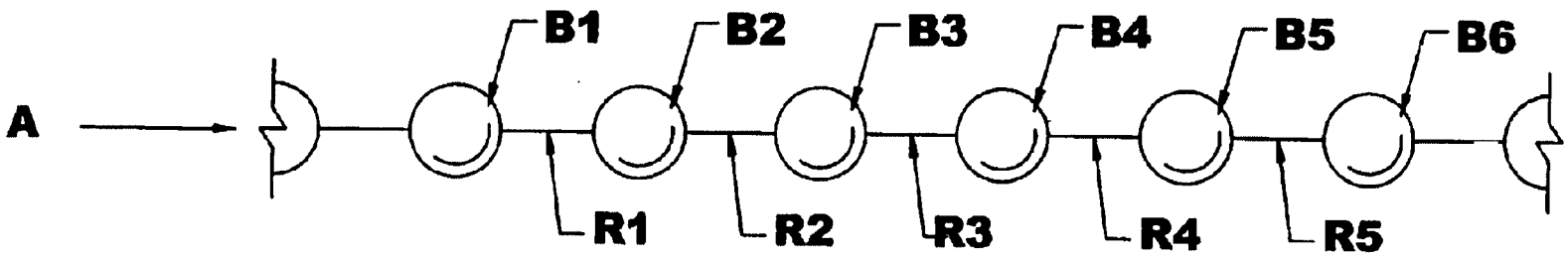
FIGS. 16A–16K provide preferred embodiments of steps of making Starz beads, along with examples of variations of these types of twisted beads.
Figure 16B:
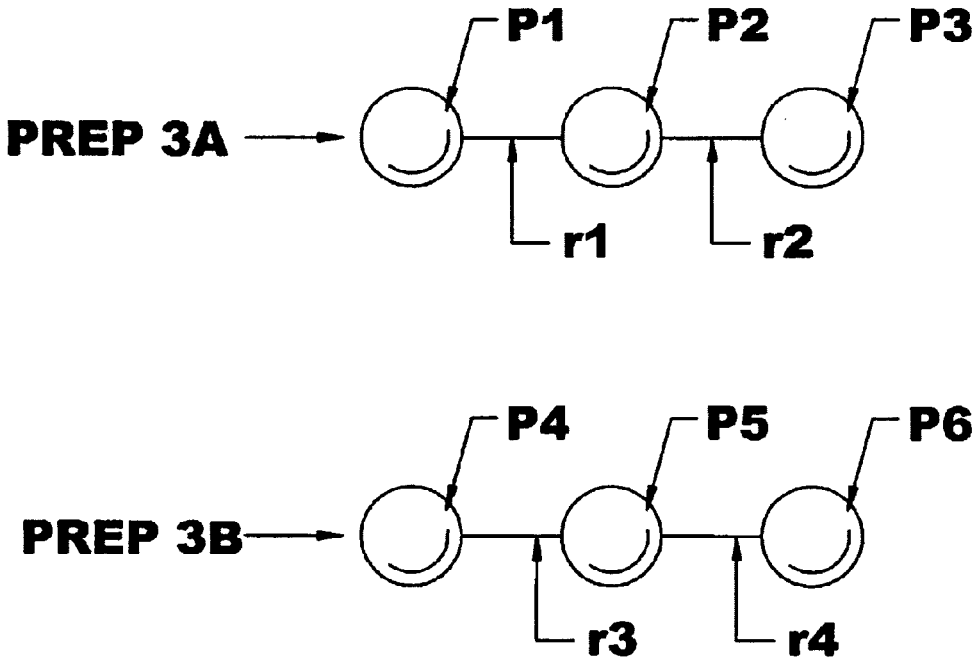
Figure 16C:
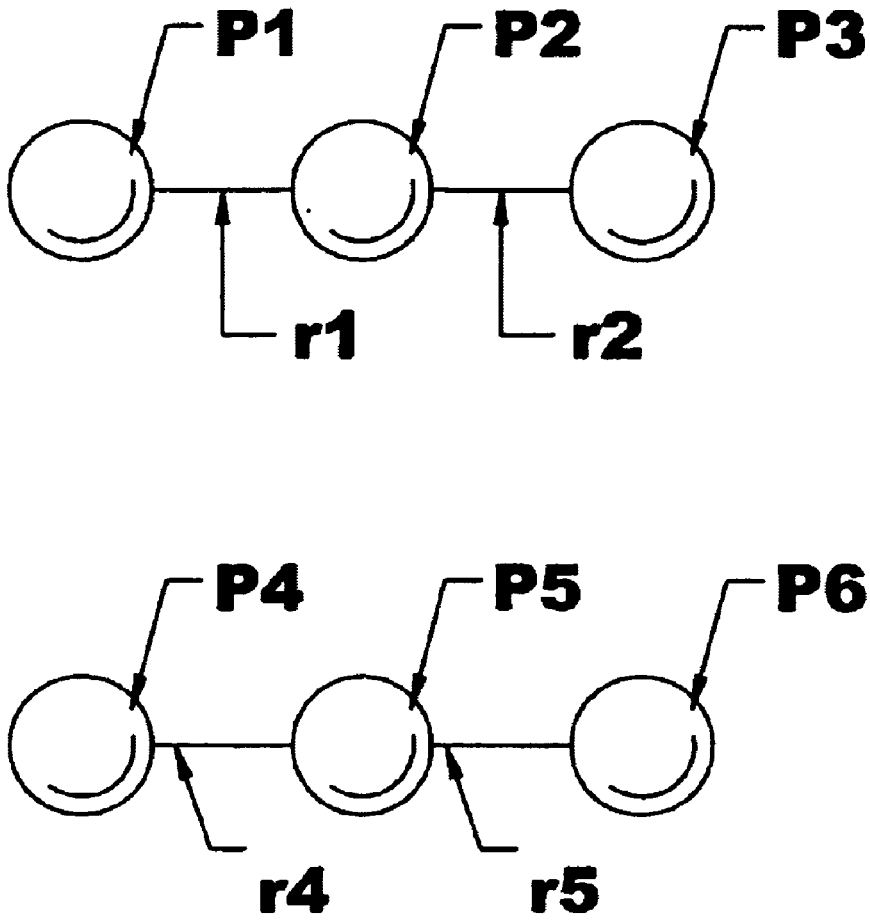
Figure 16D:
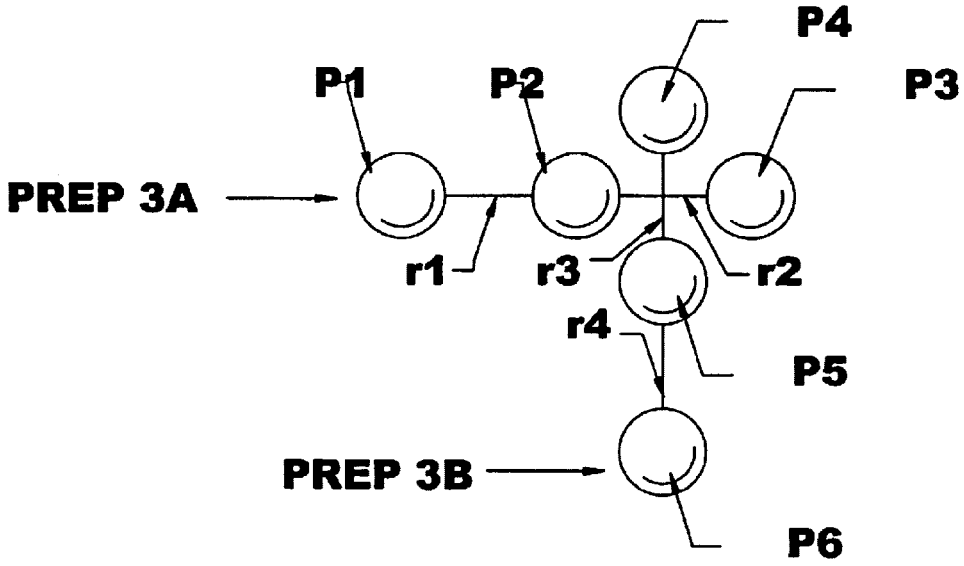
Figure 16E:
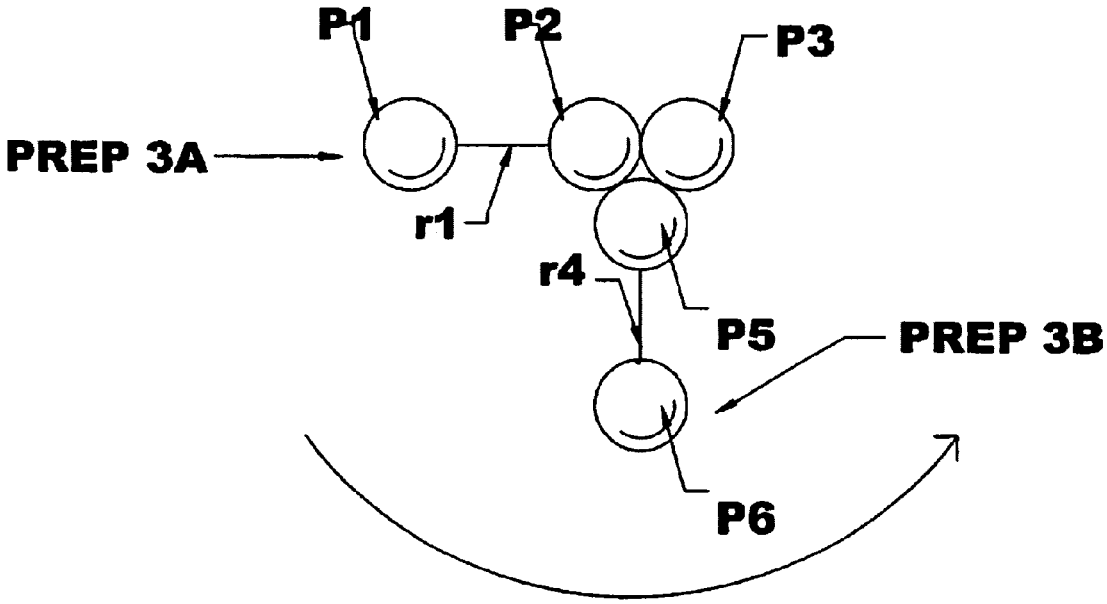
Figure 16F:
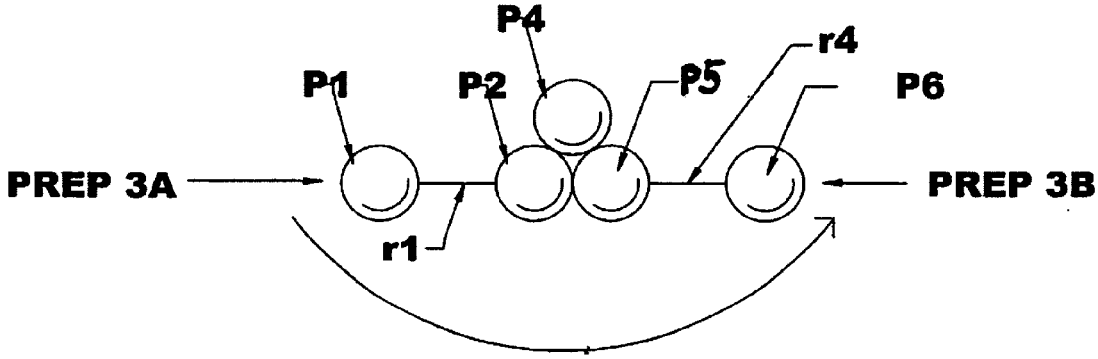
Figure 16G:
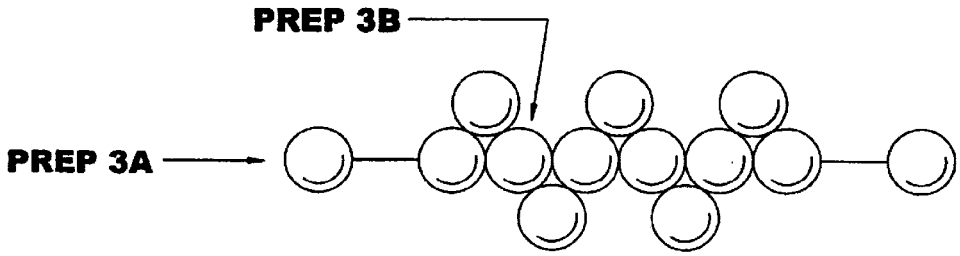
Figure 16H:
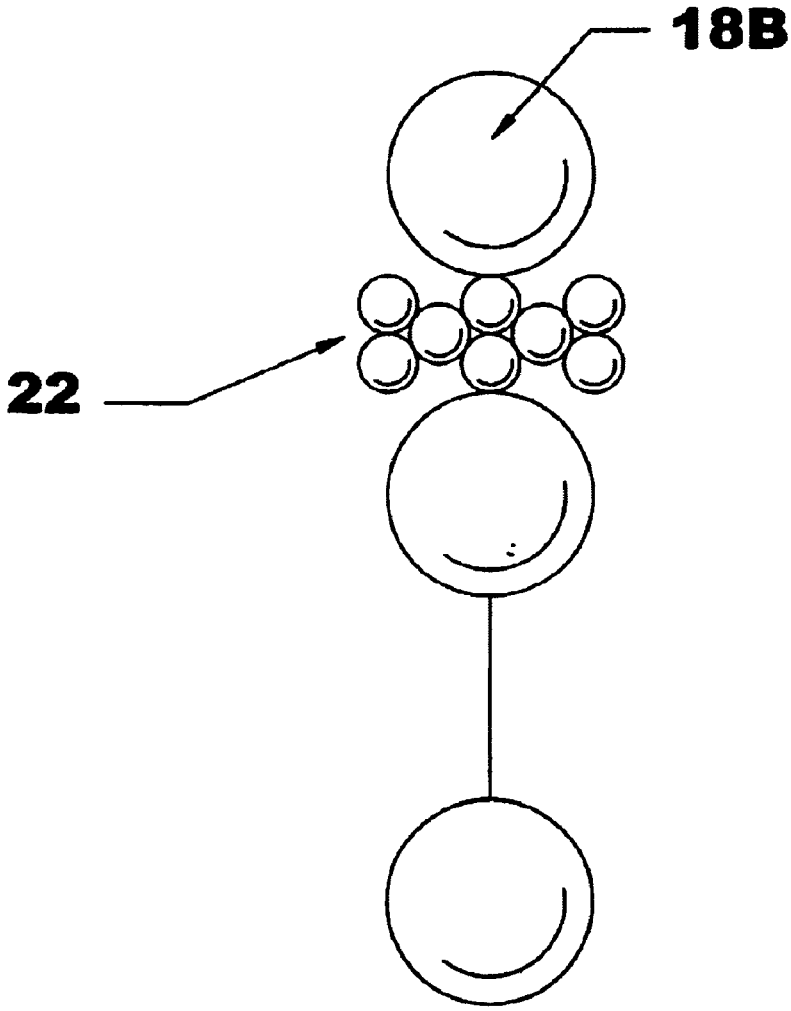
Figure 16I:
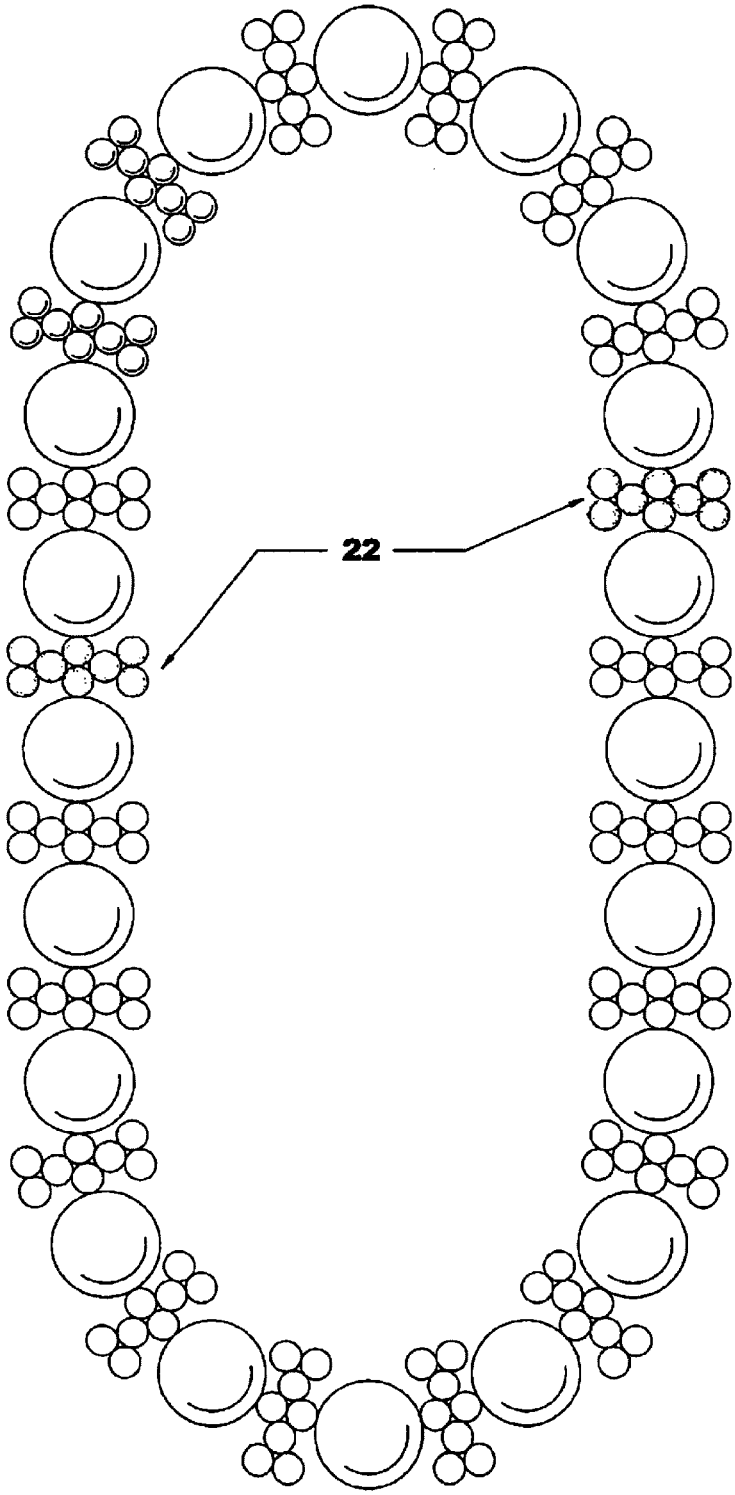

How to Make a Set of Starz:

1. Choose the variables within the pattern, i.e. color scheme for prep pieces, five-star, etc.
2. Take a strand of conventional Carnival beads (FIG. 16A)
   A. Cut it up into four pieces of three beads each (FIG. 16B)
3. Make a four-star by:
   A. Choose beads 1,2,3,4,5,6 (FIG. 16C)
   B. Cross the $2^{nd}$ rope over the $3^{rd}$ rope (FIG. 16D)
   C. Twist beads 4,5,6 to the right (FIG. 16E)
   D. Twist beads 4,5,6 to the right a second time, forming a 360-degree lock with the $2^{nd}$ and $3^{rd}$ ropes (FIG. 16F)
4. Repeat Step 2 until all Prep pieces in the four-star are twisted together (FIG. 16G)
5. Place a four-star around the larger spine beads; double-twist the end beads together to lock the four-star around the spine beads (FIG. 16H)
6. Repeat Step 4 until spine strand is completed; melt seam piece into spine beads and attach one four-star around it to create the seam. Trim any excess beads to create a Starz product (FIG. 16I)

Figure 16J:
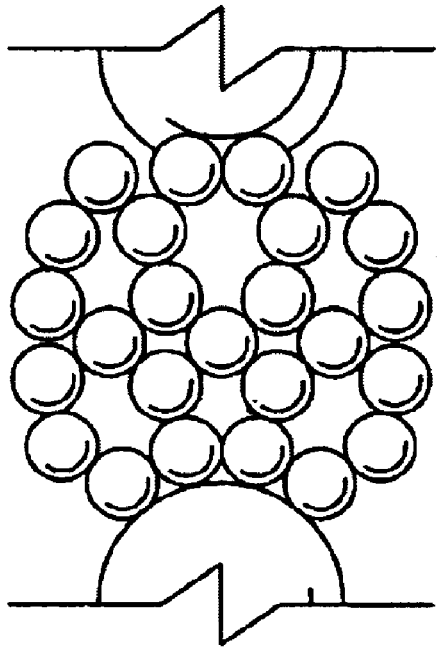

Some Variations Available:

Thick Starz: (FIG. 16J)

Figure 16K:
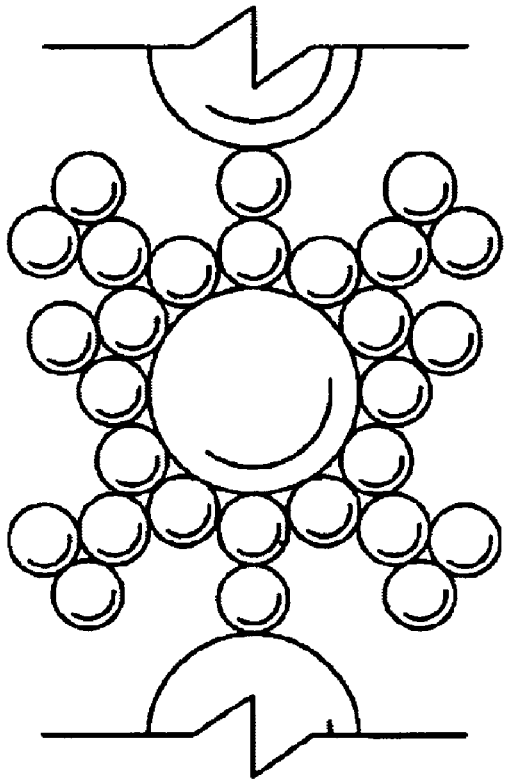

Level II Starz: (FIG. 16K)

BREAKBEADZ SPECIFICATIONS

Breakbeadz is a Carnival bead design that is created by breaking conventional Carnival beads off the strands and then twisting other beads in their gaps. It is a mathematical pattern that repeats constantly, giving the product its consistency. There are infinite variations within the Breakbeadz pattern; however, the repetitious mathematics distinguishes the product.

Breakbeadz require that individual beads be removed from the strand of beads in order to create the necessary gaps. The basic rule used in determining the product is consistently twisted Carnival beads placed in regular gaps in other beads.

Figure 17A:
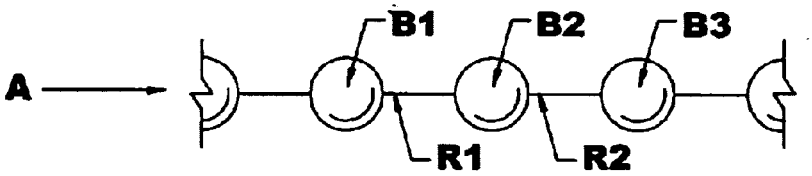
Figure 17B:
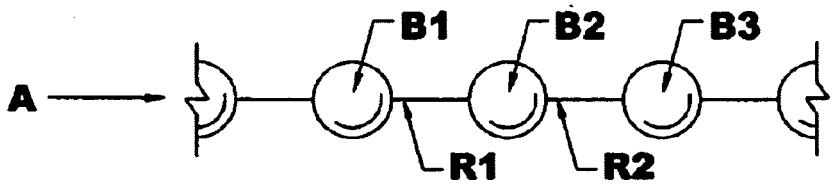
Figure 17C:
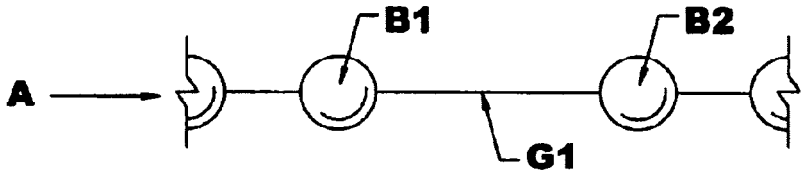
Figure 17D:
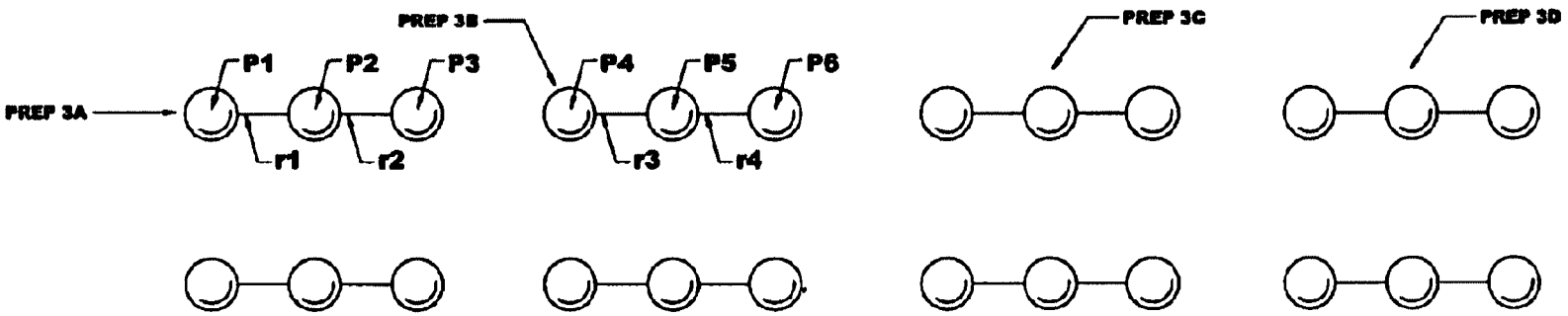
Figure 17E:
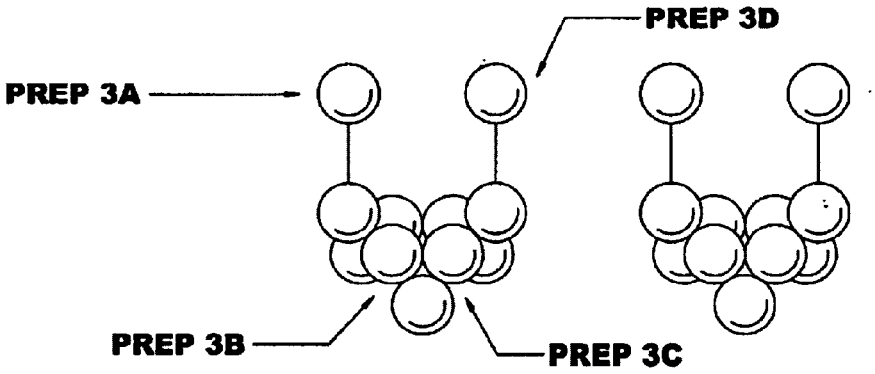
Figure 17F:
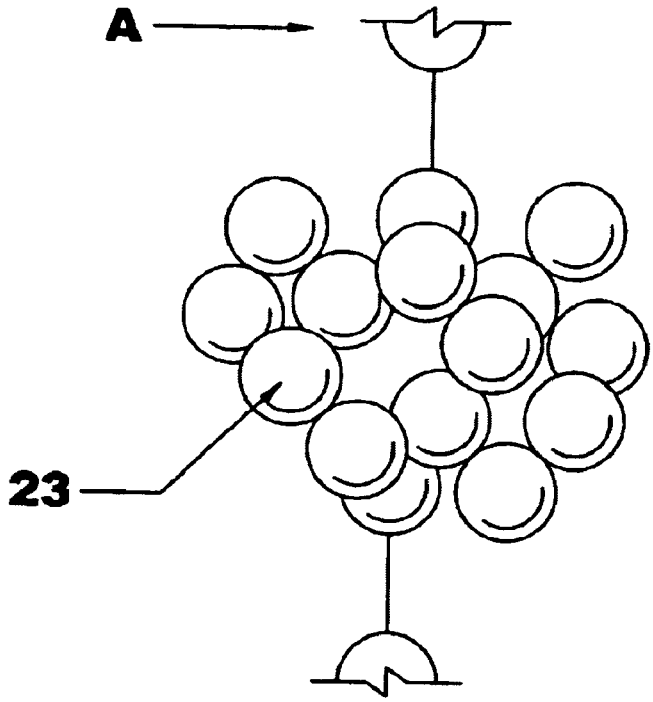
Figure 17G:
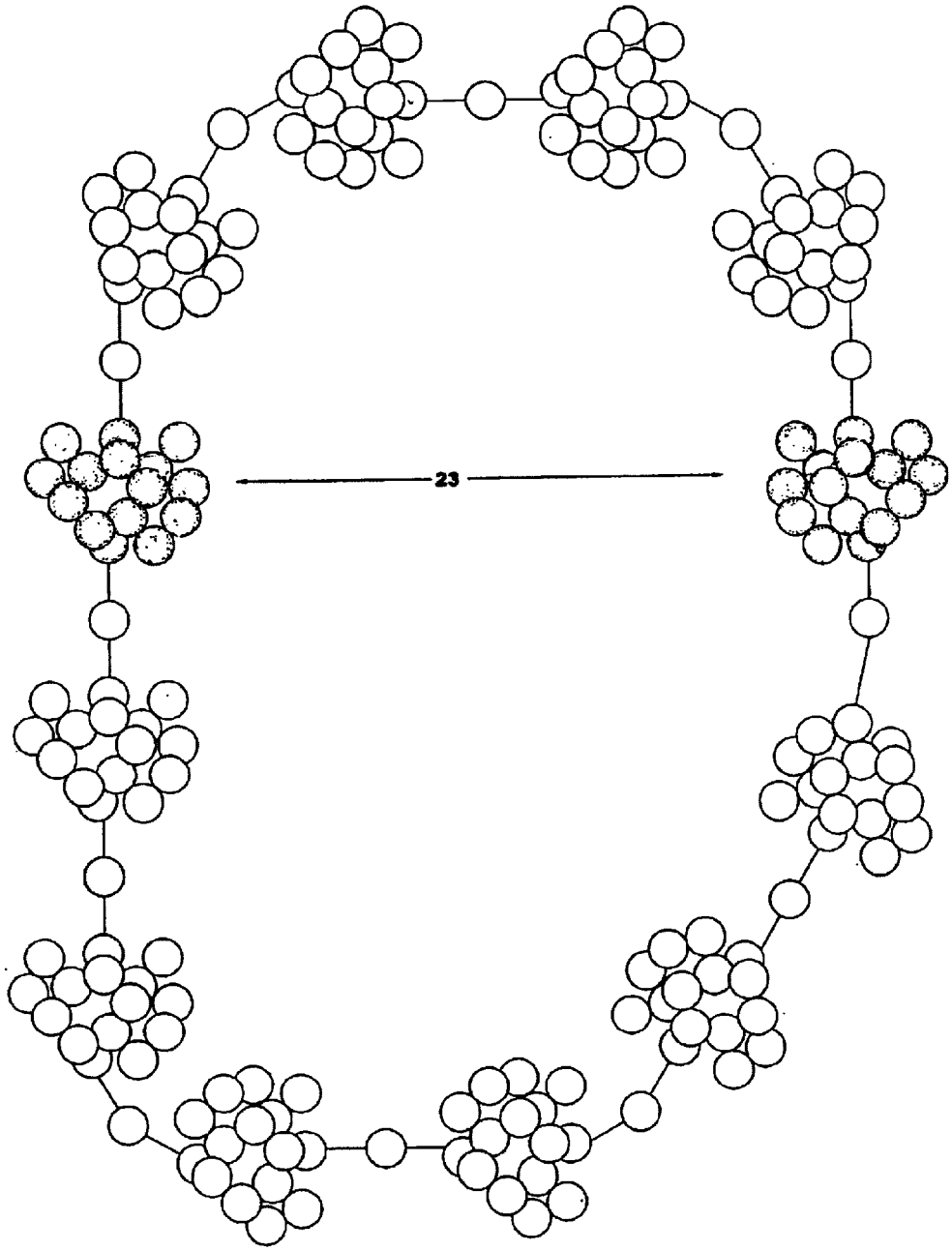

How to Make a Set of Breakbeadz:

1. Choose the variables within the pattern; i.e. 3-Gap, 4-Gap, color scheme, etc.
2. Take one strand of conventional Carnival beads (FIG. 17A)
   A. Skip two beads at the beginning of the strand to leave space for the finishing step
   B. Choose bead 2 (FIG. 17B)
   C. Use a pair of pliers to crush bead 2 off of the strand, forming a 1-Gap between beads 1 and 3 (FIG. 17C)
3. Take a stand of beads and cut it into eight pieces of three beads each (FIG. 17D)
4. Double-twist the ends of each Prep-3 together; create two pieces of four Prep-3s each (FIG. 17E)
5. Double-twist each finished piece around the 1-Gap on the spine strand (FIG. 17F)
6. Repeat Steps 2–5 to lengthen the pattern; double-twist the ends of the spine bead together to create the seam. Trim any excess beads to create a Breakbeadz product. (FIG. 17G)

Figure 17H:
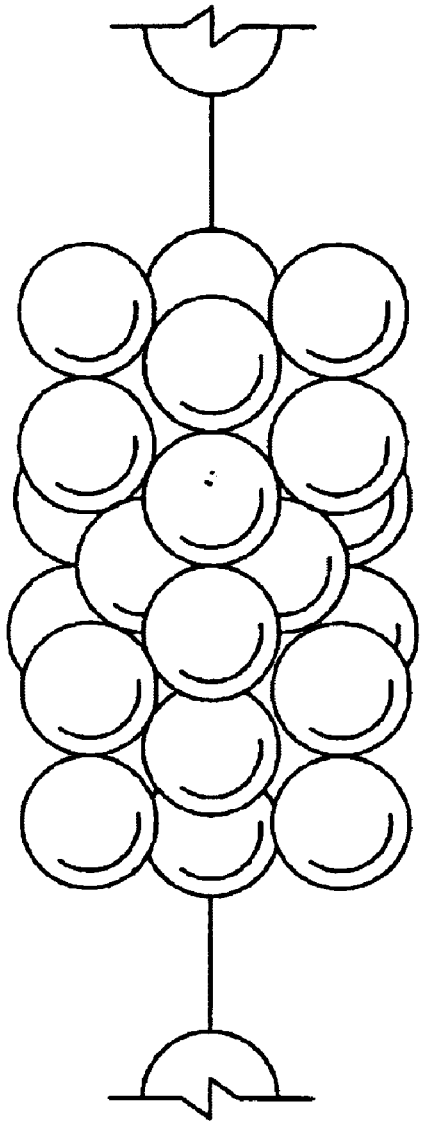

Some Variations Available:

2-Gap: (FIG. 17H)

Figure 17I:
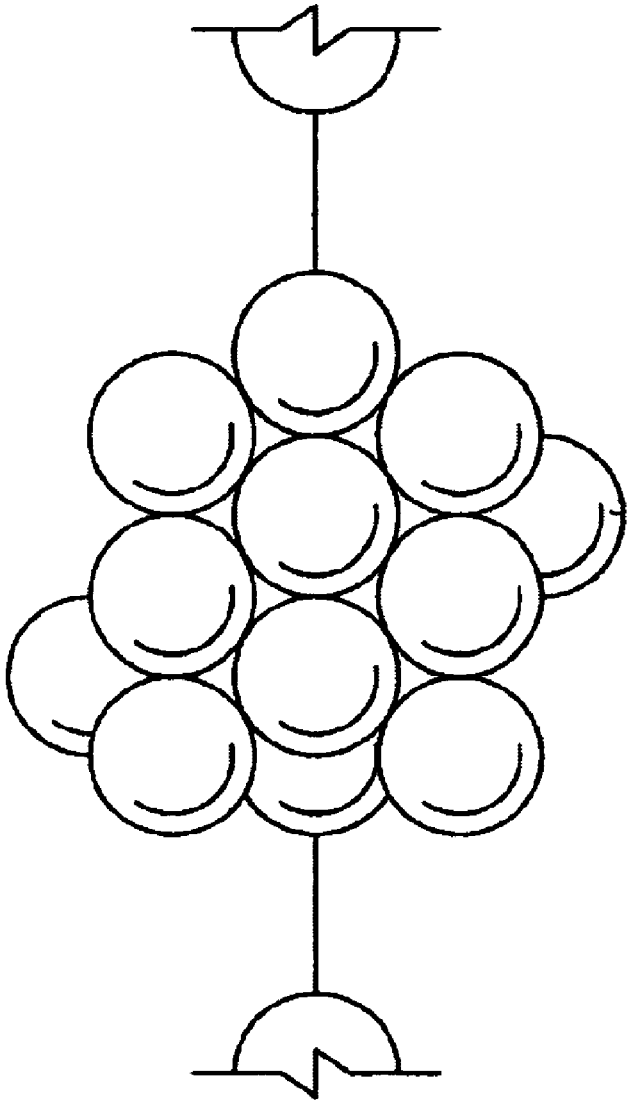

3 Prep-3s: (FIG. 17I)

SPHEREZ SPECIFICATIONS

Spherez is a Carnival bead design that is created by twisting conventional Carnival beads together. It is a mathematical pattern that repeats constantly, giving the product its consistency. There are infinite variations within the Spherez design; however, the repetitious mathematics distinguishes the product.

Spherez utilize double-twisted beads in a spherical arrangement. The basic rule used in determining the product is consistently twisted Carnival beads twisted in a spherical formation.

Figure 18A:
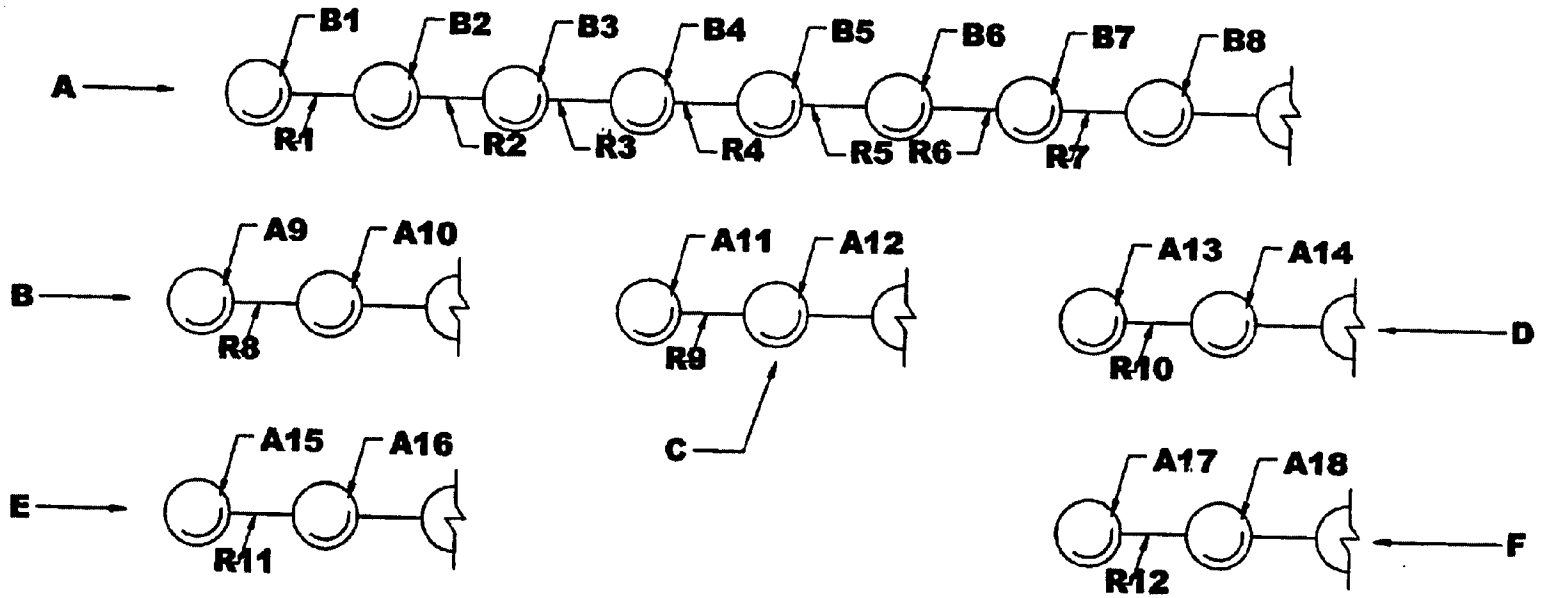
FIGS. 18A–18O provide preferred embodiments of steps of making Spherez beads, along with examples of variations of these types of twisted beads.
Figure 18B:
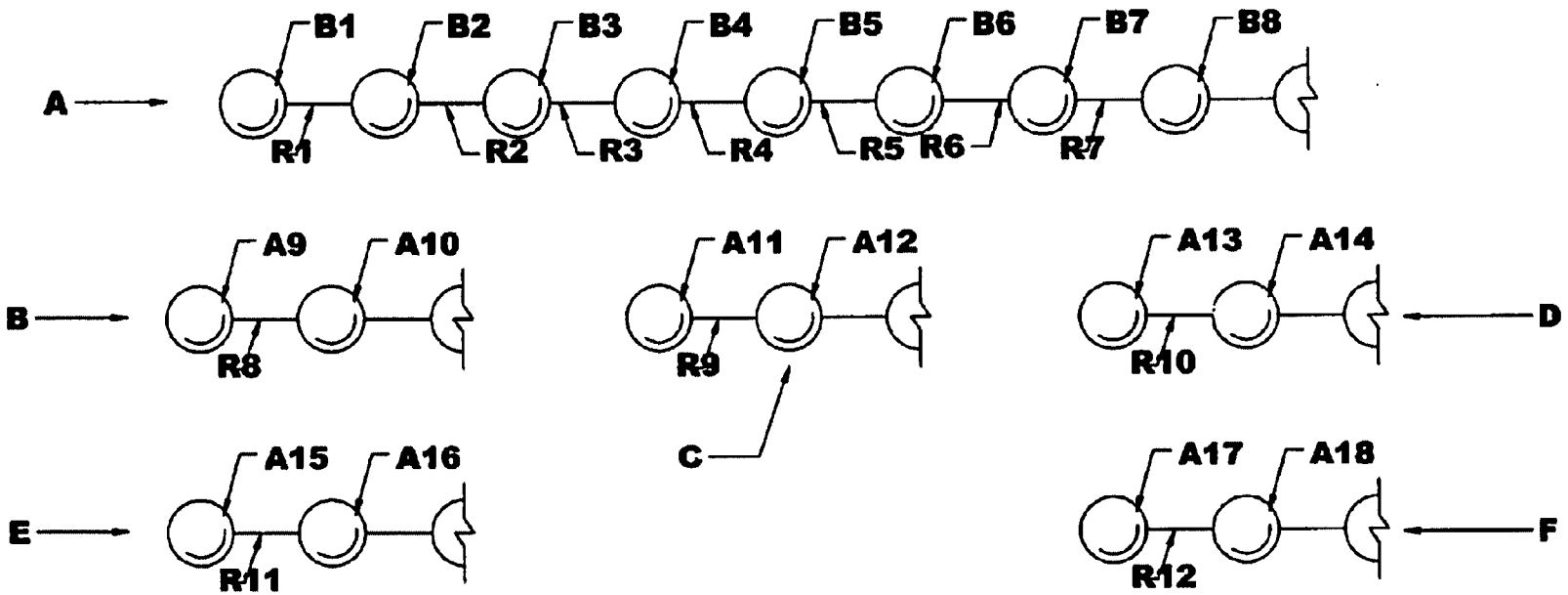
Figure 18C:
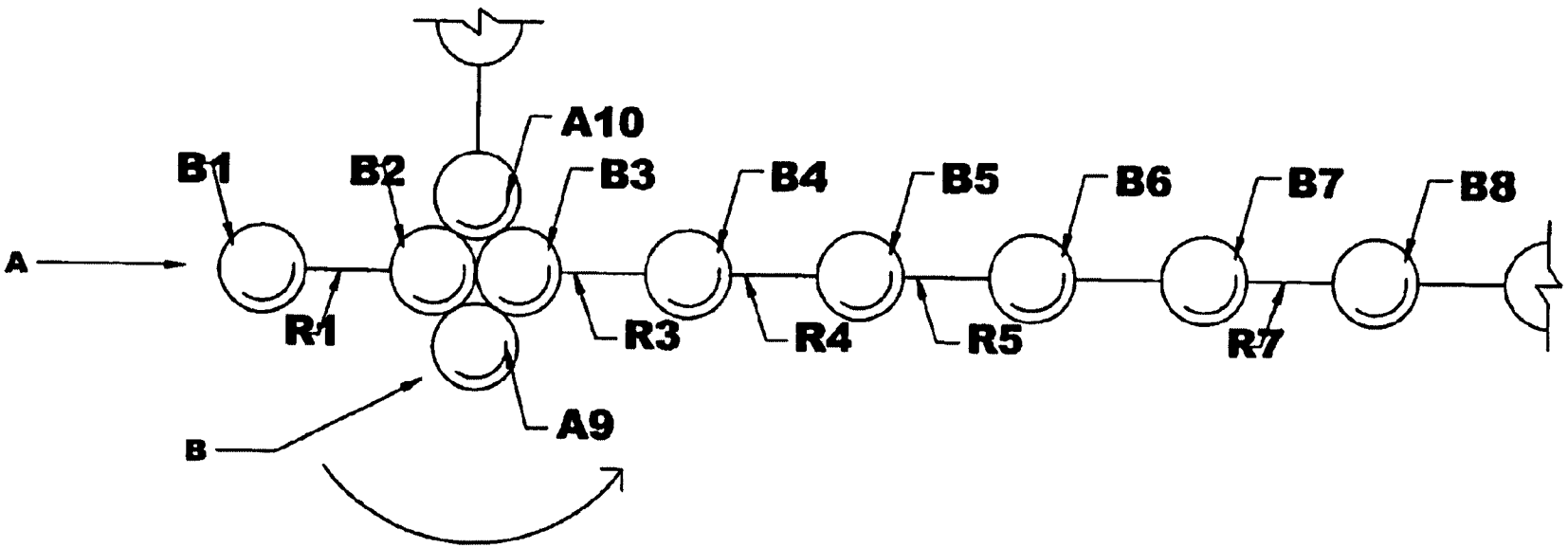
Figure 18D:
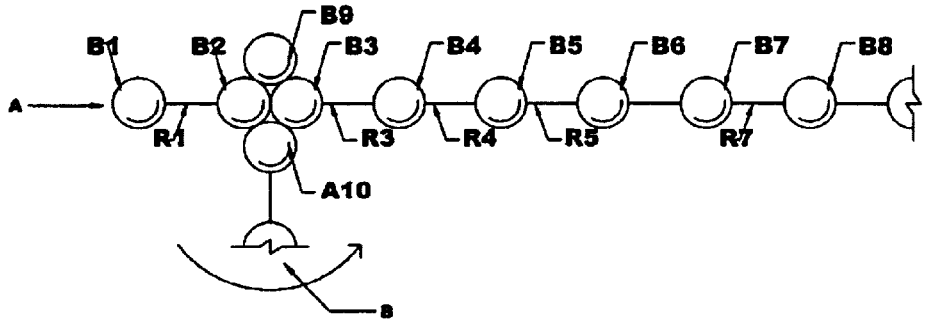
Figure 18E:
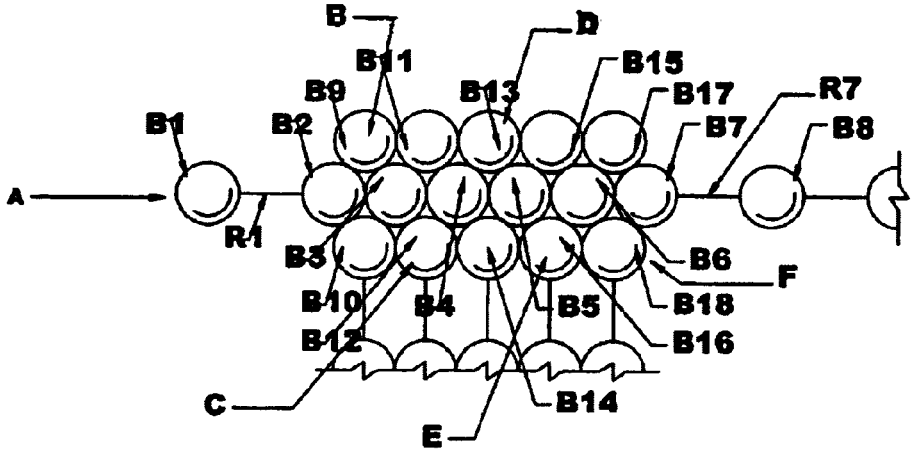
Figure 18F:
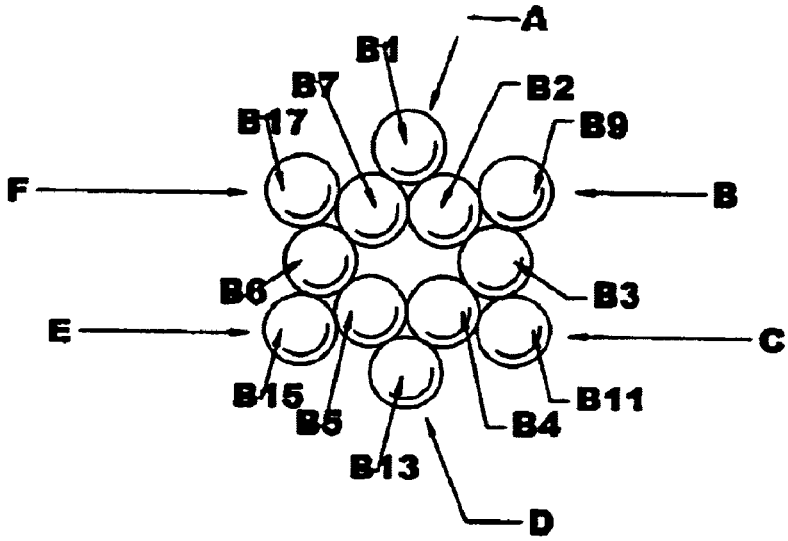
Figure 18G:
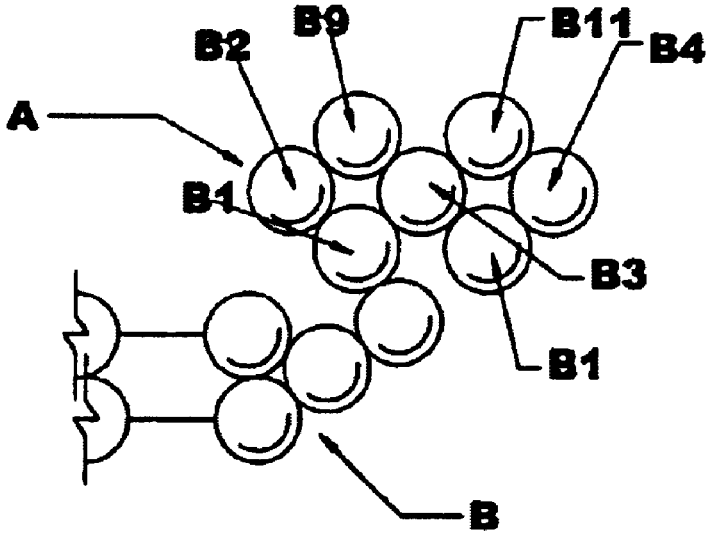
Figure 18H:
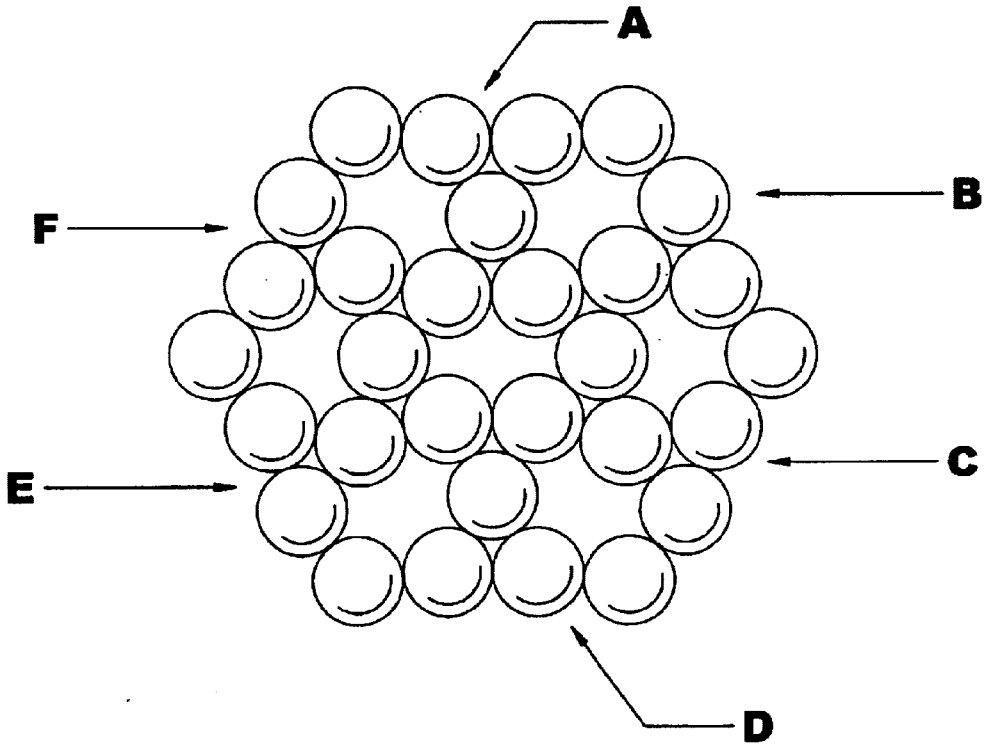
Figure 18I:
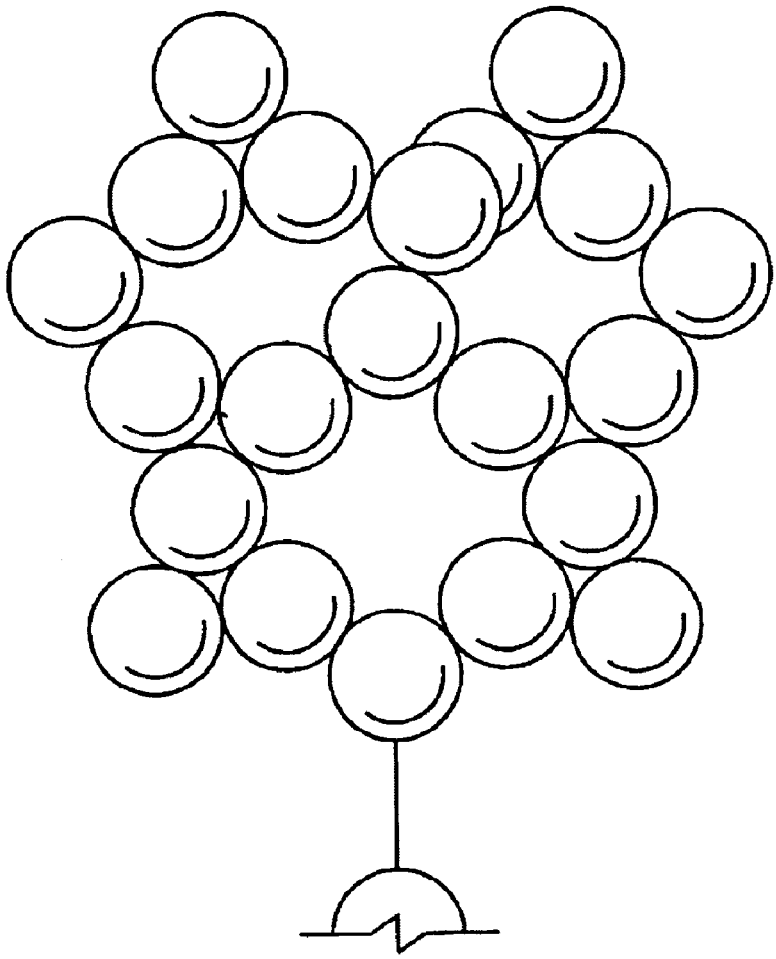
Figure 18J:
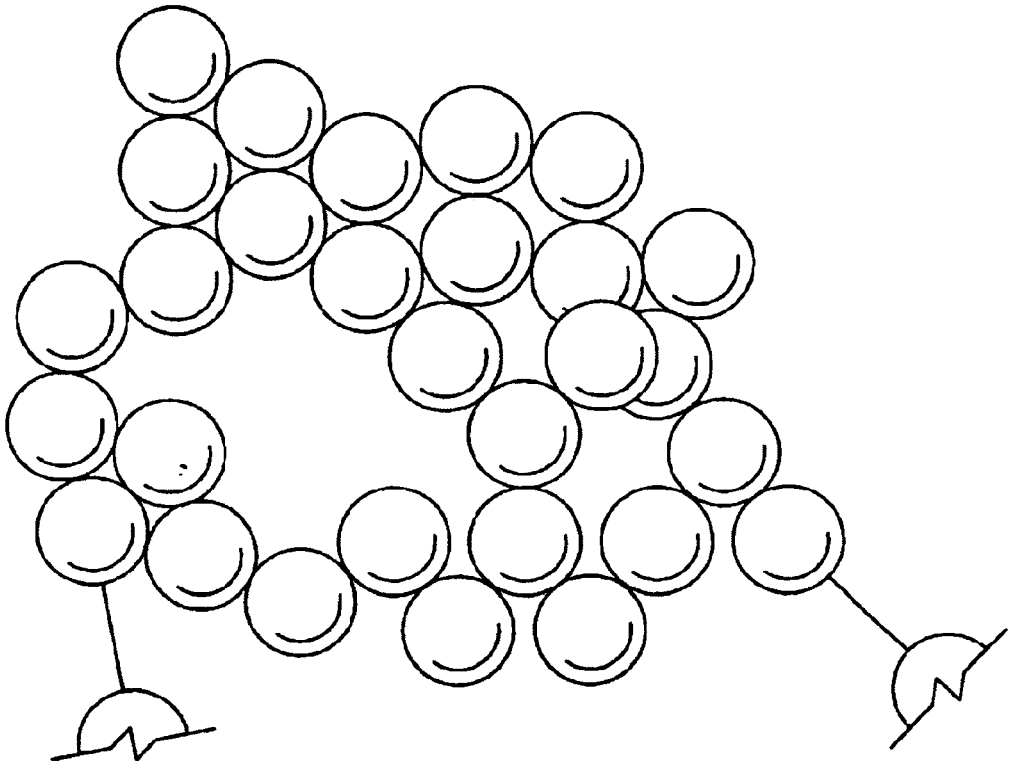
Figure 18K:
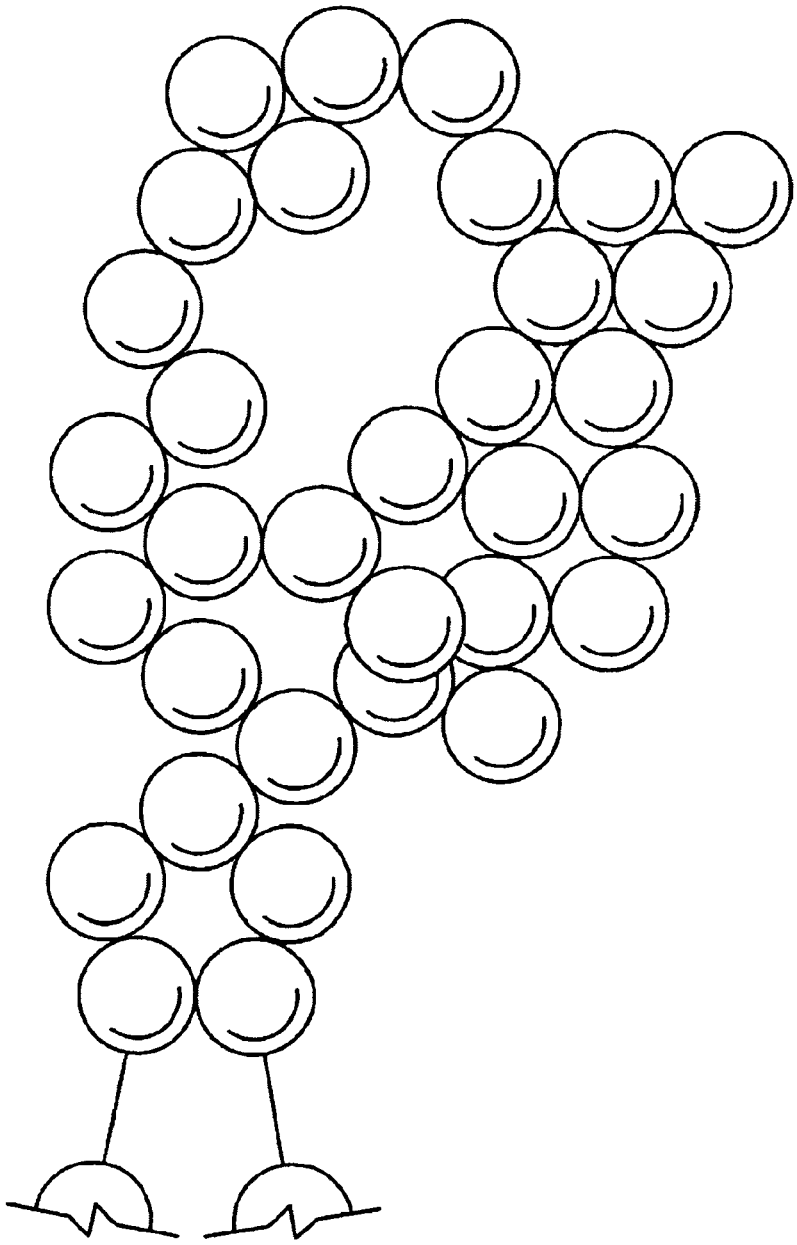
Figure 18L:
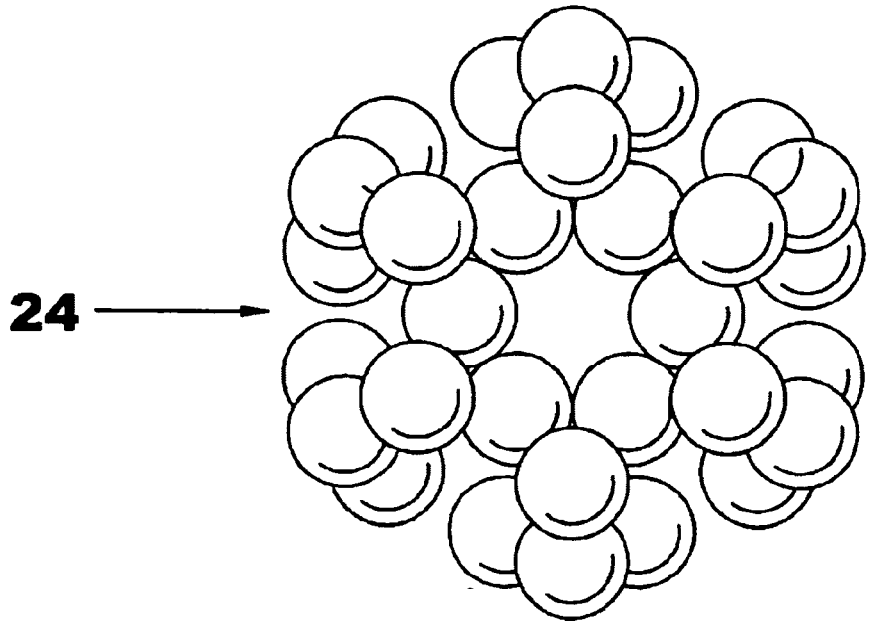
Figure 18M:
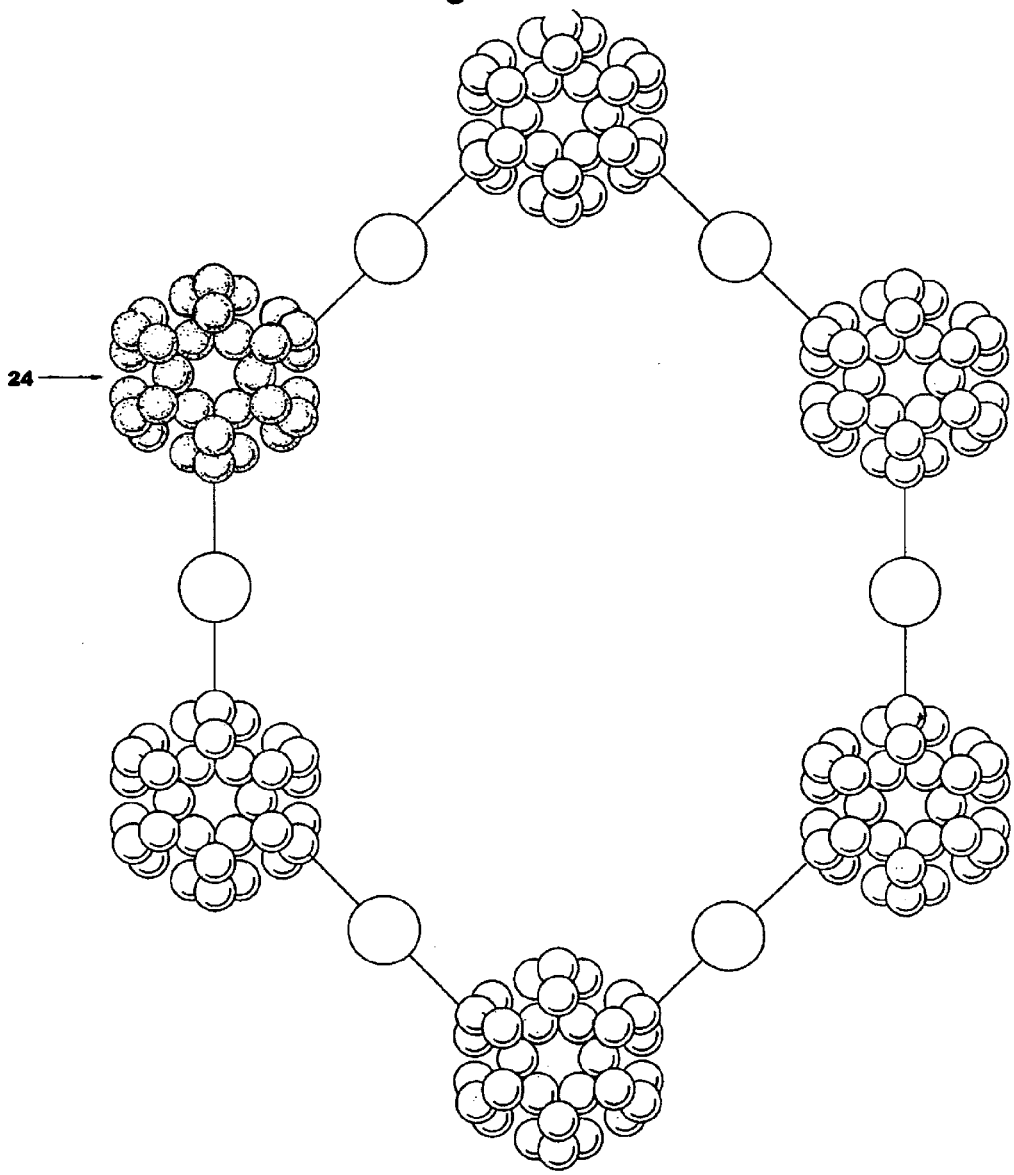

How to Make a Set of Spherez:

1. Choose the variables within the pattern, i.e. color scheme, 6-5-6-5-6, 12-5-6-6-5-12, etc.
2. Create a Sphere by:
   A. Take six strands of conventional Carnival beads (FIG. 18A)
   B. Choose beads 2,3,9,10 (FIG. 18B)
   C. Twist beads 9,10 to the right (FIG. 18C)
   D. Twist beads 9,10 to the right a second time, forming a 360-degree lock between the ropes (FIG. 18D)
   E. Repeat steps B and C with beads [3,4,11,12], [4,5,13,14], [5,6,15,16] and [6,7,17,18] (FIG. 18E)
   F. Take beads 1 and 8 and double-twist them together, forming a 6-Ring Top view (FIG. 18F)
   G. Double-twist two new strands after bead 10; double-twist the original strand to the strand of 11 & 12 (FIG. 18G)
   H. Continue to add one new strand to each original strand; double-twist the original strands together until six 5-Rings are complete (FIG. 18H (top view)
   I. Double-twist two new strands onto two original strands, one each respectively; double-twist the original strands together to form a 6-Ring (FIG. 18I)
   J. Continue to add one new strand to each original strand and double-twist the original strands together to form six 6-Rings (FIG. 18J)
   K. Double-twist two original strands to make a 5-Ring; leave one rope in the 5-Ring empty for finishing step (FIG. 18K)
   L. Double-twist each original strand to each other, one at a time, to make six 5-Rings. Tuck the last bead from the last strand onto the open rope to complete the Sphere. Trim as needed. (FIG. 18L)
3. Push 12-millimeter Prep-3s beads into the ends of Sphere pieces to connect them together. Repeat until length of bead is complete; push the last 12-millimeter Prep-3 into two Sphere pieces to create a Spherez product. (FIG. 18M)

Figure 18N:
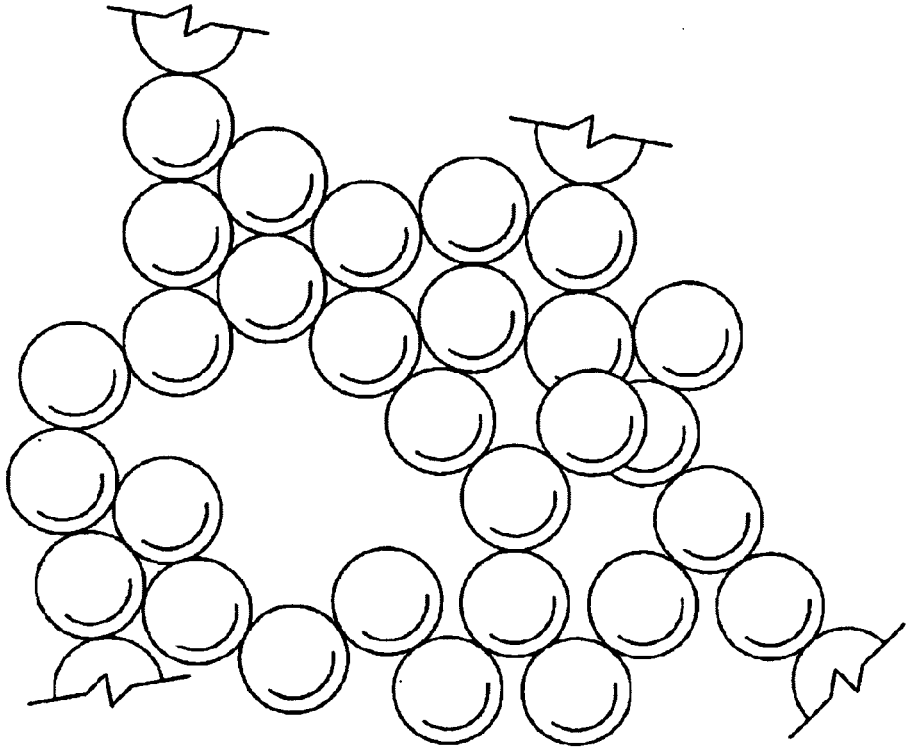
Figure 180:
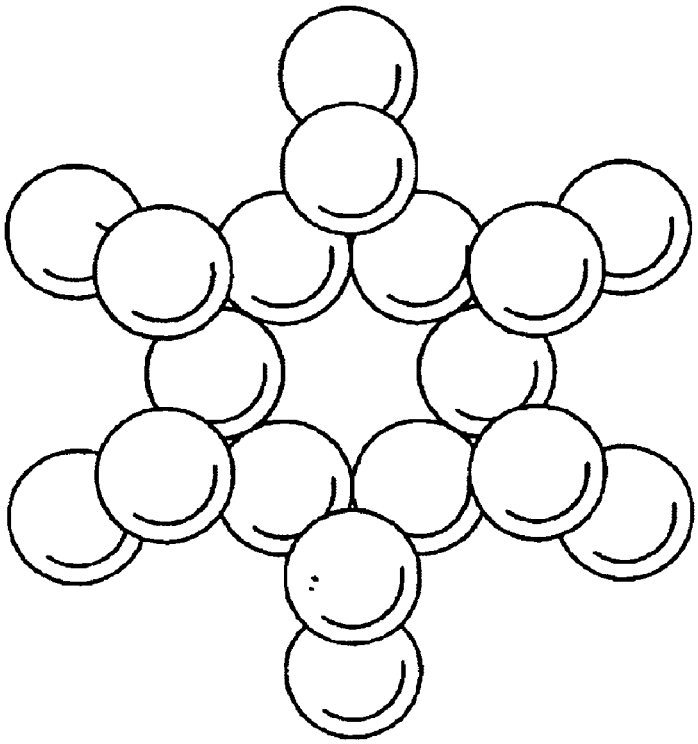

Some Variations Available:

Half-Spherez: (FIG. 18N)

12-5-6-6-5-12: (FIG. 18O)

HYBRIDZ SPECIFICATIONS

Hybridz is a Carnival bead design that is created by twisting conventional Carnival beads together. It is a mathematical pattern that repeats constantly, giving the product its consistency. There are infinite variations within the Hybridz design; however, the repetitious mathematics distinguishes the product.

Hybridz utilize any two or more of the following patterns: Braidz, Boxez, Building Blockz, Curlz, Diamondz, Flowerz, Breakbeadz, Fabricz, Linkz, Loopz, Medallionz, Spiralz, Starz, Spherez, or Helixez. The basic rule used in determining the product is multiple variations of consistently twisted Carnival beads combined together.

Figure 19A:
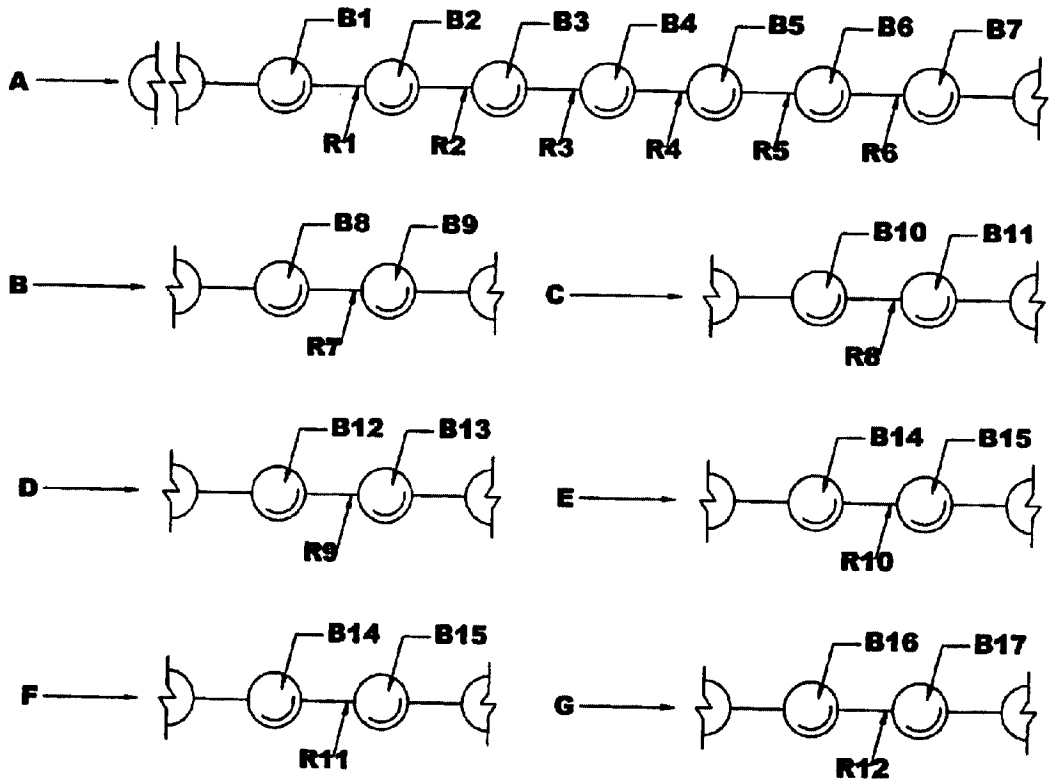
FIGS. 19A–19L provide preferred embodiments of steps of making Hybridz beads, along with examples of variations of these types of twisted beads.
Figure 19B:
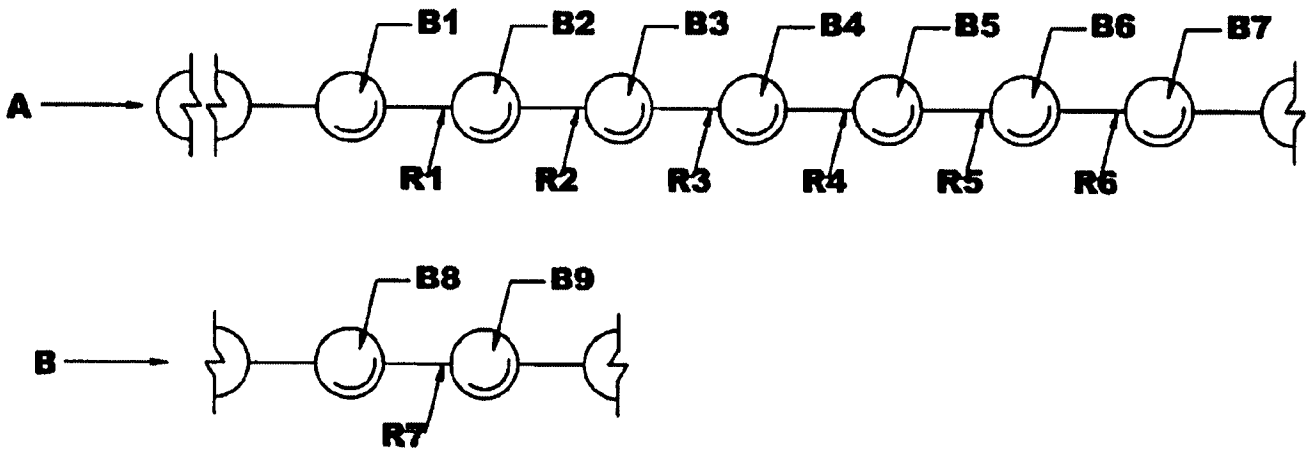
Figure 19C:
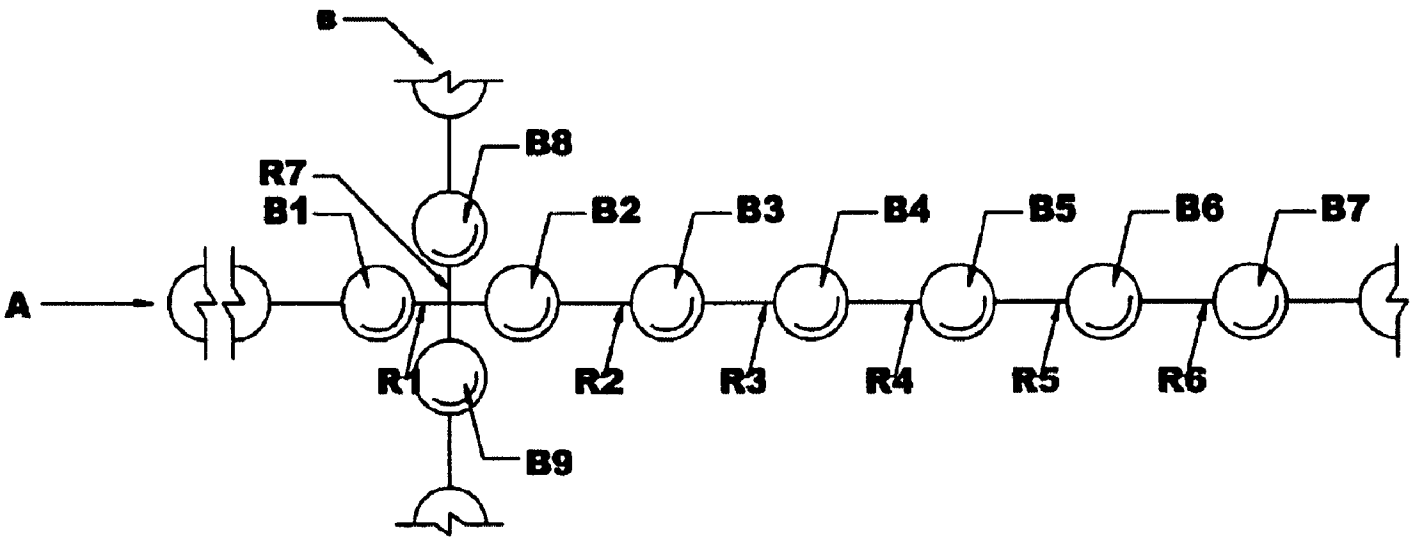
Figure 19D:
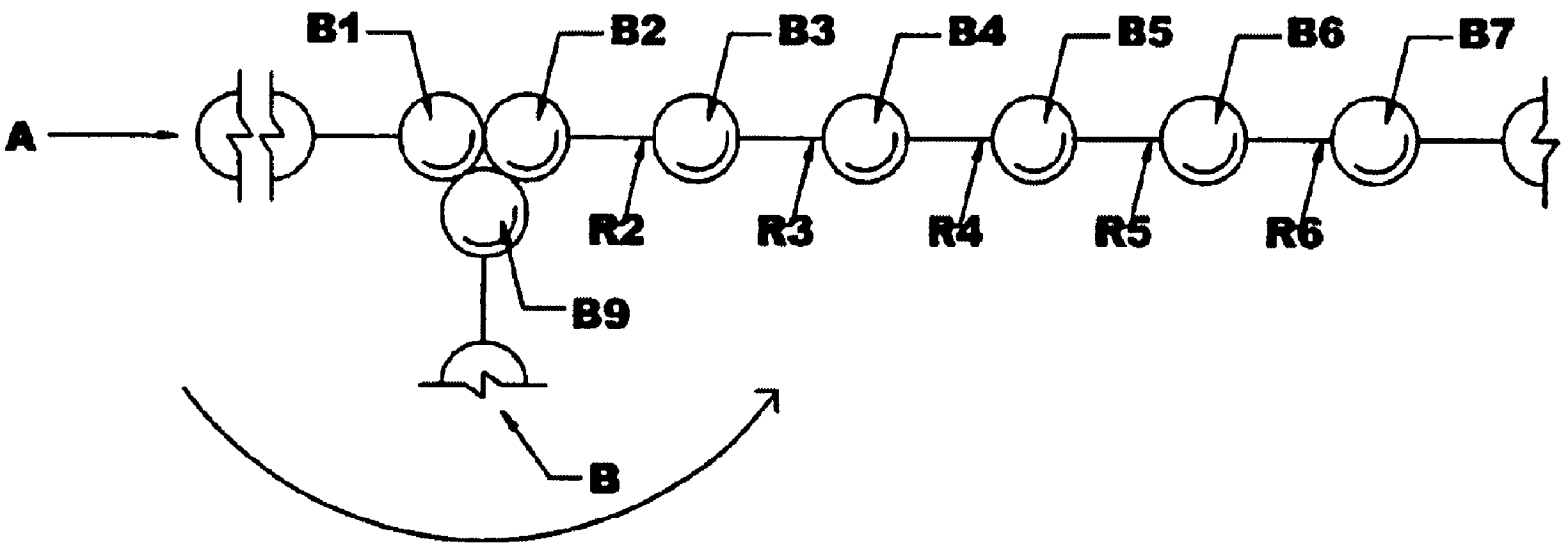
Figure 19E:
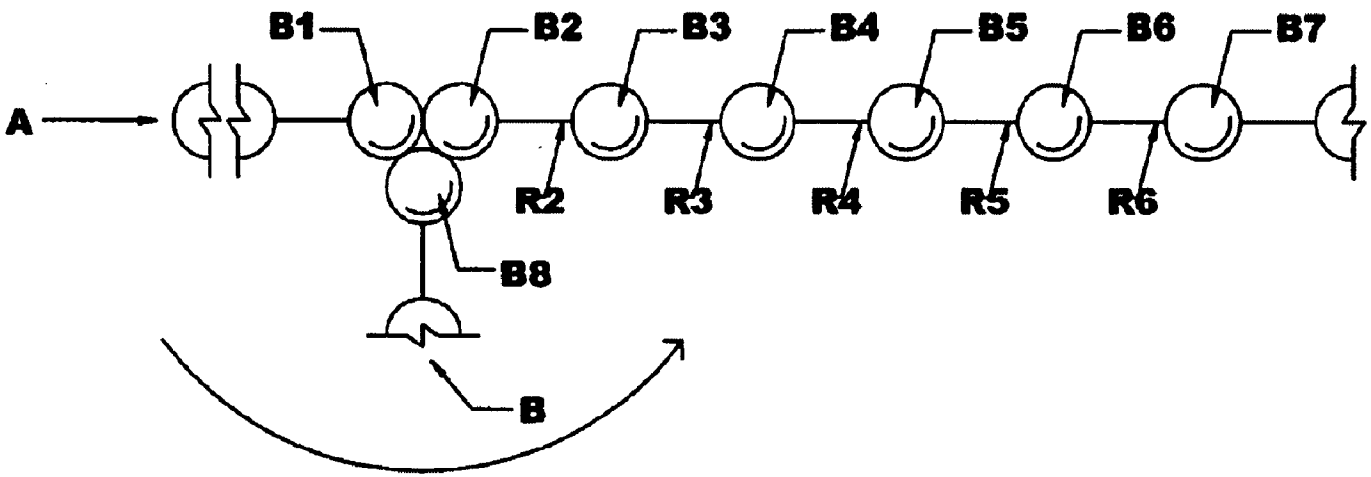
Figure 19F:
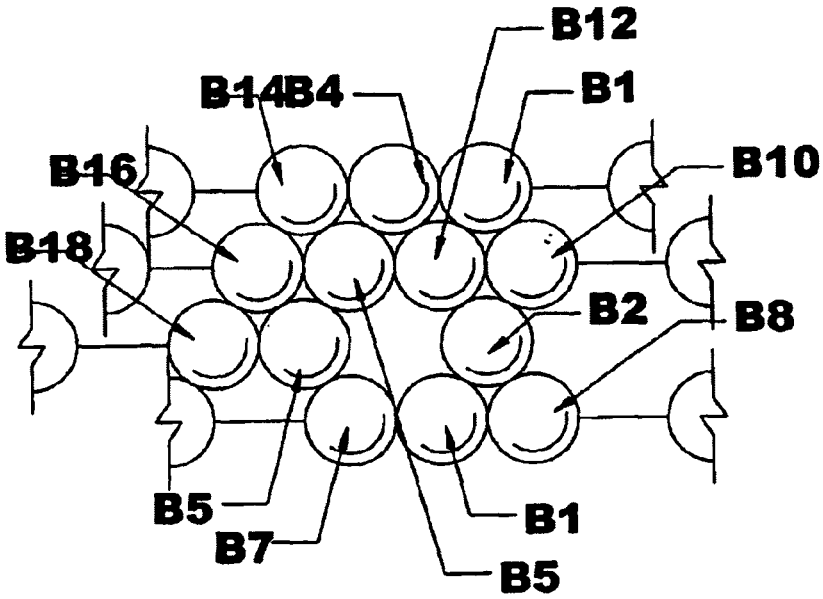
Figure 19G:
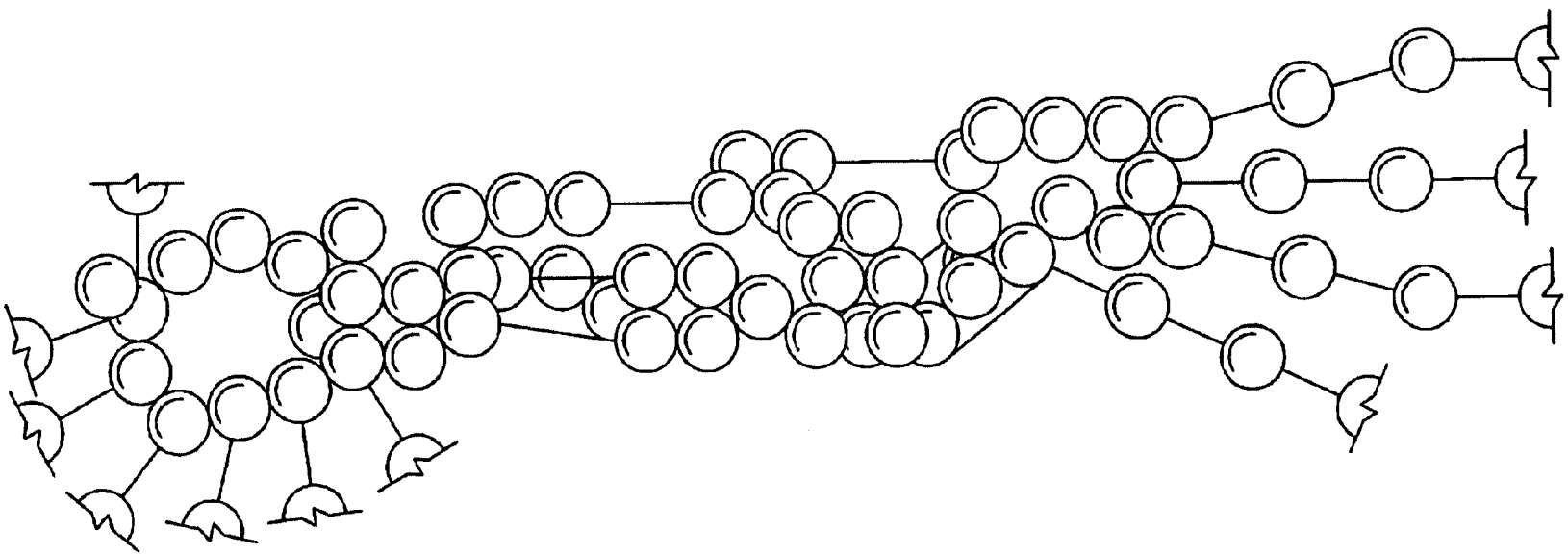
Figure 19H:
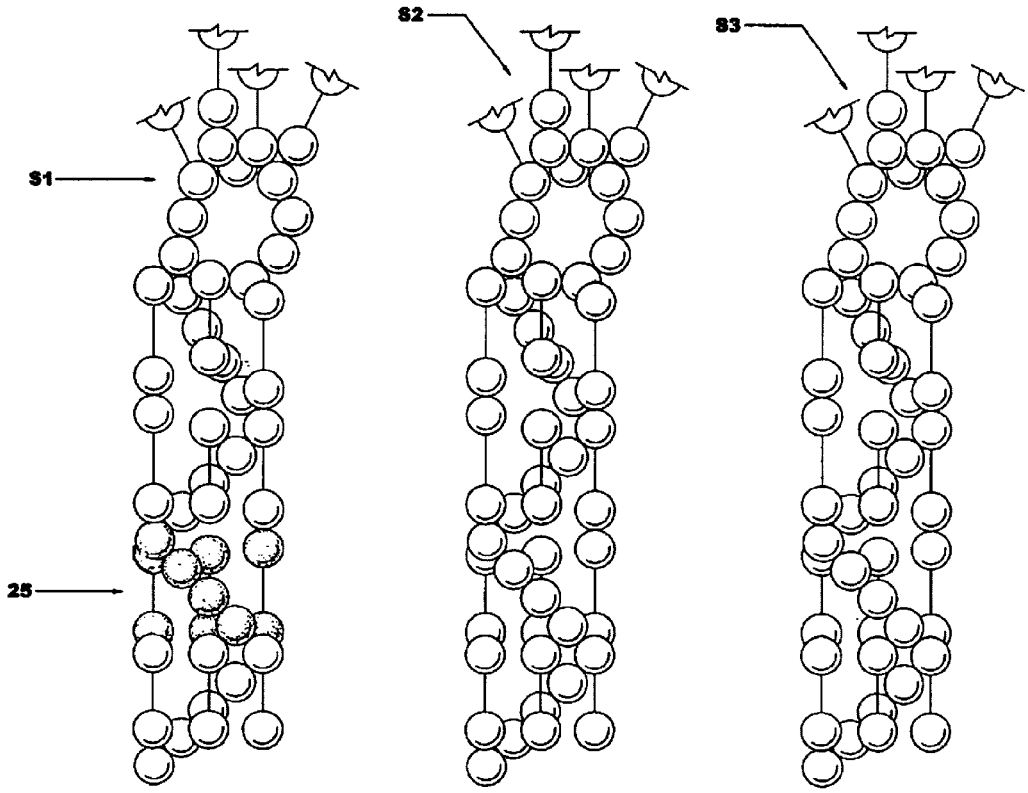
Figure 19I:
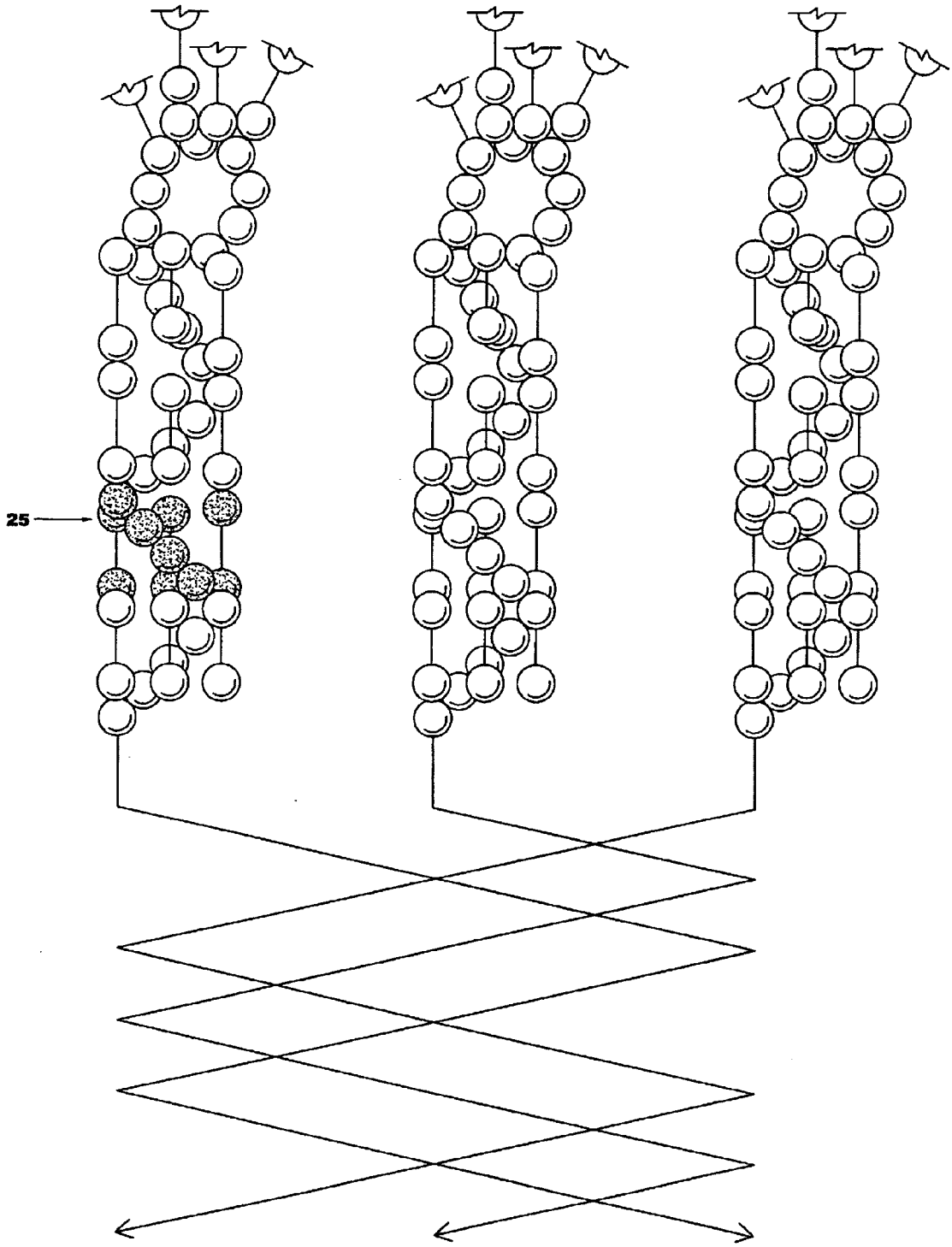
Figure 19J:
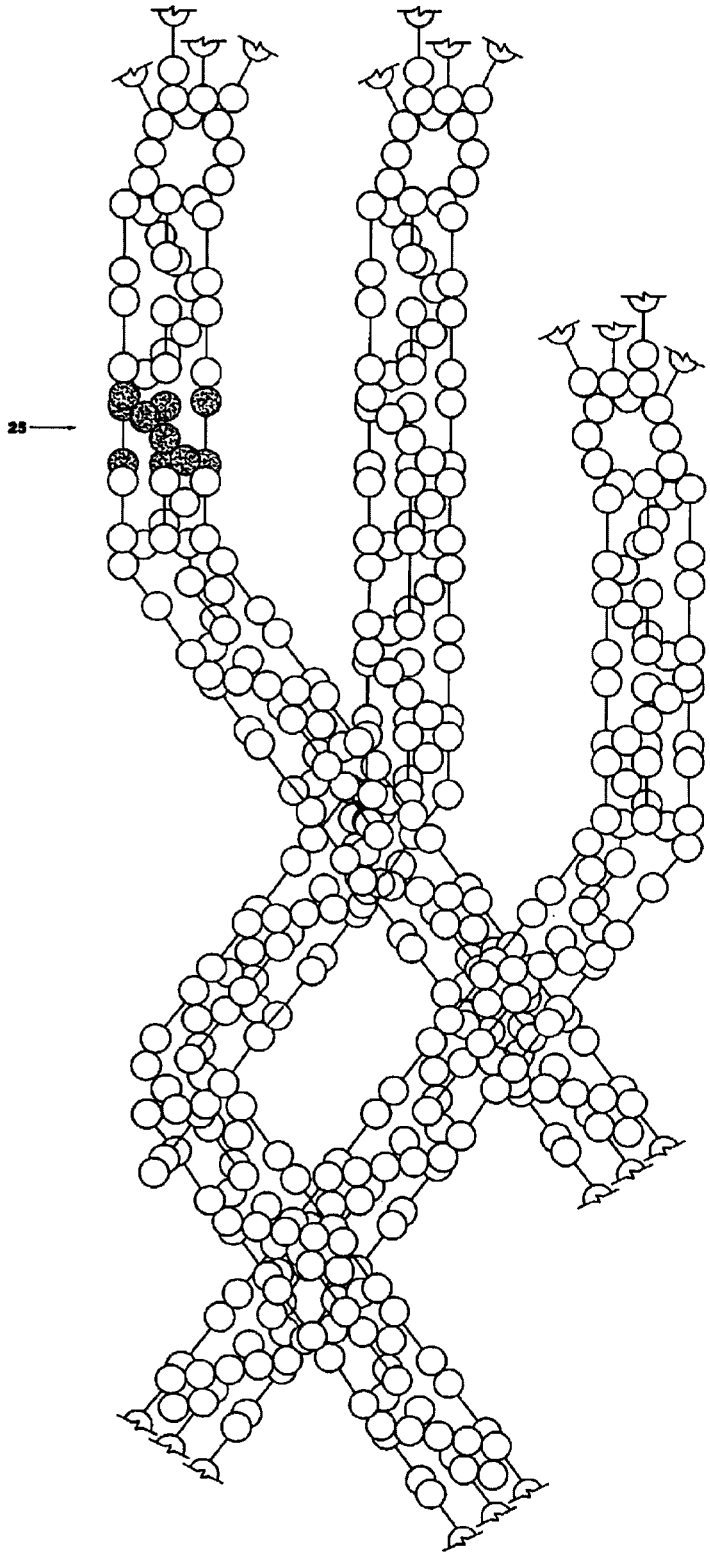

How to Make a Set of Hybridz:

1. Choose the combination of pattern variations, i.e. Braidz+Spiralz (King Cakez), Boxez+Medallionz (Independent Suspenzion)
2. Make a 6-Spiral by:
   A. Take seven strands of conventional Carnival beads (FIG. 19A)
   B. Leave three beads at the beginning of each strand to leave space for the finishing step
   C. Choose beads 1,2,8,9 (FIG. 19B)
   D. Cross the $1^{st}$ rope on the second strand over the $1^{st}$ rope on the first strand (FIG. 19C)
   E. Twist beads 8,9 to the right (FIG. 19D)
   F. Twist beads 8,9 to the right a second time, forming a 360-degree lock with the $1^{st}$ ropes (FIG. 19E)
   G. Double-twist the $1^{st}$ rope on strands 3,4,5,6,7 to every available rope on the spine strand (FIG. 19F)
   H. Skip one rope on the second strand and double-twist it to the next available rope on the spine bead. Repeat with other strands to lengthen the pattern to required length. (FIG. 19G)
3. Complete twisting three 6-Spiralz (FIG. 19H)
4. Begin braiding the three 6-Spiralz together, using a left-over-middle, right-over-middle braiding technique (FIG. 19I)
5. Finish braiding all three 6-Spiralz together, then double-twist the appropriate ends of each Spiral together to create the seam; trim any excess beads to create a Hybridz King Cakez product. (FIG. 19J)

Figure 19K:
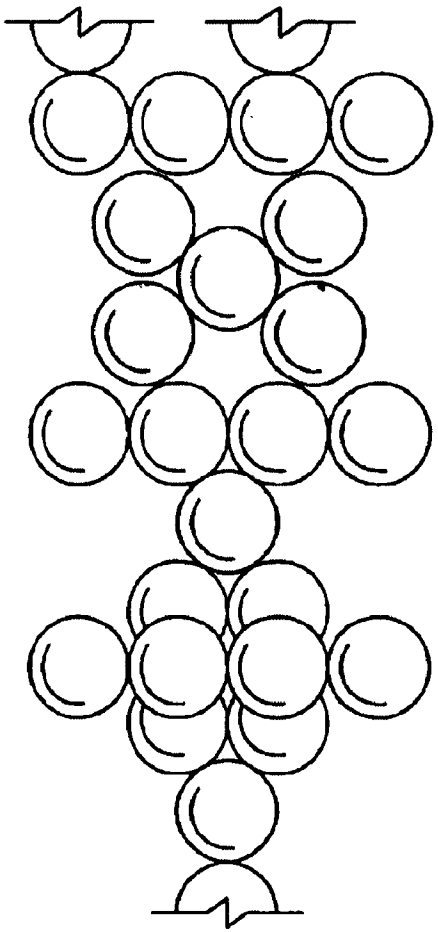

Some Variations Available:

Boxez-Diamondz: (FIG. 19K)

Figure 19L:
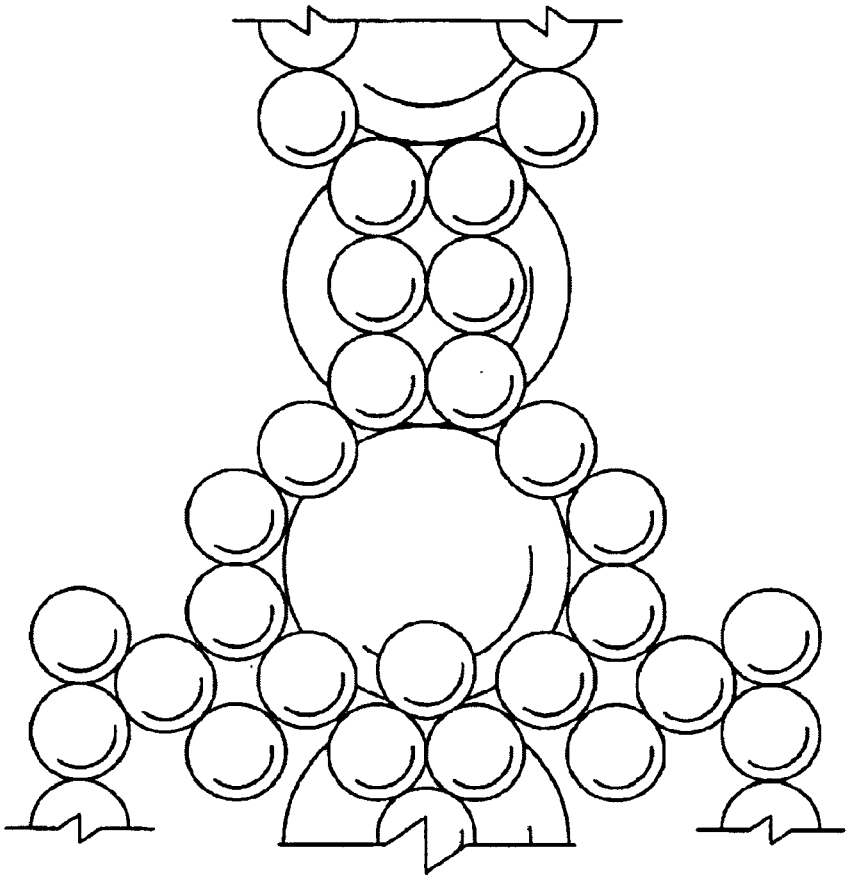

Independent Suspenzion: (FIG. 19L)

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

What is claimed is:

1. A method of making a Helixez bead structure from carnival beads, said Helixez bead structure having a quaternary structure formed from a plurality of twisted carnival bead strands, comprising:

providing a primary strand of carnival beads, said strand having a string and having a plurality of beads, each bead fixed thereon, the adjacent beads of said beads of said primary strand having a fixed rope spaces therebetween, preparing a plurality of Prep-4 strands by cutting carnival beads strands into individual strands having four beads each, each said individual strand having a first rope space r1 between a first bead P1 and a second bead P2, a middle rope space r2 between said second bead P2 and a third bead P3, and a last rope space r3 between said third bead P3 and fourth bead P4, forming a plurality of forearms along said primary strand, each said forearm formed by using the following steps:

(a) laying a Prep-4 over said primary strand such that said middle rope space r2 of said first Prep-4 intersects and contacts a rope space X of said primary strand, such that said first bead P1 and second bead P2 hang down of a first side of said primary strand, and such that said third bead P3 and said fourth bead P4 hang down on a second side of said primary strand, (b) twisting said Prep-4 around said rope space X of said primary strand such that said third bead P3 and said fourth bead P4 are positioned on said first side of said primary strand while said first bead P1 and said second bead P2 are positioned on said second side of said primary strand, whereby said middle rope space r2 of said Prep-4 strand is twisted around said rope space X of said primary strand and said Prep4 and said primary strand are interlocked to one another, (c) twisting a rope space X−2 and a rope space X+2 of said primary strand 180 degrees relative to one another to thereby form a forearm, wherein said first rope space r1 and said last rope space r3 of said Prep-4 remain unoccupied and available for twisting, and forming a Helixez configuration by interlocking each said forearm to another of said forearms via twisting of said unoccupied rope spaces of said forearms.

2. The method of claim 1, wherein said locking of forearms is accomplished by sequentially twisting an unoccupied rope space of a forearm around an unoccupied rope space of an immediately adjacent forearm, to thereby form a basic Helixez configuration.

3. The method of claim 1, wherein said locking of forearms is accomplished by twisting a free rope space of each odd numbered forearm around a free rope space of an adjacent odd numbered forearm and twisting a free rope space of each even numbered forearm around a free rope space of an adjacent even numbered forearm, to thereby form a Flat Helixez configuration.

4. The method of claim 2, further comprising selectively trimming off excess beads from said Helixez bead structure.

5. The method of claim 1, further comprising lengthening said Helixez bead structure by interlocking said Helixez bead structure to a second Helixez bead structure, said interlocking accomplished by twisting an unoccupied rope space of said Helixez bead structure around an unoccupied rope space of said Helixez bead structure.

6. The method of claim 1, further comprising covering an exterior surface of said Helixez bead structure with a protective coating.

7. The method of claim 6, wherein said coating is a clear coat to thereby allow said beads to remain visible below said coating.

8. The method of claim 6, wherein said coating is acrylic.

9. The method of claim 6, wherein said coating is sprayed onto the beads.

10. The method of claim 6, wherein said coating is brushed onto the beads.

11. The method of claim 6, wherein said coating is applied by dipping the beads into said coating.

12. A method of making a Tight Helixez bead structure from carnival beads, said Helixez bead structure having a quaternary structure formed from a plurality of twisted carnival bead strands, comprising:

providing a primary strand of carnival beads, said strand having a string and having a plurality of beads, each bead fixed thereon, the adjacent beads of said beads of said primary strand having a fixed rope spaces therebetween, preparing a plurality of Prep-4 strands by cutting carnival beads strands into individual strands having four beads each, each said individual strand having a first rope space r1 between a first bead P1 and a second bead P2, a middle rope space r2 between said second bead P2 and a third bead P3, and a last rope space r3 between said third bead P3 and a fourth bead P4, forming a plurality of forearms along said primary strand, each said forearm formed by using the following steps:

(a) laying a Prep-4 over said primary strand such that said middle rope space r2 of said first Prep-4 intersects and contacts a rope space X of said primary strand, such that said first bead P1 and second bead P2 hang down on a first side of said primary strand, and such that said third bead P3 and said fourth bead P4 hang down on a second side of said primary strand, (b) twisting a rope space X−2 and a rope space X+2 of said primary strand 180 degrees relative to one another to thereby form a forearm, wherein said first rope space r1 and said last rope space r3 of said Prep-4 remain unoccupied and available for twisting, and forming a Helixez configuration by interlocking each said forearm to another of said forearms via twisting of said unoccupied rope spaces of said forearms.

13. A method of making a unit of Building Blockz beads, said unit of Building Blockz beads having a quaternary twisted bead structure, comprising:

providing a primary strand of carnival beads, said strand having a string and having a plurality of beads, each bead fixed thereon, the adjacent beads of said beads of said primary strand having a fixed rope spaces therebetween, preparing a first and a second primary Prep-X stand by cutting carnival beads strands into individual strands having a desired number of beads X, each said primary Prep-X having a first rope space, a last rope space, and a plurality of rope spaces between said first and said last rope spaces, preparing a plurality of secondary Prep-Y strands by cutting carnival beads strands into individual strands having a desired number of beads Y, each said secondary Prep Y having a first rope space, a last rope space, and one or more rope spaces between said first and said last rope spaces, setting said first and said second Prep-X strands side-by-side in a substantially parallel arrangement, laying a first Prep-Y over said pair of Prep-X strands such that said first rope space of said first Prep-Y intersects a second rope space of said first Prep-X and such that said last rope space of said first Prep-Y intersects a second rope space of said second Prep-X, twisting a first bead of said first Prep-Y around said second rope space of said first Prep-X strand such that said first rope space of said first Prep-Y tightly encircles said second rope space of said first Prep-X, thereby locking said first Prep-Y to said first Prep-X, twisting a last bead of said first Prep-Y around said second rope space of said second Prep-X strand such that said last rope space of said first Prep-Y tightly encircles said second rope space of said second Prep-X, thereby locking said first Prep-Y to said second Prep-X, flipping said interlocked first and second Prep-X strands over, laying a second Prep-Y over said pair of Prep-X strands such that said first rope space of said second Prep-Y intersects a third rope space of said first Prep-X and such that said last rope space of said second Prep-Y intersects a third rope space of said second Prep-X, twisting a first bead of said second Prep-Y around said third rope space of said first Prep-X strand such that said first rope space of said second Prep-Y tightly encircles said third rope space of said first Prep-X, thereby locking said second Prep-Y to said first Prep-X, and twisting a last bead of said second Prep-Y around said third rope space of said second Prep-X strand such that said last rope space of said second Prep-Y tightly encircles said third rope space of said second Prep-X, thereby locking said second Prep-Y to said second Prep-X.

14. The method of claim 13, further comprising adding additional Prep-Y pieces to said first and said second Prep-X strands according to the steps of claim 1 until substantially all but said first and said last rope spaces of said first Prep-X and said second Prep-X are interlocked via a Prep-Y strand, such that said first and said last rope spaces are unoccupied.

15. The method of claim 14, further comprising selectively trimming off excess beads from the Building Blockz unit.

16. The method of claim 14, wherein said Prep-Y strands have three beads.

17. The method of claim 14, further comprising covering an exterior surface of said Building Blockz beads with a protective coating.

18. The method of claim 14, further comprising constructing an object from said Building Blockz unit by interlocking said Building Blockz unit to at least a second Building Blockz unit, said interlocking accomplished by twisting an unoccupied rope space of said Building Blockz unit around an unoccupied rope space of said second Building Blockz unit.

* * * * *